US011633662B2

(12) United States Patent
DeGraff

(10) Patent No.: US 11,633,662 B2
(45) Date of Patent: Apr. 25, 2023

(54) SYSTEM AND METHOD OF USE FOR REPLICATING THE MOTIONS OF SNOW SKIING IN DRY CONDITIONS

(71) Applicant: Timothy Robert DeGraff, Sacramento, CA (US)

(72) Inventor: Timothy Robert DeGraff, Sacramento, CA (US)

( * ) Notice: Subject to any disclaimer, the term of this patent is extended or adjusted under 35 U.S.C. 154(b) by 0 days.

(21) Appl. No.: 17/352,270

(22) Filed: Jun. 19, 2021

(65) Prior Publication Data

US 2022/0387877 A1 Dec. 8, 2022

Related U.S. Application Data

(63) Continuation-in-part of application No. 17/339,981, filed on Jun. 5, 2021, now Pat. No. 11,273,363.

(51) Int. Cl.

| | |
|---|---|
| ***A63C 17/04*** | (2006.01) |
| ***A63C 17/26*** | (2006.01) |
| ***A63C 17/00*** | (2006.01) |

(52) U.S. Cl.

CPC ..... *A63C 17/045* (2013.01); *A63C 17/0033* (2013.01); *A63C 17/262* (2013.01); *A63C 2203/42* (2013.01)

(58) Field of Classification Search

CPC . A63C 17/045; A63C 17/0033; A63C 17/262; A63C 2203/42

See application file for complete search history.

(56) References Cited

U.S. PATENT DOCUMENTS

| | | | | |
|---|---|---|---|---|
| 5,553,874 | A * | 9/1996 | Schouten | A63C 17/014 280/11.28 |
| 5,901,981 | A * | 5/1999 | Lucht | A63C 17/045 280/11.221 |
| 2008/0084034 | A1* | 4/2008 | Feldman | A63C 1/28 280/11.115 |
| 2011/0109053 | A1* | 5/2011 | Peruffo | A63C 17/1409 280/11.207 |
| 2012/0126523 | A1* | 5/2012 | Langer | A63C 17/045 280/842 |
| 2014/0291947 | A1* | 10/2014 | Maniatty | A63C 17/004 280/11.221 |
| 2015/0202522 | A1* | 7/2015 | Park | A63C 17/045 29/434 |
| 2016/0175692 | A1* | 6/2016 | Burns | A63C 17/262 280/842 |
| 2017/0348586 | A1* | 12/2017 | Davis, Jr. | A63C 17/045 |

* cited by examiner

*Primary Examiner* — Brian L Swenson

(74) *Attorney, Agent, or Firm* — Melvin K. Silverman

(57) ABSTRACT

A system, method, and apparatus for replicating the experience of snow skiing on dry land using a roller land ski with an ability to move and stop consistent with mechanics of an actual snow ski. Each land ski includes a rigid platform with a binding for engagement with a specialized boot, a pair of biased omnidirectional casters supporting said rigid platform, but mounted to a top surface of said platform, and a pair of trucks with a plurality of wheels along its curved axles. A pair of specialized boots constructed out of flexible lightweight material with a stiff support structure to fortify a user's foot and ankle from the forces created by the land ski are included in this system. The method includes calibration and selection of materials for both the board and boot in order to achieve the desired experience.

47 Claims, 35 Drawing Sheets

SYSTEM AND METHOD OF USE FOR REPLICATING THE MOTIONS OF SNOW SKIING IN DRY CONDITIONS

CROSS REFERENCE TO RELATED APPLICATIONS

The application is a continuation of application Ser. No. 17/339,981, filed Jun. 5, 2021. All prior related patents and patent applications are herein incorporated by reference in their entirety.

FIELD OF INVENTION

The invention generally relates to roller skiing on a dry surfaces including road surfaces such as concrete or asphalt.

BACKGROUND

Skiing is a widely practiced winter sport that spans every continent. Unfortunately, because the sport relies on the conditions created by gliding over snow, many are unable to experience the sport in warmer months and in dryer climates. This has led many to develop alternatives to snow skiing over a broad spectrum of technologies.

However, the alternatives to snow skiing either require a special terrain, or forgo the typical mechanics and movements associated with downhill snow skiing. Further, when turning with some devices of the prior art, the inward edge may lower slightly, but a pivoted wheel is truly where the majority of the turn occurs. Therefore, a quick, jerky shift in weight will only accomplish a turn just as well as a slow, fluid, uninterrupted transfer of weight. These systems fail to allow the broad spectrum of activities typically associated with snow skiing, including downhill skiing, carving, and the ability to perform tricks and other maneuvers and use the skis with grinding on rails in a terrain park. A rider can ride a lateral sliding roller ski, on a city street, a sidewalk, a playground, a sports complex, or some other surface to simulate unique movements of skiing but such devices do not mimic the unique movements and carving ability of skiers nor do they allow riders to grind rails, other obstacles, nor conduct nose or tail butters in a similar manner as skiers in terrain parks. Therefore, no current system is a complete correlative invention to snow skiing, including sliding or stopping, which is crucial to skiing down an asphalt hill. Thus, a need in the snow sporting industry has arisen for a roller ski that can provide for an experience that closely mimics the movement and feeling of snow skiing.

SUMMARY OF THE INVENTION

The disclosure herein provides for a roller land ski with an ability to move and stop consistent with mechanics of an actual snow ski. The land ski comprises a rigid platform with a top and bottom surface having a pair of trucks mounted to the bottom surface wherein carving wheels are mounted to curved axles to provide movability of the rigid platform. Each truck has a curved axle on either side of the truck and said curved axles extend away from each of said trucks in a semicircular arch wherein the distal ends of said axles are closer to the surface of said rigid platform to enhance the turning radius of the rigid platform. A pair of biased omnidirectional casters are included and spaced laterally apart toward the distal ends of the rigid platform. An alpine ski binding mount is affixed to the top surface of the rigid platform in a front to back orientation configured to receive an alpine ski boot connection.

Further provided herein is a system for replicating the experience of skiing on dry land. The system includes a pair of land skis as described above, with an alpine binding, and a pair of specialized ski boots.

Each of said boots in said pair of boots further includes an upper constructed of flexible material, a stiff cuff surrounding said opening, a fastener for tightening said opening, a tongue portion, a sole having a top portion and a bottom portion, an internal liner, an ankle support structure, and laces for constricting a volume created by a cavity between said upper and said sole; and The upper forms an opening configured for receiving a user's foot. The sole is configured to include the bottom portion having a linear bottom surface, wherein a toe and heel of said linear bottom surface each outwardly curve upward. The sole terminates at a forward portion in a toe lug configured for use with an alpine binding connection. The sole also terminates at a rear portion in a heel lug configured for use with an alpine binding connection. The bottom portion of the sole comprises a rubber lower surface with treads formed therein.

The internal liner, the upper of flexible material, and the sole are bonded through sonic welding to form a unitary piece, wherein said flexible material is sandwiched between said sole and said internal liner.

The ankle support structure includes the sole with a pair of sole extensions, the internal liner with a pair of liner extensions, the cuff with a pair of cuff extensions, and a pair of hinge screws.

The pair of sole extensions protrude from the sole. A first extension is on a medial side of said sole, and a second extension is on a lateral side of said sole. The pair of sole extensions are molded from the same piece of material as said sole. Each of said sole extensions in said pair of sole extensions have a screw aperture therein.

The pair of liner extensions protrude from the internal liner. A first extension is on a medial side of said internal liner, and a second extension is on a lateral side of said internal liner. The pair of liner extensions are molded from the same piece of material as said internal liner, each of said liner extensions in said pair of liner extensions have a screw aperture therein;

The pair of cuff extensions protrude downwardly from said cuff. A first extension is on a medial side of said cuff, and a second extension is on a lateral side of said cuff. The pair of cuff extensions are molded from the same piece of material as said cuff. Each of said cuff extensions in said pair of cuff extensions have a screw aperture therein.

A pair of hinge screws is also included. A first hinge screw in said pair of hinge screws is inserted on a medial side of said support structure through said apertures in said extensions in said sole, internal liner, and cuff. The said second hinge screw in said pair of hinge screws is inserted on a lateral side of said support structure through said apertures in said extensions in said sole, internal liner, and cuff.

The pair of hinge screws create a pair of hinge points allowing a top portion of said ankle support to move forward to back relative to said hinge point of said ankle support structure to allow flexibility while providing rigid support for a user's ankle.

Yet further provided is a method for replicating the experience of snow skiing, comprising providing a pair of independent platforms, wherein each platform in said pair of independent platforms further includes a pair of caster wheels, a pair of carving wheel assemblies wherein each carving wheel assembly includes a truck with a plurality of carving wheels attached to axles therewith, and a mounting location for a ski boot binding, thereby creating a land ski. The providing the pair of independent platforms further includes configuring each caster in said pair of casters to remain in a linear direction from front to back of said platform until significant pressure is placed on said caster by incorporating a tension mechanism to urge said wheel of said caster to a stable forward-facing position when no force is applied to the independent platform, and rotating said when of said caster in a direction of said force when force is applied, wherein the tension mechanism includes at least a tension cam, a tension screw, and a tension bar, configured into a caster mounting bracket of each caster in said pair of casters.

The providing the pair of independent platforms step also includes mounting of each of said casters in said pair of casters to a top surface of each of said platforms, wherein a stem of said caster descends through an aperture to an underside of said platform to provide additional surface area under said platform for use with ski maneuvers, and configuring the mounting of each caster in said pair of casters to the top surface of each of the platforms to lower the height of the platform relative to a surface on which said caster wheels engage The providing the pair of independent platforms step yet further includes providing traction for movement of said platform when said platform is angulated relative to a horizon of ground surface by configuring each carving wheel assembly to include a truck with a plurality of carving wheels rotatably affixed to an axle, wherein said each truck is located at a center axis from front to back relative a center point of a width of said platform, each truck contains a pair of axles, each axle in said pair of axles extend perpendicularly outwardly away from said center point, upwardly, and inward, creating an angled arch.

The method also includes providing shock absorption by mounting the trucks along the center point of the platform and employing the use of the curved axles, whereby shock absorption is achieved by mounting the curved axles to the truck at a point relative to a center point of said platform and using a semi-rigid material capable of flex providing a degree of vertical travel at the distal ends of each axle, and positioning each truck in said pair of trucks in a location towards the outside of the casters with one caster in a front-most position of said platform and the remaining caster in a back-most portion of said platform to maximize surface area in between said pair of casters.

Yet further disclosed in the method is providing a pair of boots, wherein the providing of the pair of boots further includes configuring each boot in said pair of boots to be constructed of lightweight material to allow enhanced movement of said land ski by using a flexible material as an upper in said boot, providing a core structure comprising a rubber lower sole, plastic upper sole, and internal liner.

Additionally provided in the step of providing a pair of boots in the method is using sonic welding to bond said flexible upper material and said core structure to thereby create a sealed unitary structure, incorporating a support structure for a user's ankle and leg by fastening a rigid cuff element around an opening in said upper and said fastening is accomplished by inserting a screw through an aperture in lower cuff extensions located along a lower perimeter of said cuff through an apertures located in sole extensions and liner extensions, thereby creating a hinge point connecting rigid components of said support structure; incorporating a fastening means to provide closure and constrict an internal volume created by the void between said upper and said core structure, wherein said closure means include at least one of a ratchet fastener and strap, laces, and a reel knob lacing system, and configuring said boot to engage with a binding by incorporating a toe lug and heel lug into a toe portion and heel portion of a rubber sole and said core structure.

It is an object of the invention to provide a system capable of replicating the movements and feeling of skiing on snow.

It is further an object of the invention to provide a land ski that is versatile and adaptable to the unique conditions of roller skiing on dry ground.

It is yet further an object of the invention to provide a system with a specialized boot that provides proper support for a user's ankle created by the movement and forces created when using the land ski.

It is additionally an object of the invention to provide a system with a specialized boot is lightweight in order to allow a user to perform tricks and maneuvers similar to skiing in a terrain park.

It is a further object of the invention to create boot with a rubber sole and slightly curved bottom similar to a skate shoe to allow the rider walk around comfortably on roads when detached from the land ski It is an additional object of the invention to provide a system having a boot that is lighter in weight, lower in thermal insulation, and increased flexibility over the prior art, specifically configured for the limitations presented therein.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

While many inventions, mentioned in the background, attempt to provide a user with a ski-like experience, they all fall short of allowing a user to accurately mimic the movements that correlate to snow skiing. Further, no prior inventions allow a user to practice multiple forms of skiing, including downhill as well as maneuvers or "tricks" such as grinding on a rail or surface. Prior inventions only allow the most basic of ski alternatives of gliding in a direction fixed to the axial orientation of the user's feet.

Figure 1:
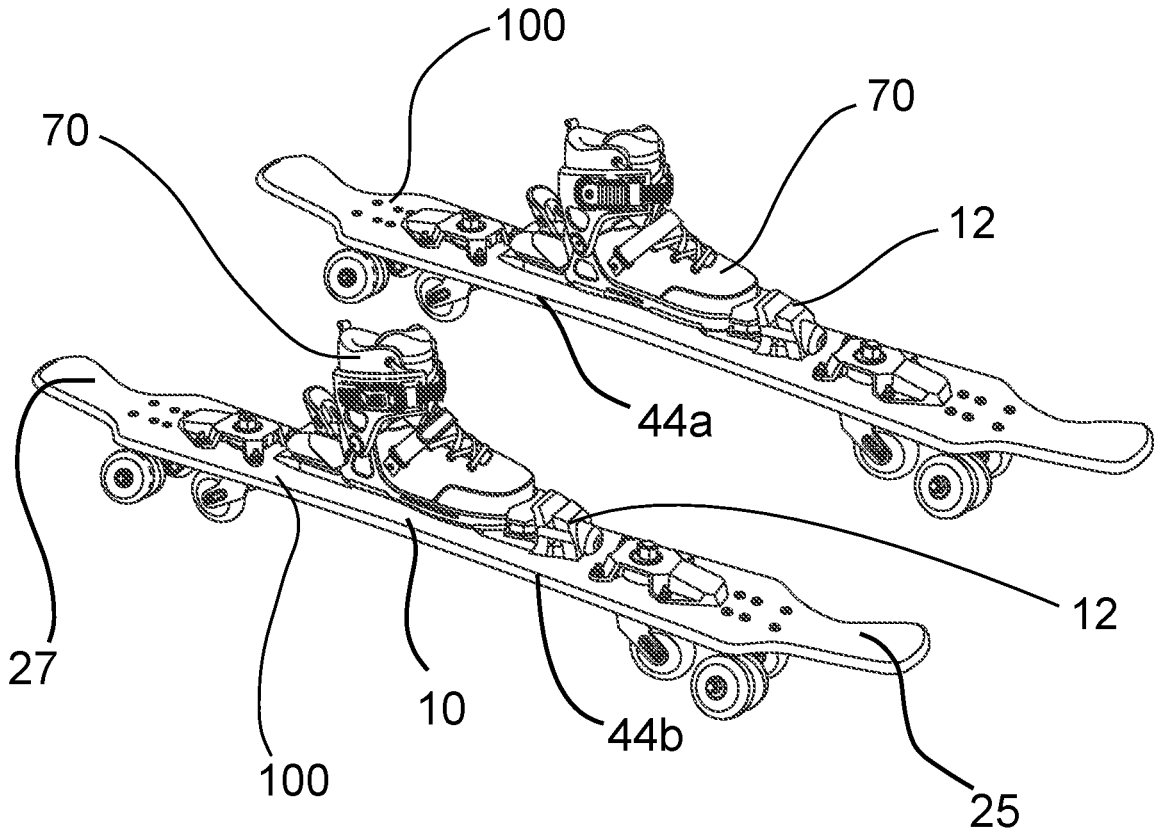
FIG. 1 is a front top perspective view the land ski with binding.

The land ski system can be primarily seen in FIG. 1. As may be seen in the figure, the system includes a pair of land skis 100, having a binding element 12, and a pair of specialized boots 70 attached.

The purpose of the land ski system would be to allow a user to ski down smooth asphalt surfaces, while being able to slide, carve, slow down, and stop using typical mechanics and motions used in snow skiing. This disclosure provides for a land ski apparatus, along with a system of a land ski with a specialized boot specifically configured to the requirements of the land ski.

Figure 10A:
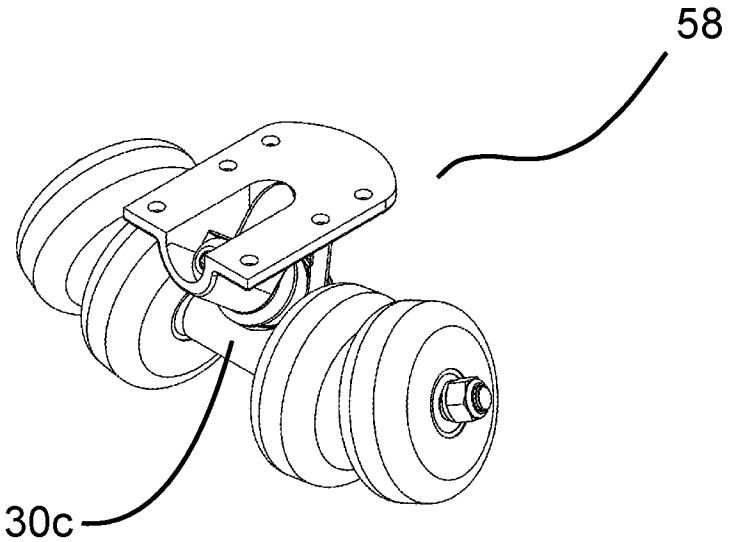
FIG. 10A is an isolated top perspective view of the truck.
Figure 10B:
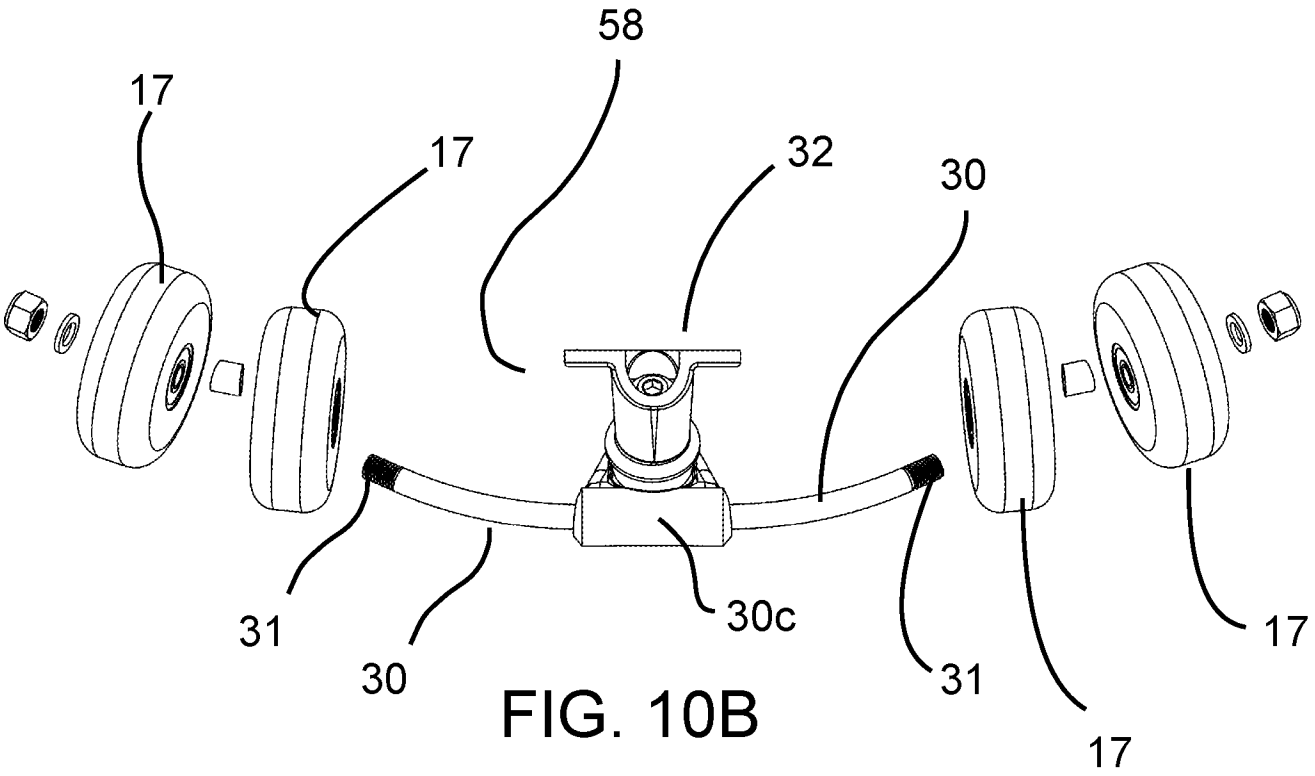
FIG. 10B is an exploded view of the truck of FIG. 10A.
Figure 10C:
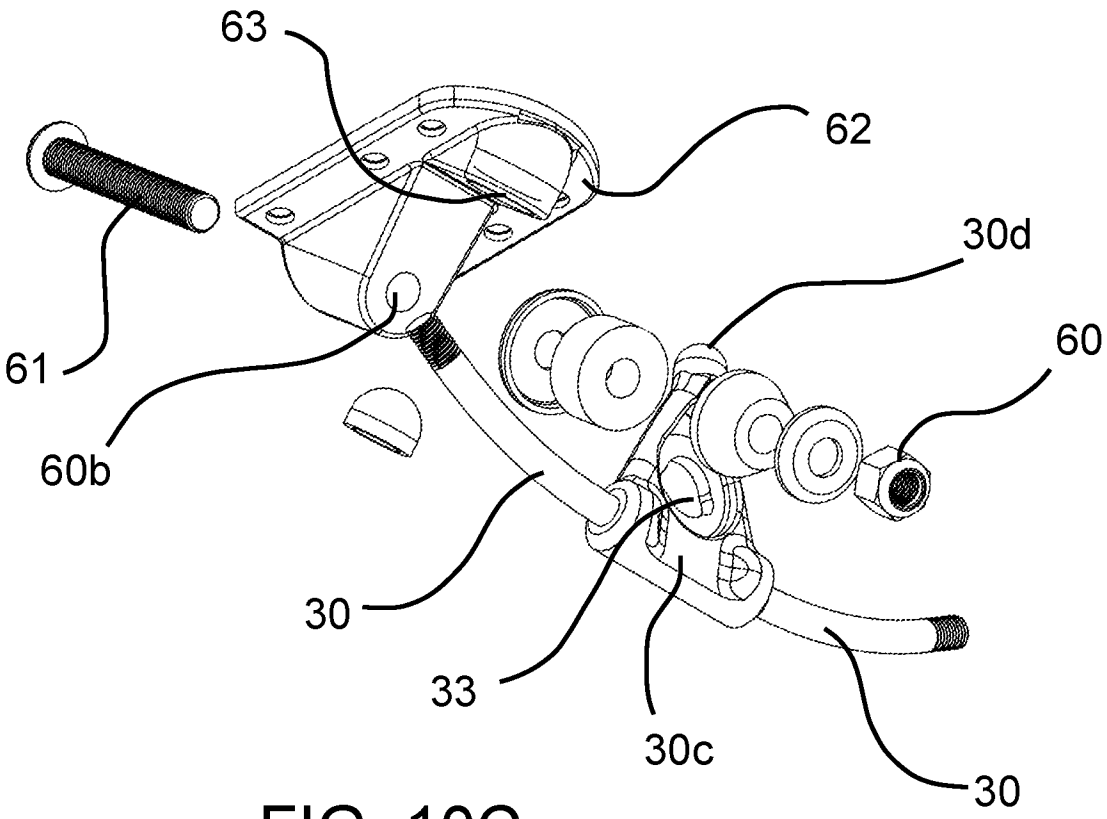
FIG. 10C is a bottom perspective exploded view of the truck of FIG. 10A.

The land ski generally constitutes of a platform 10, with one platform for each foot. A binding 12, such as a traditional alpine ski binding, is to be mounted on the platform 10, as shown in FIGS. 1-8. A biased omnidirectional caster 14 is used to allow omnidirectional movement, and is mounted near the front and rear of each platform and centered the middle of the platform width-wise. A biased omnidirectional caster 14 does not spin freely 360-degrees but is biased to stay straight until pressure is applied laterally. The casters 14 and all wheel assemblies are spaced so that grinding can take place on the smooth surface located near the central portion of the underside of the platform 20. In order to allow carving, slowing down, and stepping, a set of carving wheels 16 on a pair of arched axles 30, shown more particularly in FIGS. 10A-10C, is mounted slightly higher than the caster 14, as may be appreciated in FIG. 6.

Figure 2:
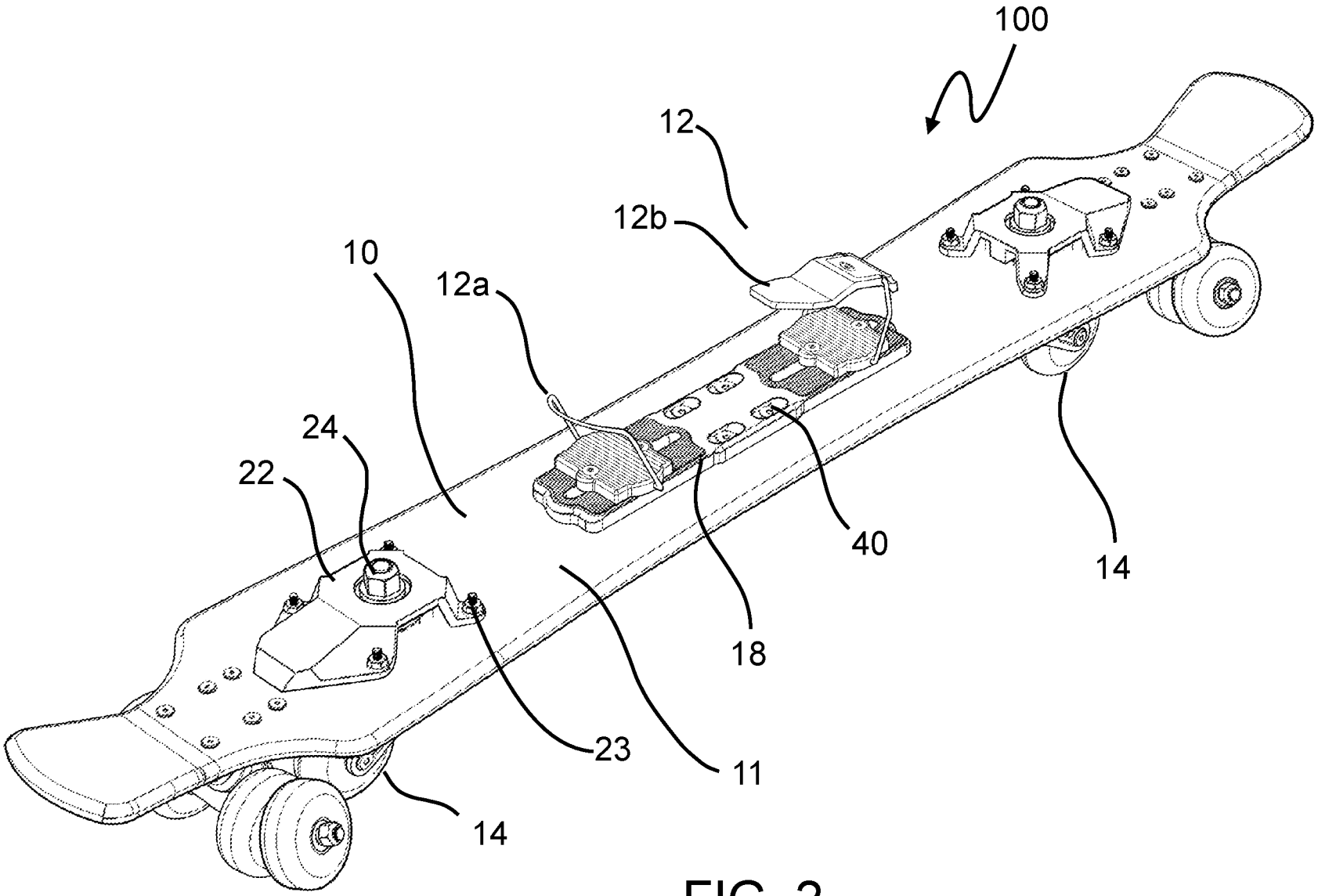
FIG. 2 is a rear top perspective view of a land ski binding.

The land ski may be seen primarily in FIGS. 2-9. FIG. 2 shows a rear perspective view of land ski 100, where the platform 10, which may also be called a deck, can be seen together with a binding mounting plate 18, front binding clip 12*b*, and rear binding clip 12*a*. Binding clips may represent any binding, but in many embodiments, the binding system is an Alpine binding system, shown in FIGS. 17B, 18, 20, and 21B. Front and rear biased omnidirectional casters 14 are shown in FIGS. 2, 5, 6, and 7. As may also be seen from FIG. 2, the casters are mounted to the deck by mounting brackets 22 that are secured to the deck 10 with a set of mounting screws 23. Therein, a caster nut 24 tightens the securement from the threaded caster securement bolt 26, which can be primarily seen in FIGS. 11, 12, and 13. The caster is secured to the top of the board so that the height of the board is lowered. The lowering of the board may be appreciated by viewing FIG. 6, wherein the top of the caster element can be seen at the caster nut 24, and the bottom of the caster element may be seen at the bottom of the caster wheel 28. As can be seen, the board has been lowered by the distance from the top of the deck 10 to the top of the caster nut 24. The mounting of the casters 14 on the top of the board 10 also expands the surface are area under the board, where rail sliding and other tricks could be performed, as may be appreciated by viewing the space around the caster 14 in FIG. 5. Further, having the turning mechanism of the caster 14, as further detailed in FIG. 13, on top of the platform 10 reduces the ability for dirt and gravel to get into the mechanism, thereby reducing malfunction of the spinning components. Also shown in FIGS. 5-10C is the pair of secondary wheel assemblies 16, known as the carving wheels. These figures show the wheels 17, mounted on a curved axle 30 stemming from a pair of trucks 32. By mounting the axles 30 to a centrally mounted point, in this case the trucks 32, the distal ends of the axle 31 are allowed a degree of vertical travel, which provides the land ski with shock absorbing properties.

Figure 3:
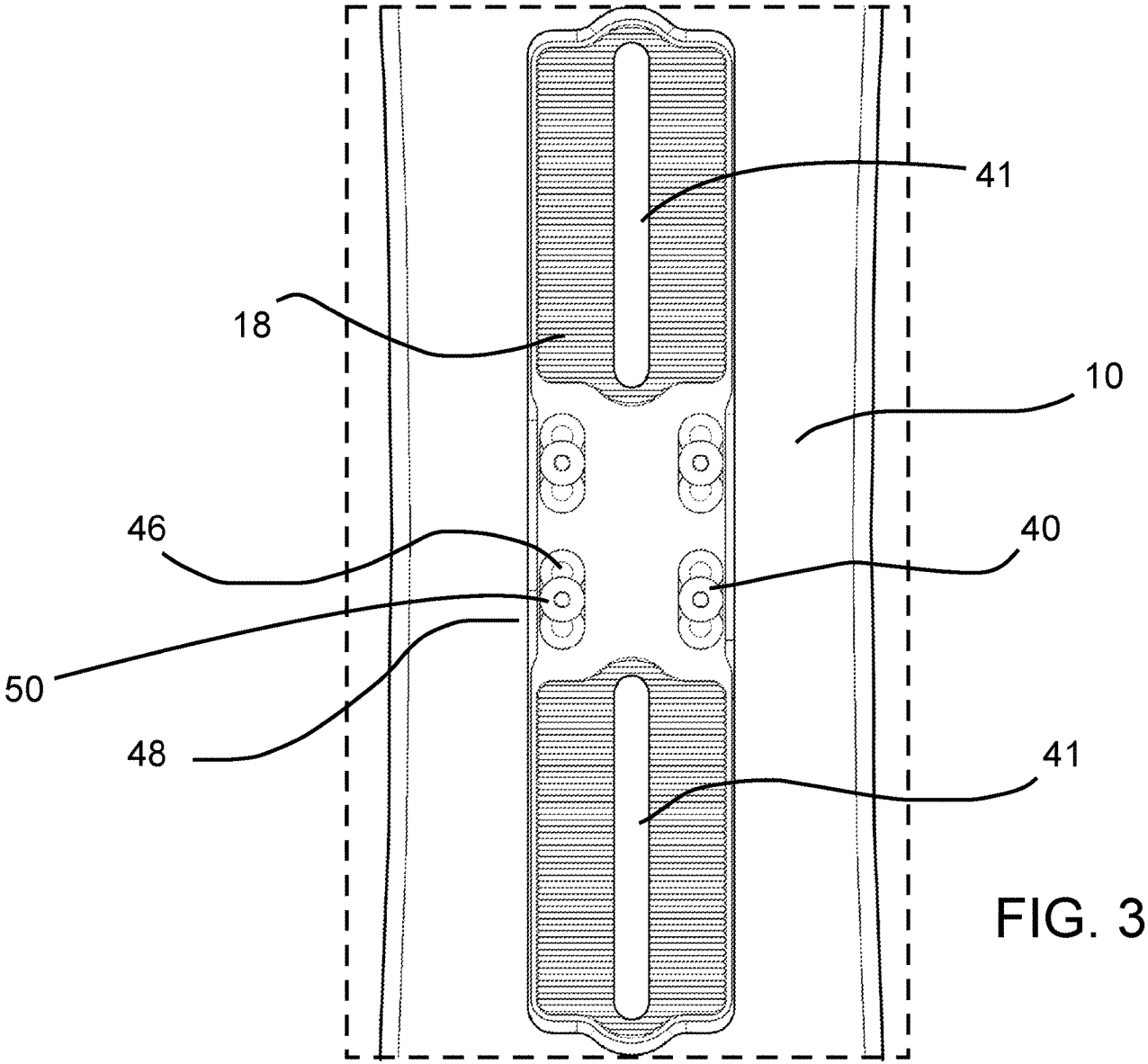
FIG. 3 is an enlarged isolated top view of a land ski.
Figure 4:
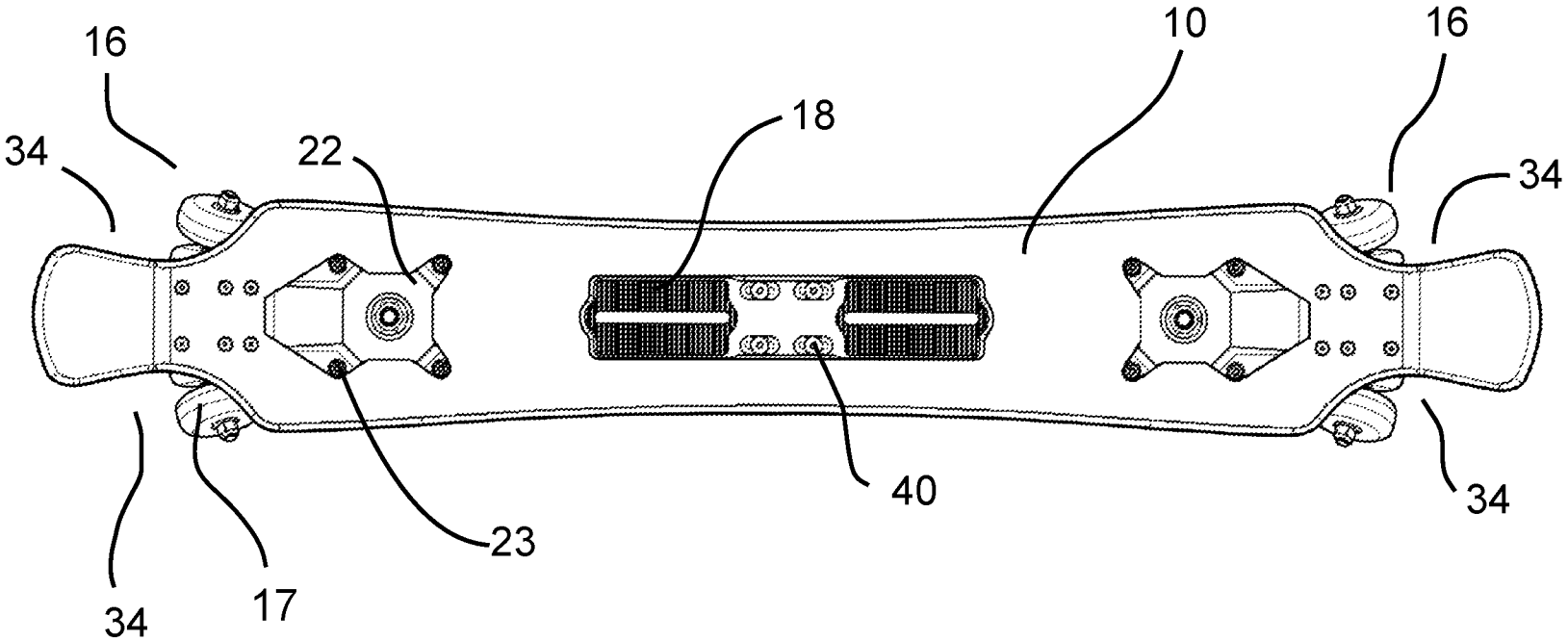
FIG. 4 is a top view of a land ski.

As also may be noticed from FIGS. 2-4, the mounting plate 18 is held to the board 10 by four bolts 40, this may be loosened to adjust the positioning of the mounting plate along the deck 10. In addition, a pair of binding mount channels 41, one on the front end of the plate and one at the rear end, is shown, wherein the bindings are affixed to, and may be adjusted accordingly.

It should be appreciated, that different bindings may require different lengths of the boards 10 of the land ski 100. For instance, with a non-release binding, as shown in FIG. 2, the board may be shorter because of the components of a non-release binding require less room. However, with land skis 100 including a traditional release alpine binding, as shown in 17B, 18, 20, and 21B, the board 10 will need to be longer to accommodate the additional components therein.

Figure 7:
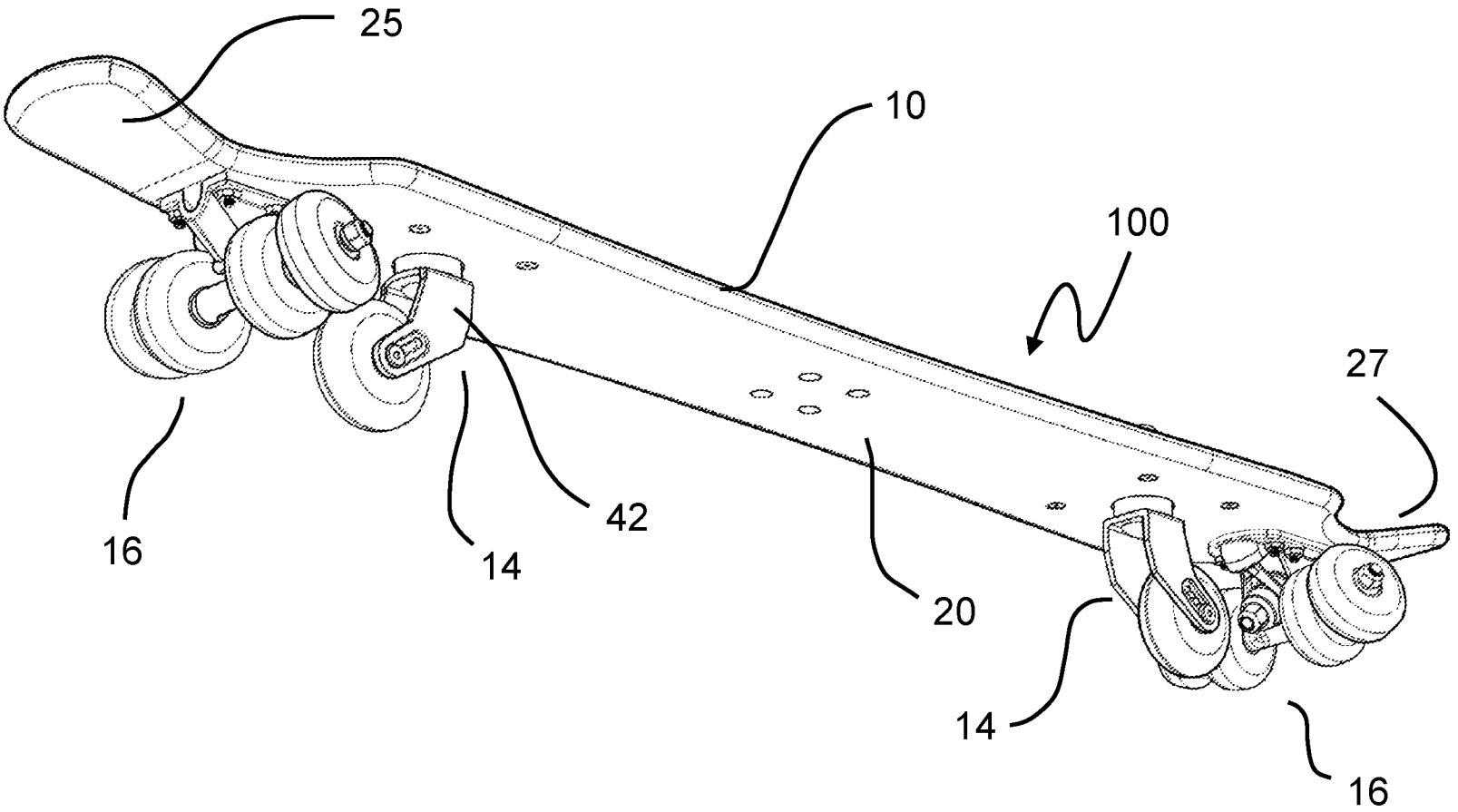
FIG. 7 is a front bottom perspective view of a land ski.

FIG. 7 is a front bottom perspective of a land ski 100. In this view, the bottom surface 20 of the desk 10 is shown from tip 25 to tail 27, wherein the casters 14 and secondary wheel assemblies 16 can be seen more clearly. The placement and layout of the wheels 16 and the spacing in between may be appreciated more clearly with this view. A significant space exists between each caster 14 to allow for a greater range of activities while using the board. Although a degree of flex in the deck is ordinary and in many cases optimal for turning, It should also be appreciated that the board will be made of a strong material, such as wood, to keep from excessive flexing from the weight of a user, which will be primarily in the center of the board, supported by the two casters 14 on opposing ends of the board 10. While the assembly of the front and rear casters 14 are shown, the details can be more particularly seen in FIGS. 8, 12, and 13.

Figure 13:
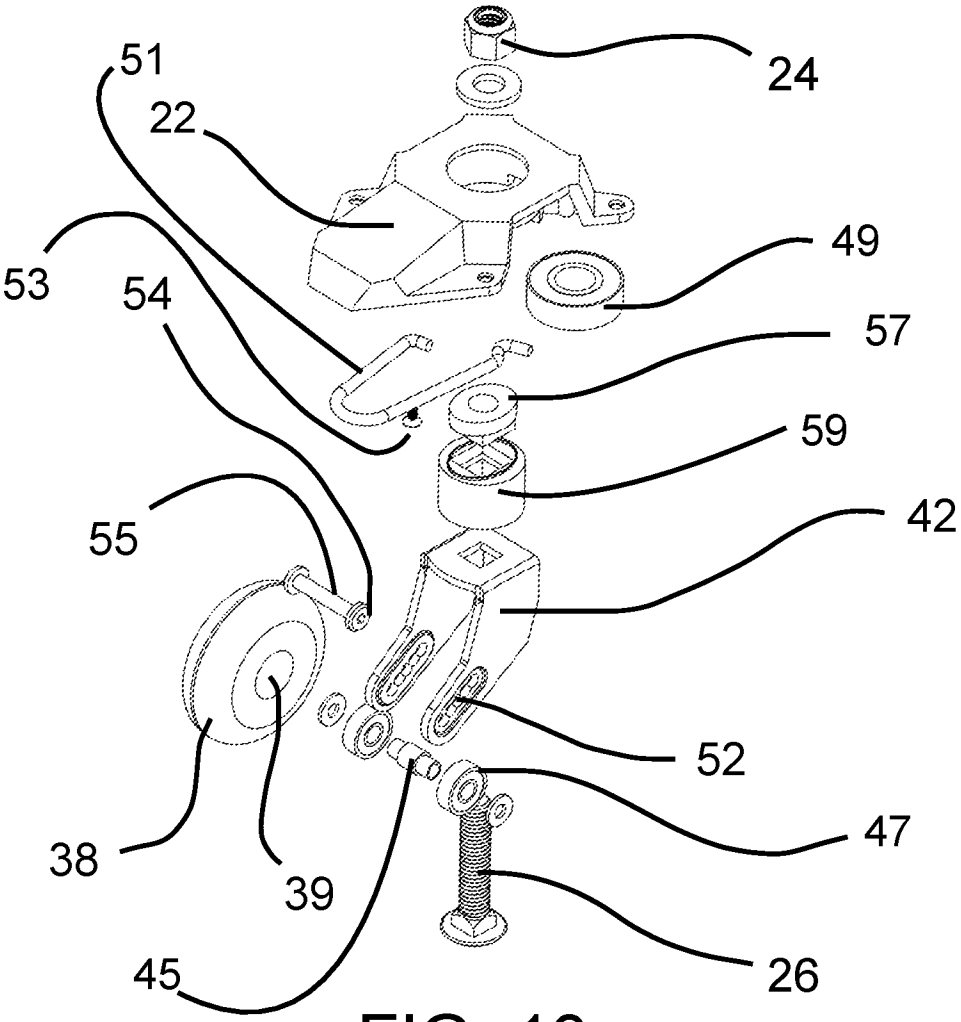
FIG. 13 is an exploded view of the caster of FIG. 12.

FIG. 13 shows the biased omnidirectional caster assembly, including the mechanisms therein. As may be seen, the caster assembly 14 includes a wheel 38, with adjustable shaft 55, bolt 54, and a bearing 47 and wheel spacer 45 therein, for which the adjustable shaft 55 fits through. The wheel engages with frame 42, wherein the bolt 54 locks the adjustable shaft 55 to the wheel channel 52. The frame 42 rotatably couples with the caster mounting bracket 22 using a kingpin 26 that is inserted up through the frame 42, rotation means, and caster mounting bracket 22, thereby being secured by a lock nut 24. The rotation means includes a bearing 49 that provides rotation for the caster 14. In addition, the rotating means includes a tension cam 57, tension bar 51, and tension screw 53 to thereby achieve a force that will align the wheel 38 to the direction of the force. This thereby acting as a spring to keep tension on the caster 14. When the wheel 38 urges the frame 42, the frame 42 will pivot, thereby rotating the tension cam 57. The oval shape of the tension cam 57 creates a variable pressure on the tension screw 35 of the tension bar 51. The tension bar 51 exerts force back on the tension cam 57 to guides the orientation of the wheel 38 to a stable positioning when force is not exerted on the tension screw 53. A bearing spacer 59 keeps the tension cam 57 spaced and tightly engaged under the caster mounting bracket 22.

Figure 6:
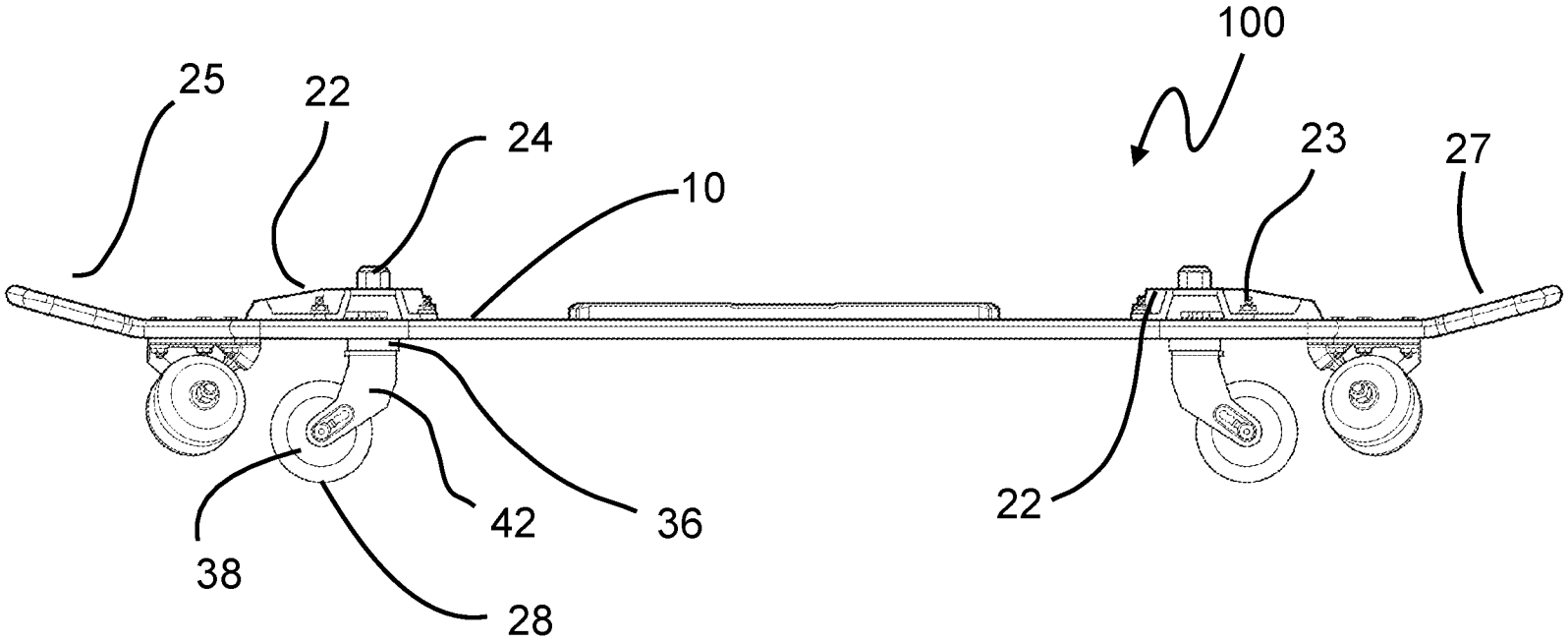
FIG. 6 is a side view of a land ski.
Figure 9:
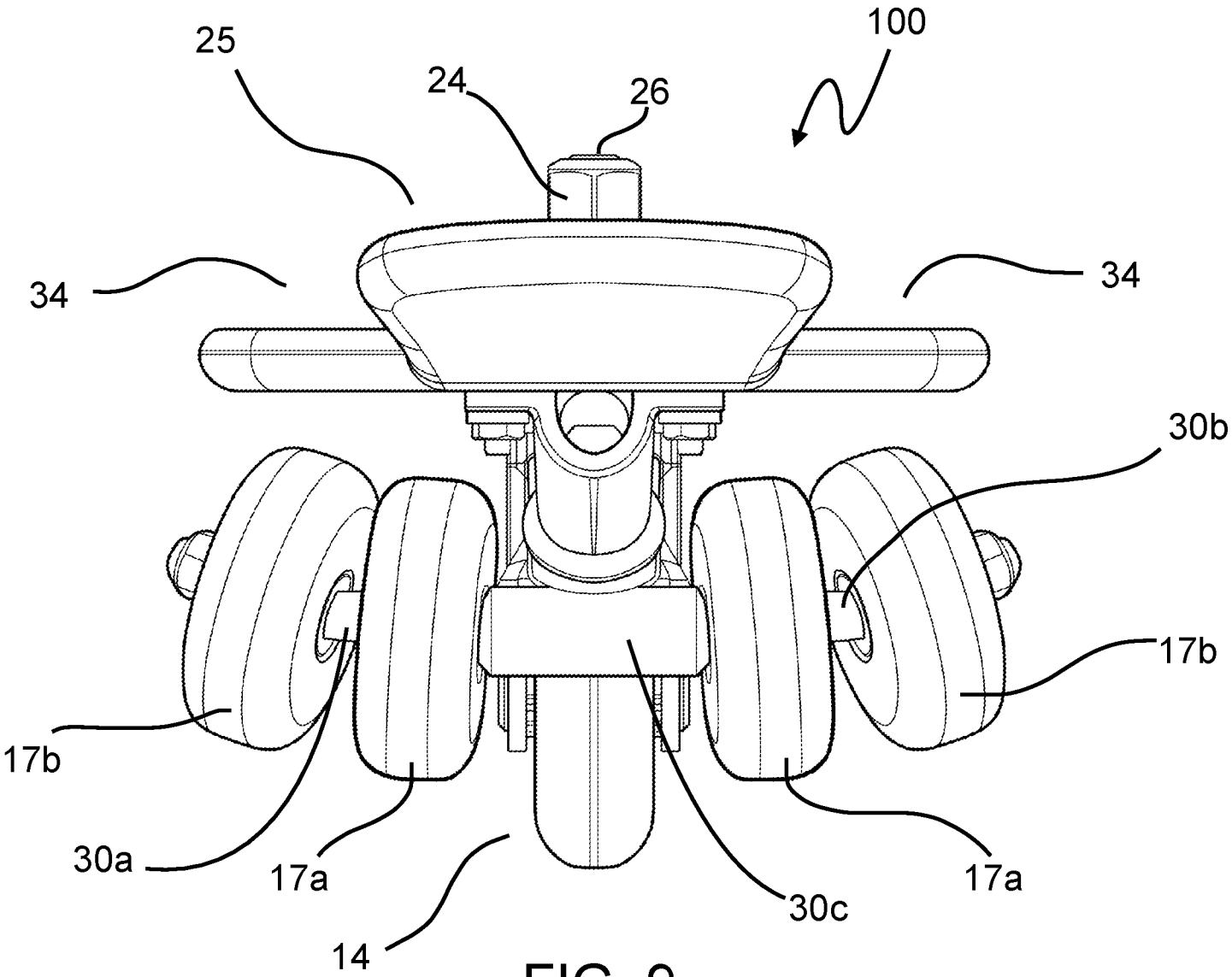
FIG. 9 is a front/rear view of a land ski.

FIG. 9 is a front view of the land ski 100, from the tip 26, in which wheel cutouts 34, caster securement bolt 26, caster securement nut 24, front truck, innermost carving wheel 17*a* of the secondary wheel assembly 16, outermost carving wheel 17*b* of the secondary wheel assembly, left front axle 30*a*, right front axle 30*b*, axle mount 30*c*, and caster wheel 14 may be seen. When viewing from this angle, it may be seen that the tip 25 of the board 10 angles up. In general, the degree of the tip 25 and tail 27 may vary in angulation depending on the specifications required for the land ski 100. Angulation provides more clearance for when a land ski 100 is not planted firmly on the ground, such as when landing after performing a trick or jump, at which time the front to back lateral orientation of the skis may not be parallel to the ground surface, thereby requiring extra space in the front and back of the land ski to allow the wheels to catch the ground's surface without the deck accidentally hitting the ground. This angulation can be further seen in FIG. 6, showing a side view of the land ski 100. It should also be appreciated that FIG. 9 is also representative of a rear view, because in the shown embodiment, the tip and tail are mirror images of each other. Other embodiments may exist where angulations of one or both ends is increased, reduced, or removed all together.

FIG. 6 shows a side view of an embodiment of the land ski 100. It should be appreciated that in the embodiment as shown in FIG. 6, the view may represent a left side or a right side. The shown embodiment incorporates sides that are mirror images of each other. Further, the components shown are also mirror images of each other, in that the skis are symmetrical. This allows the skis greater flexibility in orientation, adding a secondary benefit. Also shown in FIG. 6 is the tip 25, tail 27, caster securement bracket 22, caster securement nut 24, caster omnidirectional hinge 36, caster wheel brace 42, caster wheel 38, and mount screws 23.

Figure 5:
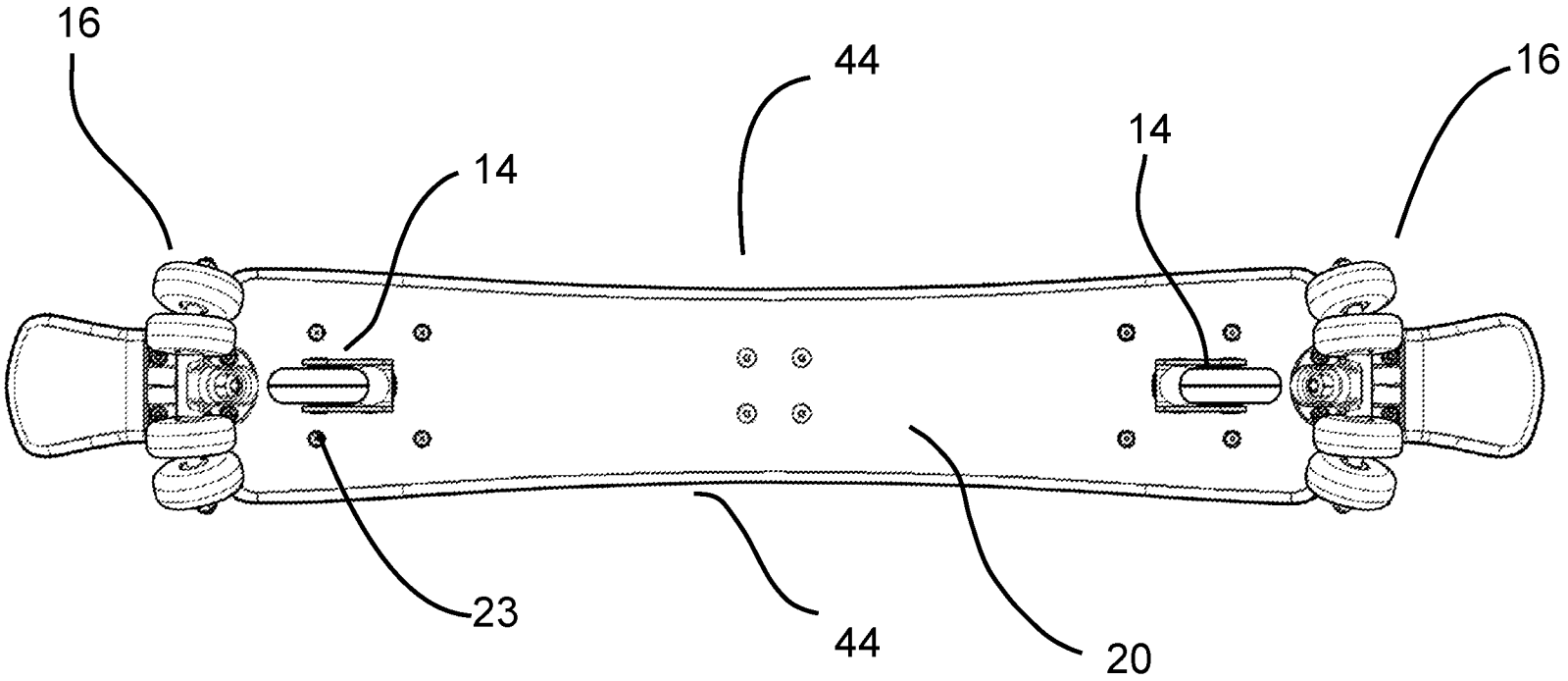
FIG. 5 is a bottom view of a land ski

FIG. 4 is a top view of the land ski. As may be appreciated from this view, the secondary wheels 16 may be seen through the four-wheel cutouts 34. Similarly, FIG. 5 is a bottom view providing an alternative view. As may also be noticed, the curvature of the axles also curves laterally. Concave edges 44 of the deck 10 may also be seen. These concave edges 44 also help with flexure of the board, especially during turning when the forces are greater from the weight of the rider. The curvature of the secondary wheels 16, the spacing of the secondary wheels 16 and the casters 14, and concave curves 44 in the deck 10 can all be appreciated from this view.

FIG. 3 is an isolated top view of the deck 10. The binding mounting plate 18 is shown in more detail as compared to FIG. 4. Specifically, the securement of the binding mounting plate is shown. In some embodiments, the plate has three holes 46 per mount location 48, with a total of four mounting locations. A mounting screw 50 fits in to one of said holes 46, and the screw 50 can be tightened to secure the mounting plate 18. The multiple holes 46 per mounting location 48 allow the binding mounting plate 18 to be shifted incrementally forward or back as necessary.

Figure 8:
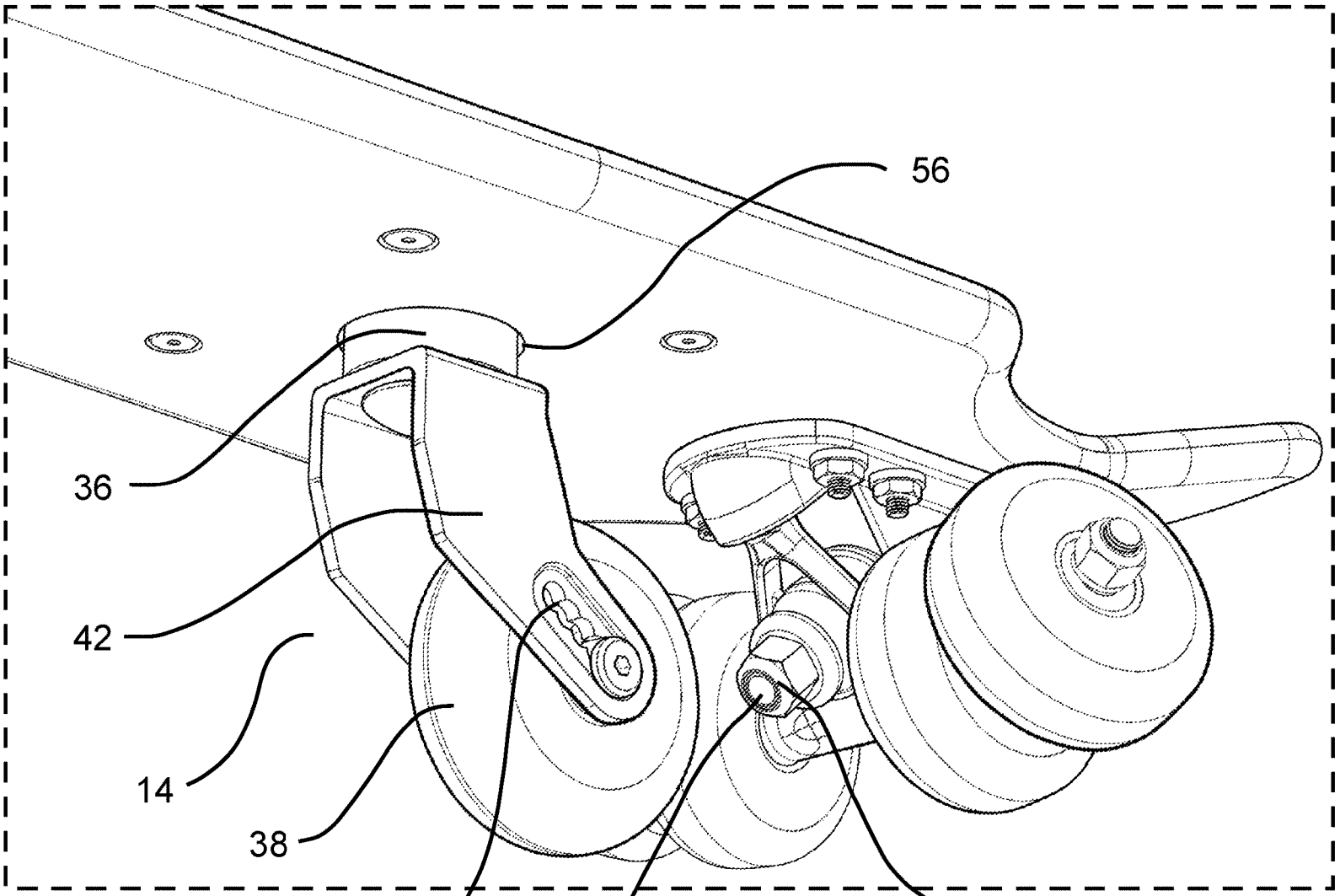
FIG. 8 is an enlarged isolated perspective bottom view of the tip/tail end of a land ski.

FIG. 8 is an enlarged isolated perspective bottom view of the tail end of a land ski. Here, the details of the components in the omnidirectional caster 14 and the secondary wheel assemblies 16 is shown. The casters 14 comprise a caster frame 42, which is a wheel mount that the caster wheel 38 is supported by. The frame 42 comes with an adjustable wheel channel 52 wherein the adjustable shaft 55 and bolt 54 can be loosened so that the caster wheel 38 can be raised or lowered depending on usage. Moving the caster wheel 38 closer to the board 10 will lower the center of gravity and be easier to control for newer users, while moving the caster wheel 38 away from the board 10 will make it more top-heavy allowing more advanced users a broader range of movement. The caster frame 42 is connected to the pivoting caster hinge 36, which extends upward through an aperture 56 in deck 10 of the land ski and mounted on the top of the deck to a bracket 22. Bracket mounting screws 22 extend from the bottom surface 20 and secure the bracket 22 on the upper surface of the deck 10.

The secondary wheel assembly 16 can be seen in FIGS. 5-9, but more particularly in FIGS. 10A-10C. The secondary wheel assembly consists of a truck 58 mounted to the bottom surface 20 of the deck 10 and secured by a series of nuts and bolts for a tight fit. The wheel assembly 16 includes said truck 58, which is a two-part device, in which both parts (a mounting bracket 62 and axle mount 30*c*) are pivotally attached, wherein an adjustment nut 60 fastens around a threaded pin 61 to tighten both parts 62 and 30*c* together. The truck has a higher range of pivoting if the nut 60 is loosened. The looser the pivoting in the truck 58, the tighter the turning radius of the secondary wheels 16 will be. Attached to the trucks 58 are curved axles 30. On each curved axle 30 is an inner secondary wheel 17*a* and an outer secondary wheel 17*b*, as may be appreciated in FIGS. 9 and 10B. As may be seen in FIGS. 14 and 15, the axis of these wheels 17*a*/17*b* is different. That is, not all the wheels

Figure 14:
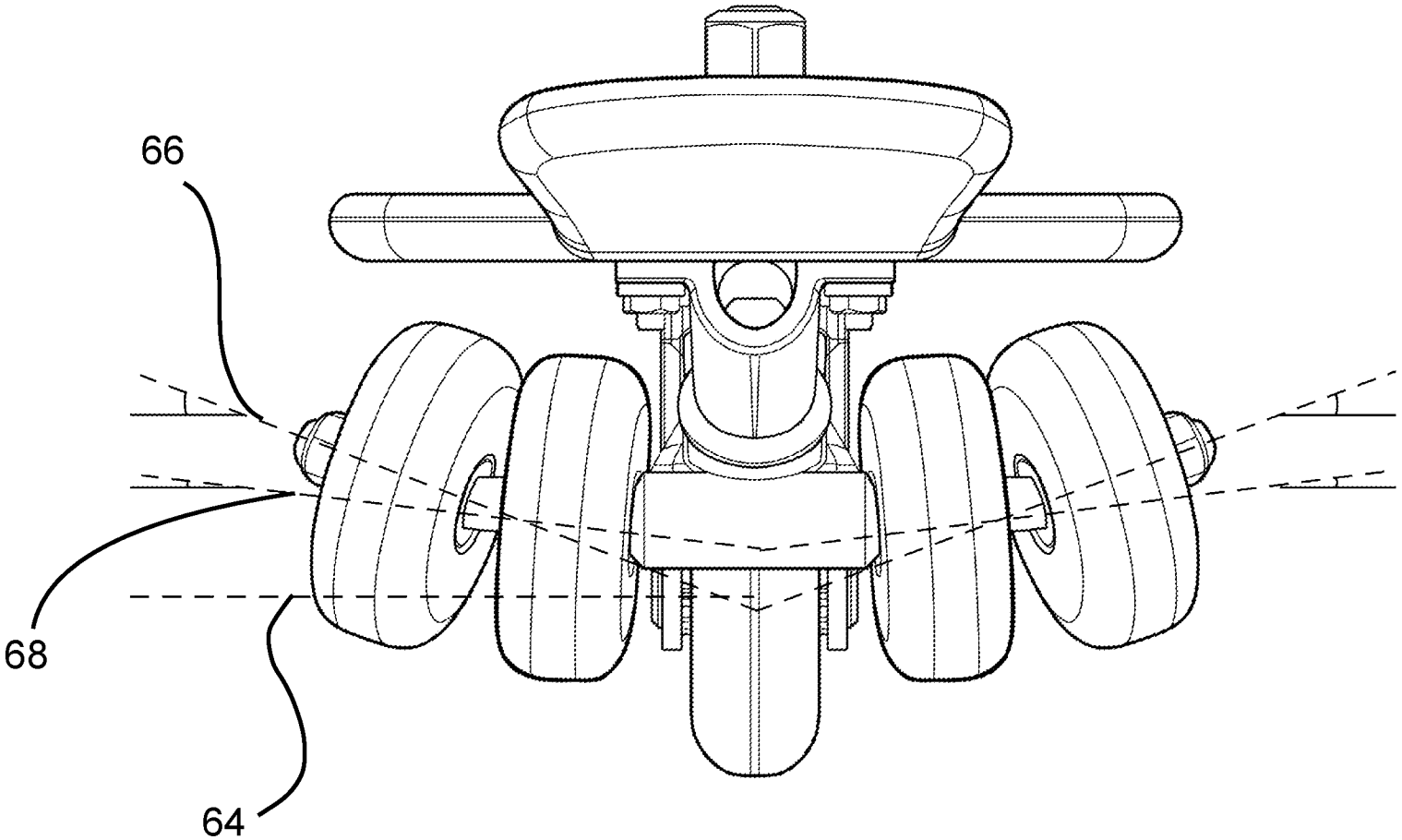
FIG. 14 is a front view of a land ski showing axial orientations of the wheels of the land ski.
Figure 15:
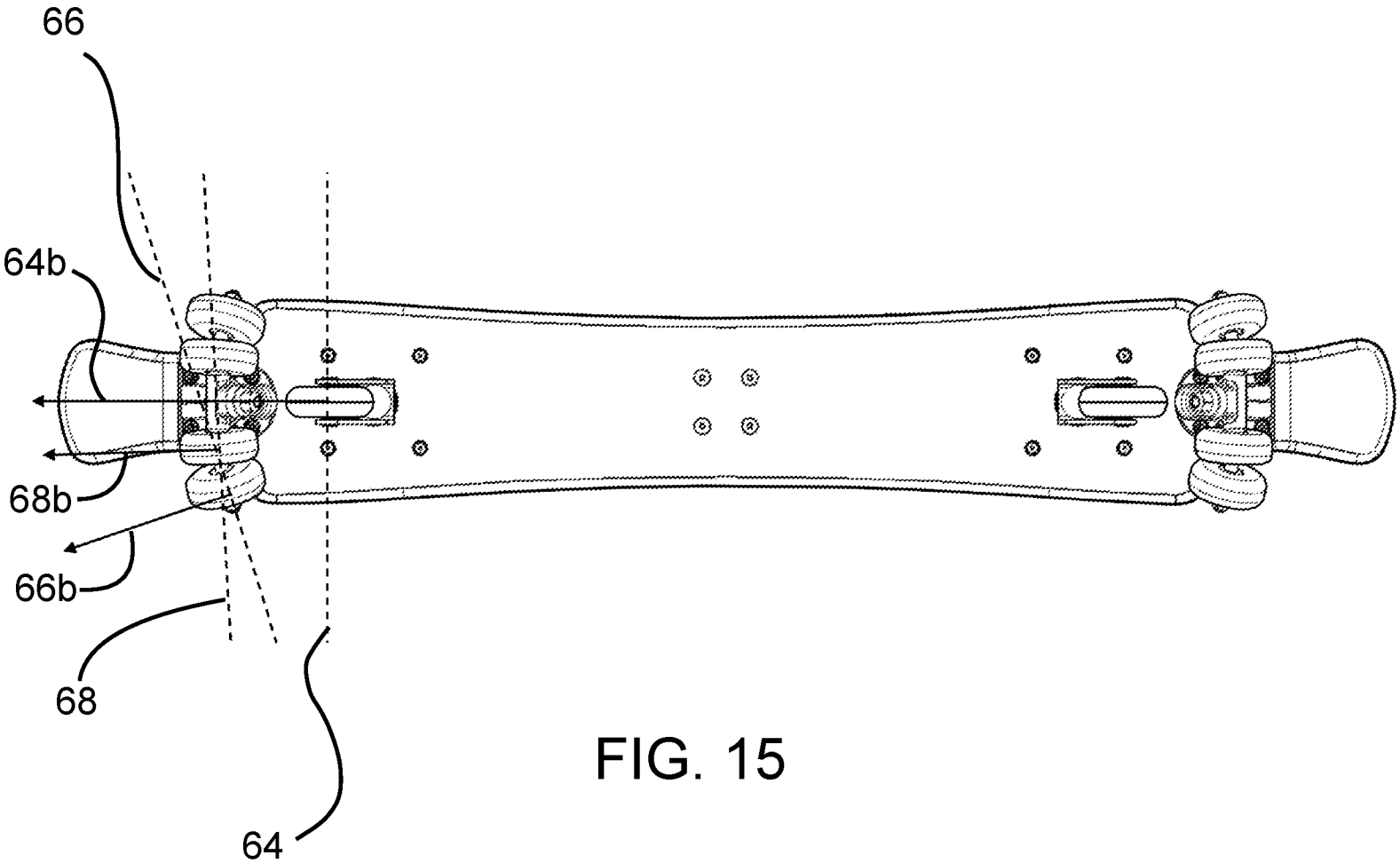
FIG. 15 is a bottom view of a land ski showing axial orientations of the wheels of the land ski.

17*a*/17*b* are mounted in a common transverse plane. With these secondary wheel assemblies 16, when turned, the tighter the turn, the tighter the arc created between wheels. Since the wheels 16 are pivotally mounted, turns can be accomplished by transferring one's weight in the desired turn direction. FIGS. 14 and 15 show the caster axis 64, outer wheel axis 66, and inner wheel axis 68, as well as the direction of the caster 64*b*, direction of the inner wheel 68*b*, and direction of the outer wheel 66*b*.

Figure 16C:
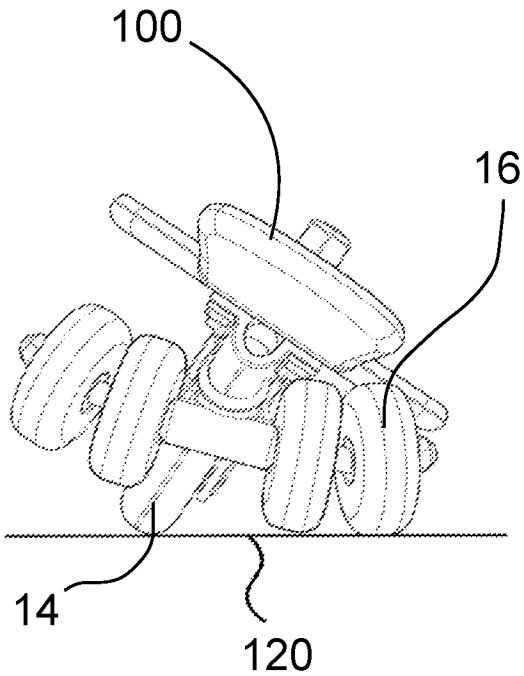
FIGS. 16A, 16B, and 16C show front views of a land ski on a flat surface.
Figure 16B:
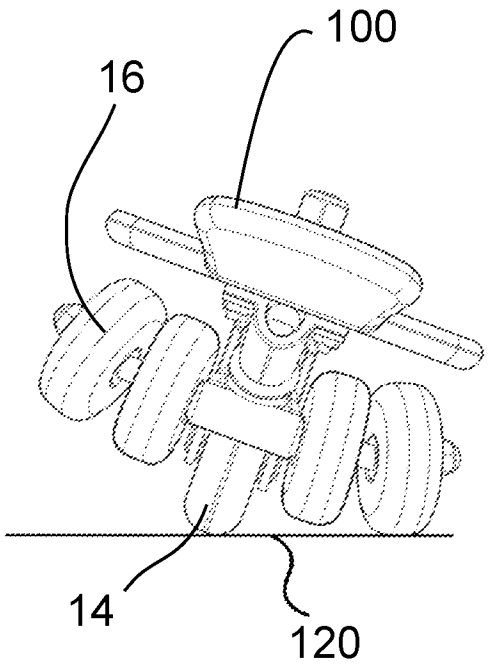
Figure 16A:
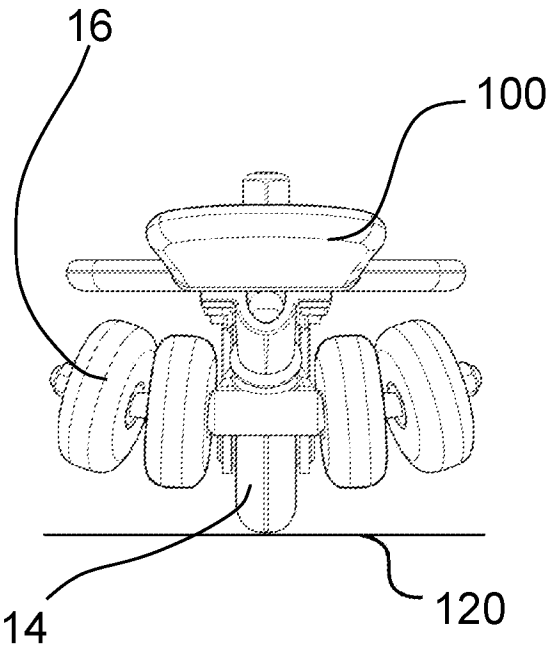
Figure 16F:
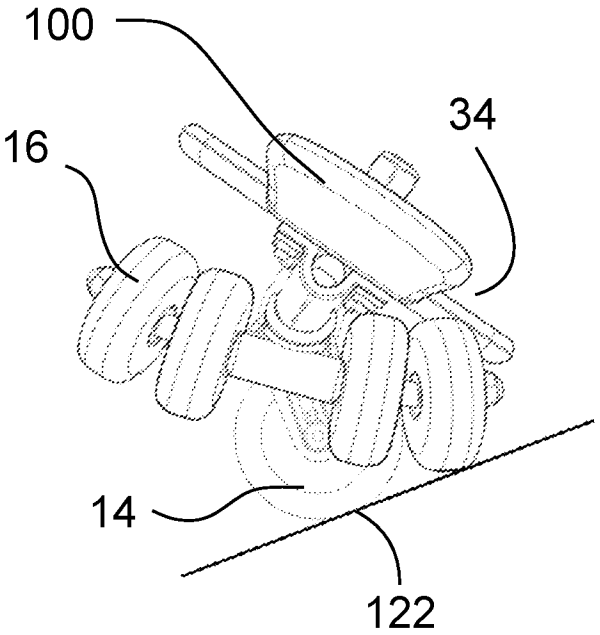
FIGS. 16D, 16E, and 16F show front views of a land ski on an inclined surface when the caster wheel is perpendicular to the land ski.
Figure 16E:
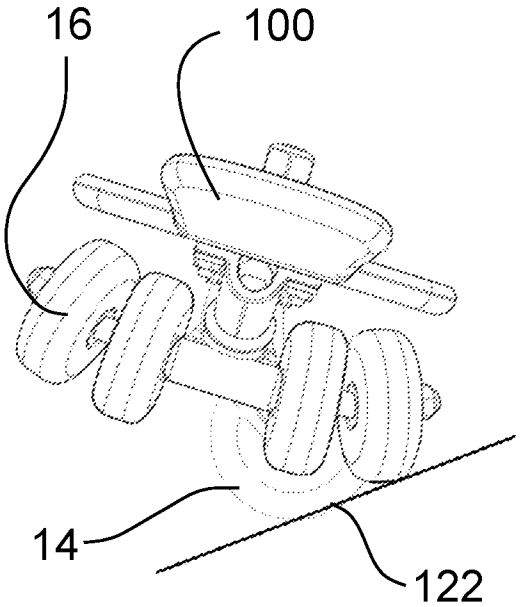
Figure 16D:
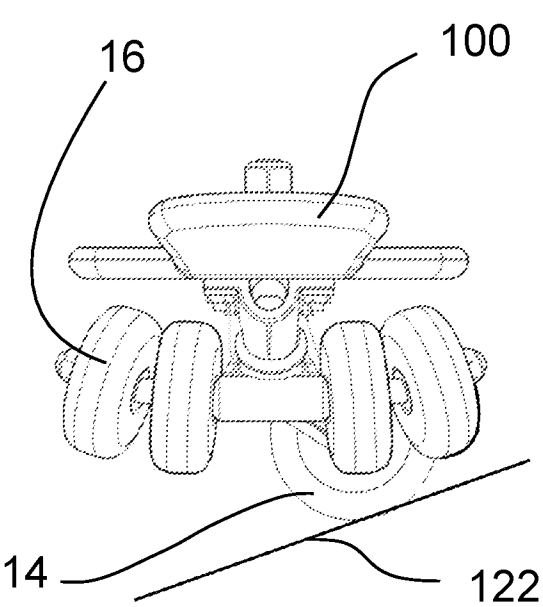
Figure 16H:
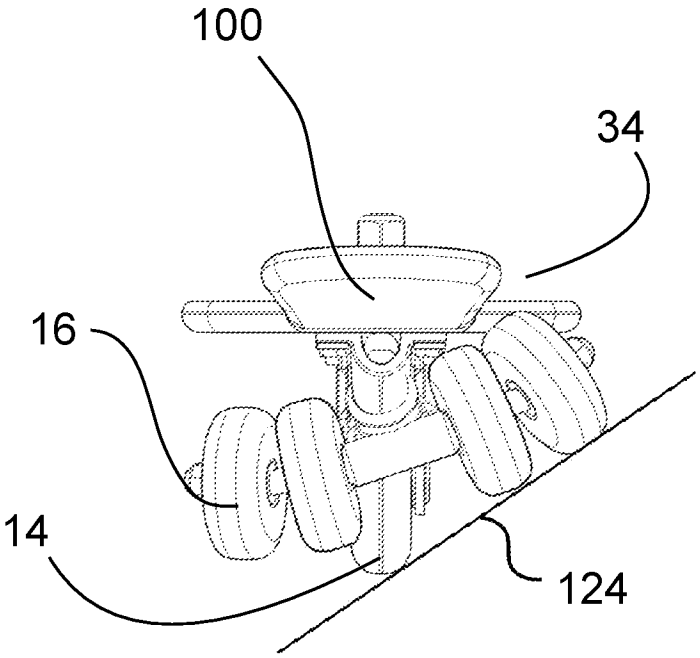
FIGS. 16G and 16H show front views of a land ski on an inclined surface when the caster wheel is parallel to the land ski.
Figure 16G:
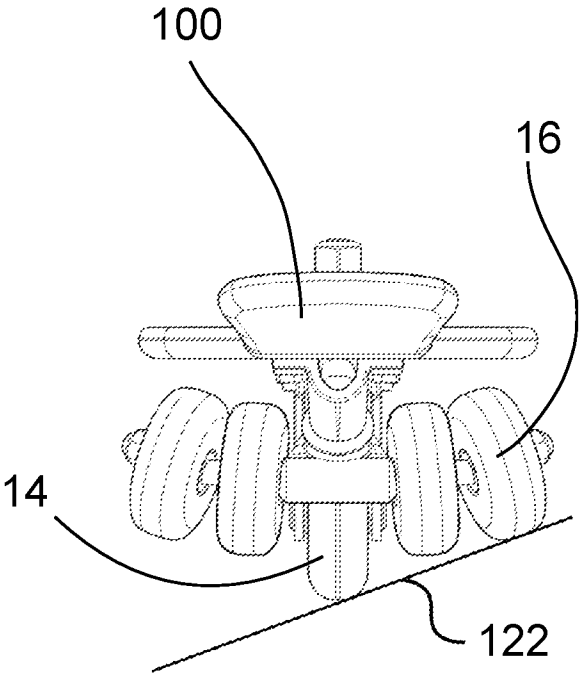

On a flat surface 120, the land ski 100 can engage as shown in FIGS. 16A-16C. As may be noticed, the angulation of the land ski can pivot to provide proper carving. FIG. 16A shows the land ski 100 engaging the caster wheel 14 without the carving wheels 16, as may be the case when the land ski 100 is moving forward. If a user shifts his or her weight, the land ski 100 will tip, thereby engaging the carving wheels 16, however, the caster 14 will still be parallel to the board, as may be seen in FIG. 16B. FIG. 16C also shows the land ski 100 tipped, with the caster wheel 14 parallel, but engaging both carving wheels 16 on one side of the land ski 100. When engaging down hill, the center caster 14 turns in the direction the land ski is moving, which may be perpendicular to the board of the land ski 100. As may be seen in FIGS. 16D, 16E, and 16F, the caster 14 may be seen as perpendicular to the board as the board slides. This allows the land ski 100 to perform maneuvers and allows the land ski 100 to complete 360-degree rotations. In FIG. 16D, the carving wheels 16 are not engaged, because the angulation of the land ski 100 does not provide the necessary angulation. In FIG. 16E, the carving wheels 14 are engaged, which can be the result of tipping the land ski more, or carving on a steeper incline. FIG. 16F also shows an increased tipping and/or steeper incline, wherein the carving wheels 16 are further recessed in to the wheel cutouts 34. The carving wheels 14 are multifunctional because they can both assist in carving and in stopping. The carving wheels 16 can assist in carving, wherein they guide the land ski 100 once engaged, thereby urging the caster wheels 14 to pivot parallel to the board, but the carving wheels 16 may also act as brakes when the caster wheels 14 are facing perpendicular to the land ski 100, and the user transfers weight to the carving wheels 16 forcefully. Further, when the land ski 100 is in a forward direction, the caster wheels 14 will be facing the direction of the board, as shown in FIGS. 16G and 16H, wherein 16G shows a moderate incline 122 with only one carving wheel 16 engaged, and FIG. 16H shows a steep incline 124 with both carving wheels 16 engaged and the carving wheels 16 extending upwards through the wheel cutouts 34.

While FIGS. 16A-16H show the different angulations of the land skis 100 in correlation with different inclines and different directions, it should be understood that the embodiment shown in FIGS. 16A-16H show an exaggerated height for clarity of concept, but normal use would have a configuration with a wheel of a caster 14 closer to the board of the land ski 100. In these Figs, the wheel of the caster 14 is shown at its farthest point away from the board. This will create an extremely top heavy configuration. For normal use, the wheel of the caster 14 would likely be calibrated closer to the board, and as such, the range of angulation of the top of the land ski 100 would be reduced, and the secondary carving wheels would engage with the ground more readily.

When gliding in a straight direction, the only portion of the land ski in contact with the road surface would be the pair of biased omnidirectional casters 14. As a result, sliding in all directions would be possible, including a complete 360-degree rotation. As the user shifts their weight to the left or right, the wheels 17 arched wheel assembly 16 would catch the road surface thereby allowing carving. If the rider is sliding downhill and wishes to slow down, the user can accomplish this by leaning uphill of making the curved wheels 17 contact the road surface on the uphill side thereby slowing down by creating friction against the road surface. The center omnidirectional casters 14 have more freedom to spin and are therefore when balanced on these center wheels 38 the board 10 can go faster similar to straight lining on skis. The curved wheels 16 are purposely designed to have less "freedom" to mimic the steel edges of skis. When the ski is turned on edge by engaging the curved wheels 17 the inability of these curved wheels 17 to turn as fast as the center wheels 14 naturally slows the rider down similar to skiing. The caster wheels 38 in said pair of omnidirectional casters 14 are configured to include a bearing with a lower degree of friction then a bearing in said carving wheels 16 to thereby allow said caster wheel 38 to spin at a faster rate then said carving wheels 16.

The land ski also allows deeper carving than any of the prior inventions through use of a combination of the casters 14, secondary wheels 16 with centrally mounted curved axles 30, wheel cutouts 34 in the deck 10 for said secondary wheels 17*a*/17*b* in the secondary wheel assemblies 16, and a spacing means between the axles and the deck in the form of trucks 58. These secondary wheels 17*a*/17*b* are mounted to the trucks. The curved axles 30 extend outward widthwise and upward from each truck 58. On each side of the truck 58 are axles 30 with two wheels 17*a*/17*b* with different axis of rotation 66/68. A total of eight wheels 17*a*/17*b* are mounted to the pair of axles 30 from a pair of trucks 58. The use of trucks 58 also allow pivoting of the axles 30 for a deeper turn, thereby allowing the deck 10 to orient at an angle that exceeds the fixed angulation of the wheels mounted to the curved axles, as shown in FIGS. 16A-16H. Wheel cutouts 34 give the wheels 17 mounted to the curved axles 30 ample space to move beyond the horizon of the deck 10 to allow deeper carving without interference. This provides a more natural feeling carve, and allows a user to ski down a variety of different inclines, similar to a snow ski. This also allows for more control over the prior inventions because it tightens the turning radius.

The curved axles 30 are also configured to provide shock-absorbing characteristics, which further enhance the replication of skiing on snow in an uninterrupted glide. The arched axles 30 provide a degree of flex since the material can compress slightly and the distal end of each axle is not connected to the axle mount 30*c* of the truck 58 mounted to the board 10, or any connection point thereof. The degree of flex allows for small variations in vertical travel which creates a shock-absorbing effect.

On a ski, a user can continue to increase the angle at which a ski contacts the snowy surface. This becomes an issue with any kind of land ski, mainly because the snow ski has blade-like edges that can grip the snowy surface, but in-line skates cannot have such tight turns because at a certain angle, the wheels of in-line skates do not have enough grip to adhere to the surface, thus causing a user to lose control. Some inventions have increased the number of wheels on the underside of the land ski to provide more grip, but the addition of wheels reduces the angle at which the land skis can turn.

However, in this invention, the height of the deck 10 as compared to other inventions in this area provides for a higher center of gravity, which in turn increases the sensitivity of movements because of the achievable range of angulation between the deck 10 and ground, closely resembling the natural movements achievable with a snow ski.

In some embodiments of this invention, a mounting platform 18 is included and affixed to the deck 10 to allow for the mounting of bindings 12 to attach a ski boot 70. The mounting platform 18 has a channel 41 wherein a set of mounting screws affix to the bottom of the bindings and hold the bindings tightly to the mounting platform 18. The channel 41 also allows the user to adjust the positioning of the bindings to shift the user's weight in order to provide a more stable ride when gliding over asphalt by shifting the force towards one truck 58 or the other, which is important when using the land skis 100 to perform tricks as the center of gravity needs to be calibrated correctly as a user cannot simply adjust his or her footing once the boot 70 is snapped in to the binding. These channels 41 also allow the binding 12 to be adjusted to different foot sizes.

Other embodiments may not require a mounting platform 18. Most embodiments will use a traditional alpine ski binding 21, which can be mounted to the platform 10, or to the binding mounting plate 18 to allow the center of gravity to be changed as well as adjust to the size of the boot of the user.

The system includes a specialized boot 70 configured for the support requirements of the land ski 100. The boot is configured to be lightweight, but provide support for a user's ankle and leg while using the land ski. The boot includes a sole portion 72 with rubber bottom 74, a flexible upper portion 76 with laces 78 for constricting the space created therein, and a support structure 80 for the user's ankle and leg, which includes a closure means 82, such as a buckle and strap 84*a* or a reel knob lacing system 84*b*. The boot 70 of the system can be primarily seen in FIGS. 1 and 17A-25C. The integration of the boot 70 integrating into the system can be seen primarily in FIGS. 1, 17B, 18, 20, and 21B To increase support for a user, each boot 70 has a core structure, as may be seen in FIGS. 23A and 23B, comprised of 4 pieces: a rubber sole 74, and harder shell components including a plastic core sole 72, a plastic interior sole 102, and a plastic cuff/neck 86. The design integrates the soft components directly into the design for greater support while having a lighter weight. The shell 75 of the upper 76 is merged into the bottom arced sole, between sole portion 72 and liner 102 to reduce weight while maximizing support around ankle as well as to reduce lateral sliding of the foot in the boot 70 as a way to maximize ski to boot responsiveness. The shell 75 is forged into the sole 72 providing additional support around the ankle and entire foot.

In other words there is no stand-alone soft component for the boot 70. In addition to FIGS. 23A and 23B, FIGS. 24A-24F show the core structure of the boot 70. As may be appreciated by viewing FIGS. 24A-24F in combination with FIGS. 22A-22C and FIG. 25A, the softer components are molded into the harder shell components. The fabric from the upper 76 of the boot 70 is inserted above core sole 72 and sandwiched between the core sole 72 and interior sole 102, then fused to create one unitary piece. In some embodiments, the fusion is accomplished through sonic welding, this way the pieces act as one, rather than glue or other means that may leak. However, some embodiments may still use gluing or sewing if manufacturing requirements make it difficult to sonically weld. With this construction, the liner 102 is permanently adhered to the other components and is no longer capable of being a pullout liner like some ski boots have. This also merges the boot 70 material into the sole 72, which, unlike the prior art, makes the boot 70 function as a unitary piece and helps prevent leaks and tears, but also keeps the boot 70 lightweight.

Further, by merging the soft components with the hard components of the boot 70, the need to have a seal to prevent water, snow, etc., is eliminated, and prevents this moisture from getting in between the boot 70 and sole 72. Also by incorporating the a reel knob lacing system 84*b* as a closure means instead of laces and buckles, the outer holes where snow, water, and mud could enter the boot 70 are eliminated and thereby further reducing the need for a separate seal of plastic, as may be seen in FIGS. 25A-25C.

This also helps the overall performance of the boot 70 to keep the boot 70 as light as possible, while being structurally rigid and supportive to a user's ankle. The unique design and construction is implemented specifically to work with the land ski 100.

The design of the boot 70 incorporates more of a traditional ski boot shell around most of the key parts of the boot 70, including the heel, ankle, foot, and toe, but avoids the top of the foot and lower calf. As shown in FIGS. 17A, 17B, 18, 20, 23A, 23B, 25A and 25B, the upper support 86 is focused around these key areas to reduce weight and to lower the overall height of the boot 70. That is, the upper external shell 75 is primarily focused around the calf. With the incorporation of the reel knob lacing system 84*b* the boot 70 can provide additional tighter support around the top of the foot and lower calf. The height of boot 70 is lower than traditional boots, and is meant to mimic the weight and aesthetic of a skate shoe/boot rather than a ski boot. This weight advantage provides superior controllability when in collaboration with the land ski 100.

Figure 19:
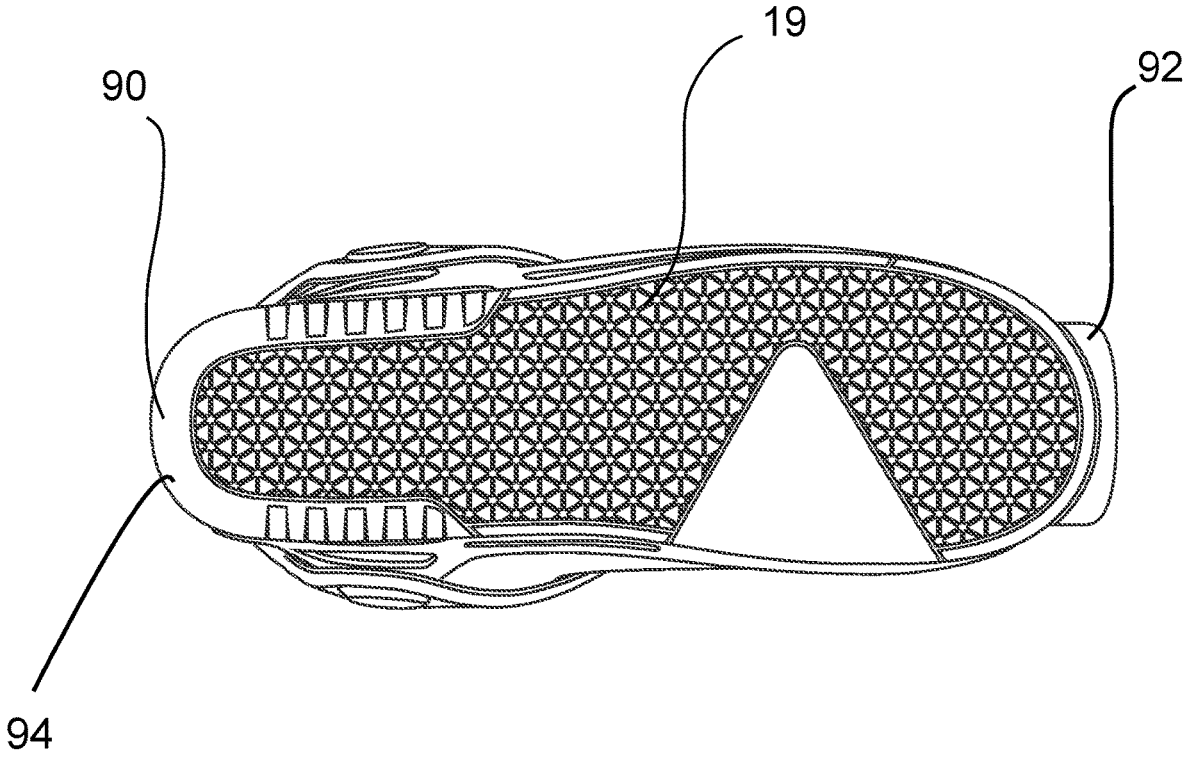
FIG. 19 is a bottom view of the boot of the system.
Figure 20:
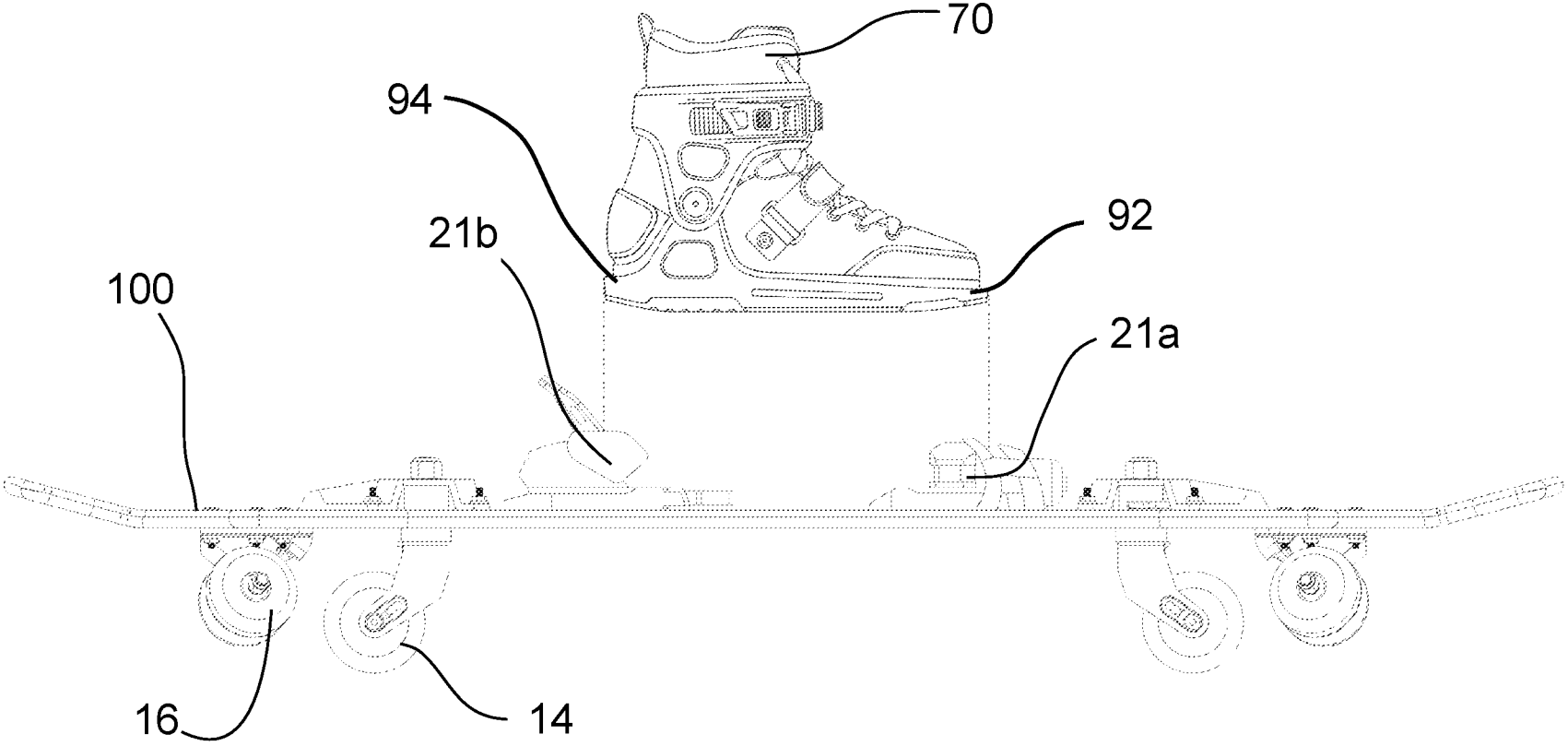
FIG. 20 is side view of the lateral side of the boot of the system with indications of engagement with a land ski.
Figure 21A:
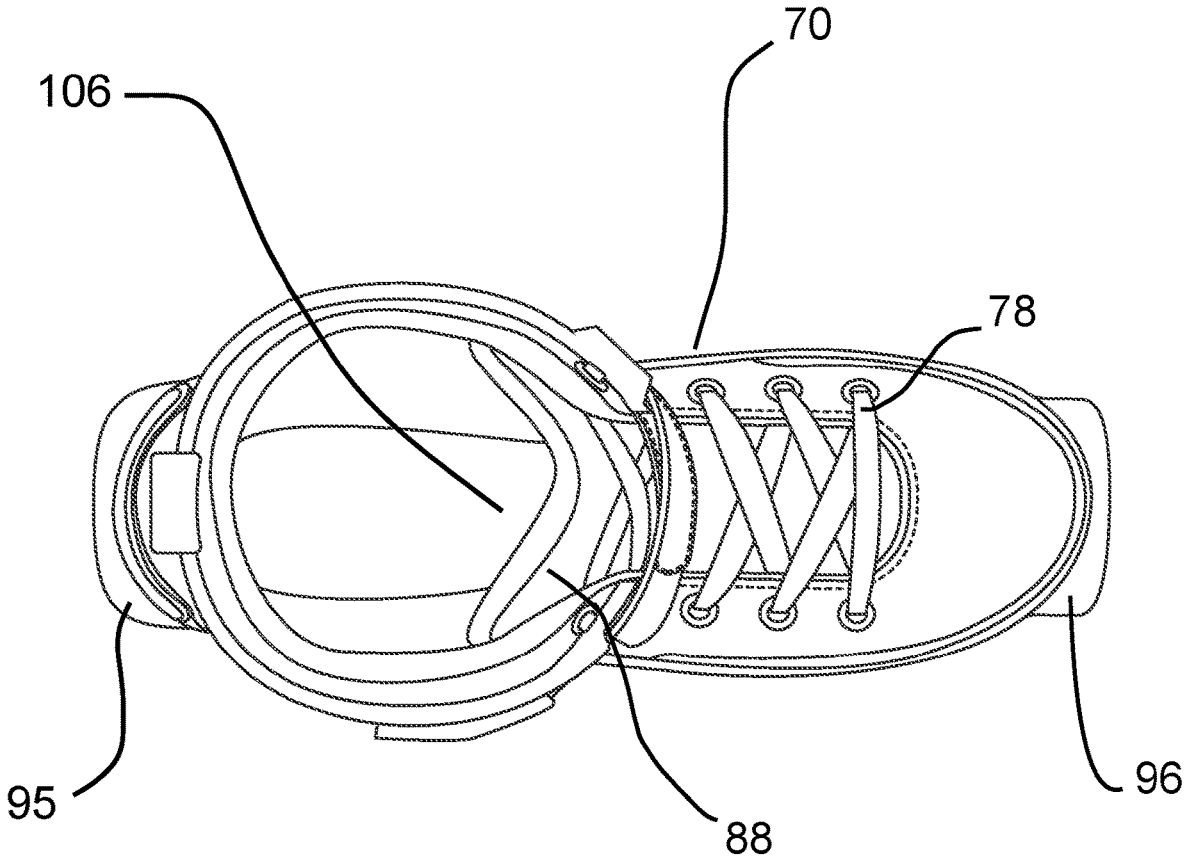
FIG. 21A is a top view of the boot of the system.
Figure 21B:
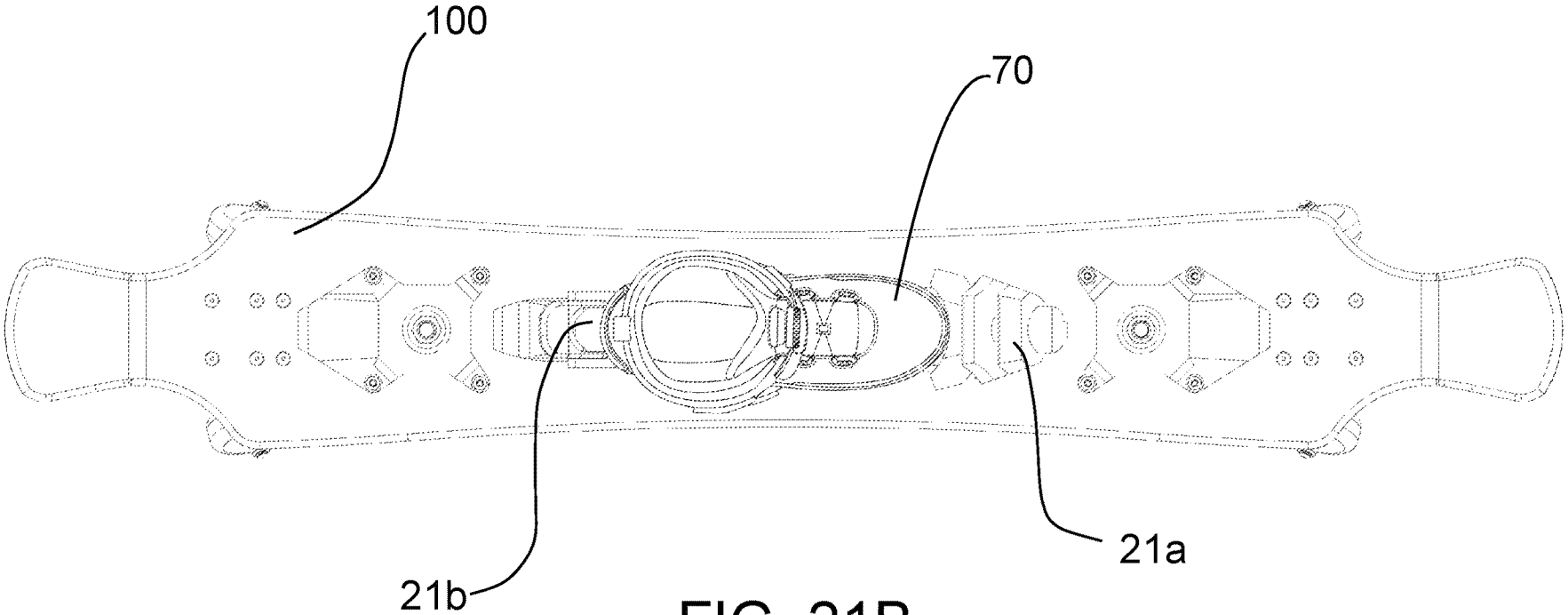
FIG. 21B is a top view of the system showing the boot of FIG. 21A with a land ski.
Figure 22A:
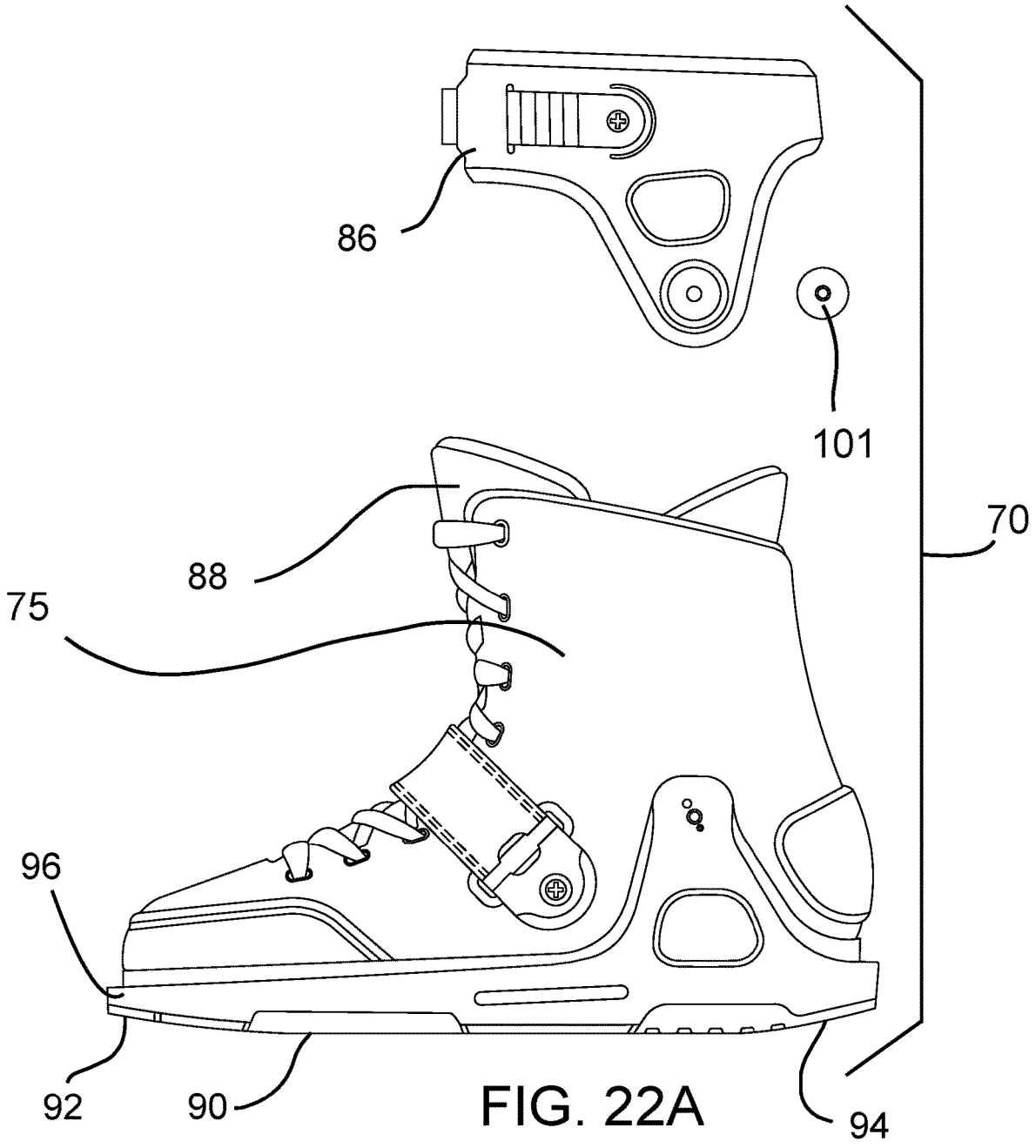
FIG. 22A is partially-exploded side view of the medial side of the boot of the system.
Figure 22B:
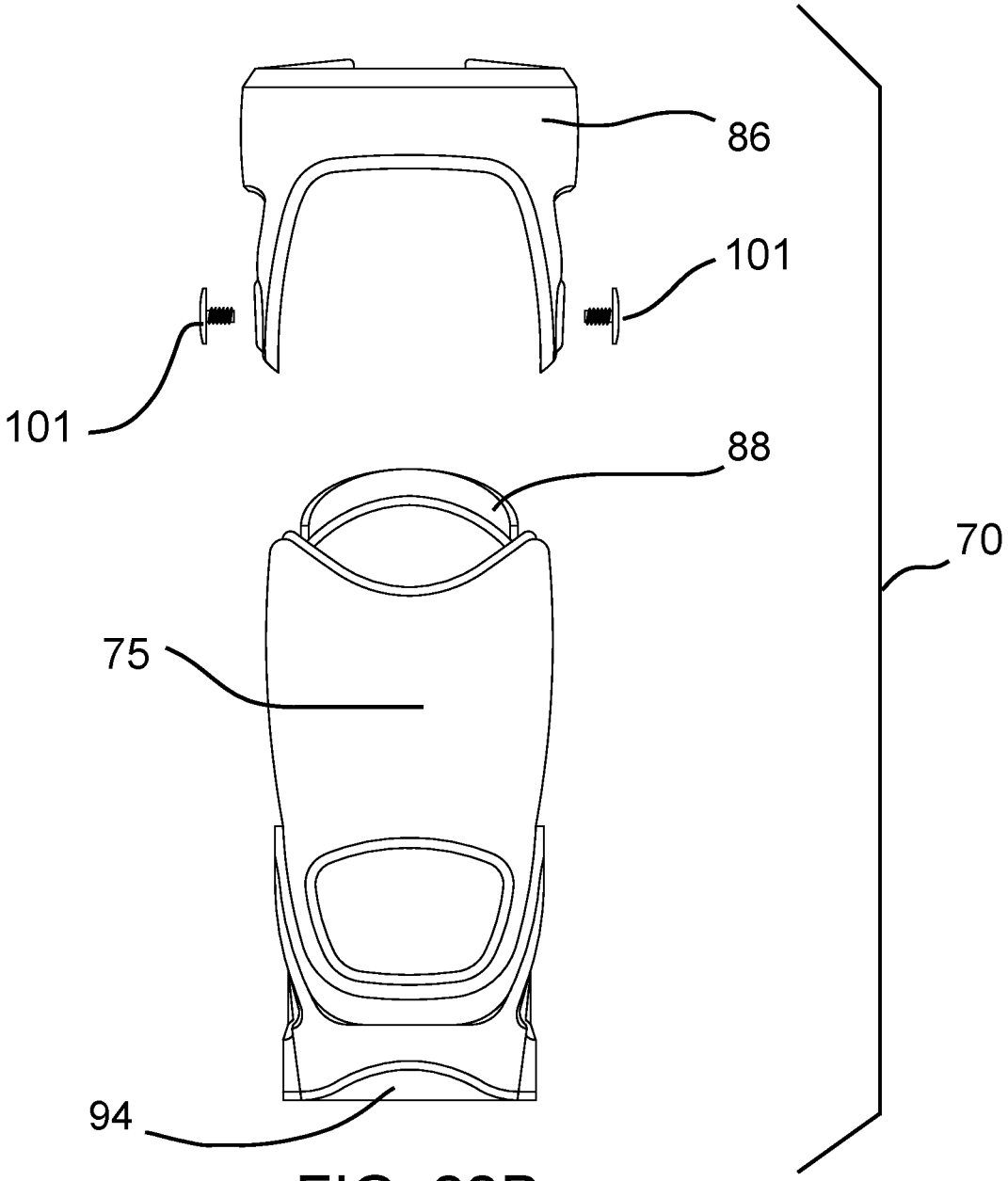
FIG. 22B is partially-exploded rear view of the medial side of the boot of the system.
Figure 22C:
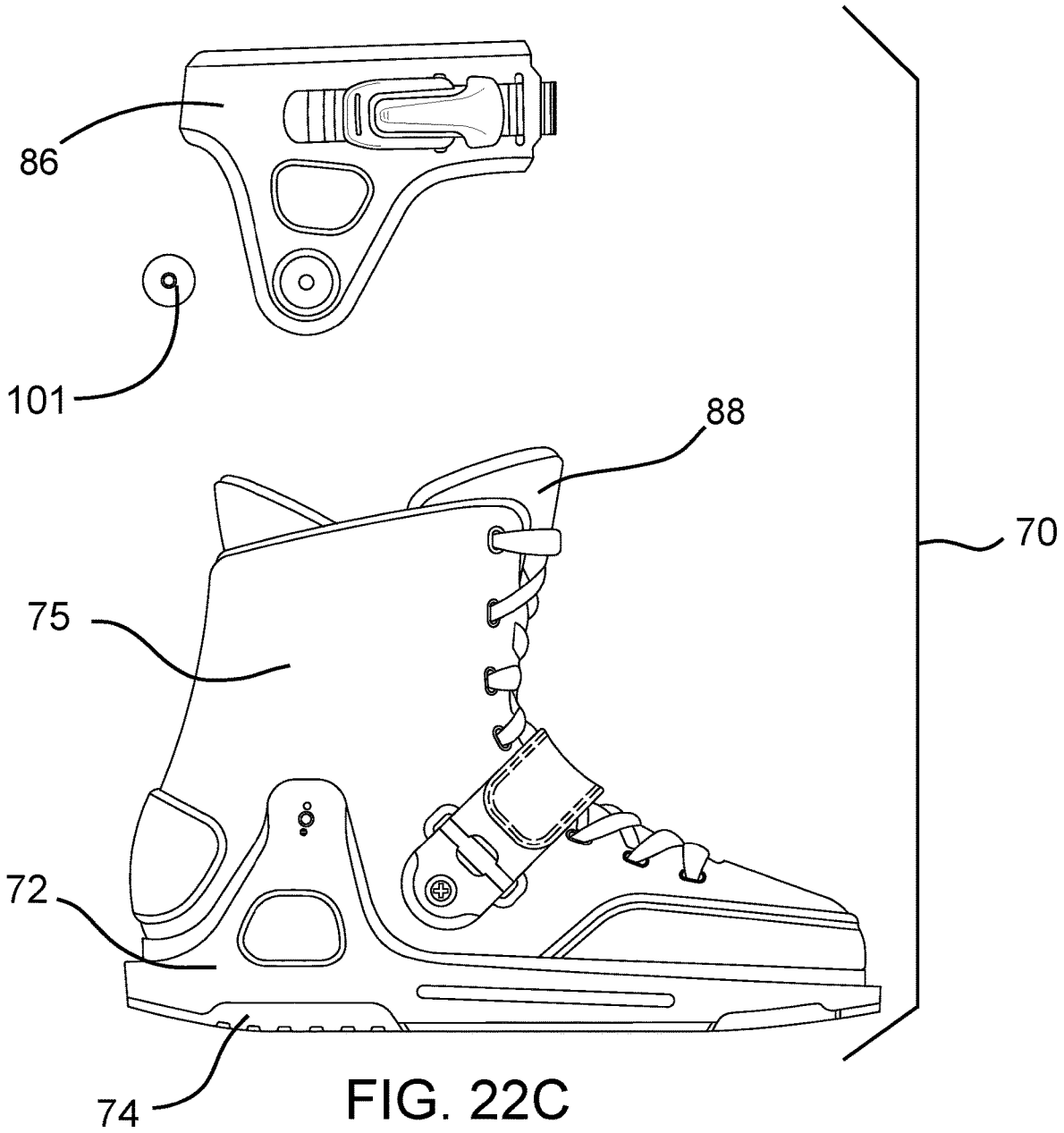
FIG. 22C is partially-exploded side view of the lateral side of the boot of the system.

The soles 72 are also rubberized on the bottom 74, with recesses 19 for grip, as may be seen in FIG. 19. Further, the boot 70 incorporates this softer rubber at the bottom 74 of the sole, similar to a skate shoe, but maintains the rigid connectors at the nose and heel in order to connect to alpine boots. This not only provides an aesthetic enhancement, but helps a user while walking in the boots 70. This is an important feature because, unlike snow skis or skis of the prior art, this invention is intended to be used in dry locations, when facilities for downhill gliding, such as ski lifts and mapped out trails, may not be available. To promote movability, the soles have cambered surfaces at the heel 94 and toe 92 portion of the boots 70, as shown in FIGS. 22A and 22C, wherein the curvature allows for easier walkability. Despite this camber, the toe 92 and heel 94 portion also have sight protrusions that are adequate for use with an Alpine binding 21, as shown in FIGS. 1, 17B, 18, 20, and 21B, even though they are not in-and-of-themselves ISO 5355 compliant.

Due to the lighter design and lower height profile of boot 70 compared traditional ski boot this boot 70 has been configured for optimal performance of the land ski 100. However, because of the construction, the boot 70 may also be beneficial with use in other skiing devices on use with water ramps, dry slope skiing, rail slides, slope-style skiing, half-pipe skiing, and mogul skiing. Another benefit of this boot 70 is that it is interchangeable with current bindings, including Alpine bindings and Grip Walk™ bindings, thus providing greater flexibility than current boots in the market.

If the rider does not have access to the incline, the hill, or the mountain, then the land ski 100 may not operate as designed. A flat surface may limit the ability to use the land ski 100 in many regions, as public access to an incline, hill, or mountain is not widespread. Although some roller skis allows a rider to ride without human power, any powered roller ski currently available is typically unable to provide the lateral sliding movement or the deep carving movements associated with the land ski 100 described herein. It should also be understood that the land ski 100, herein, has the capability of becoming motorized in some embodiments. In such embodiments, at least one omnidirectional caster 14 is replaced by a roller assembly with a motor. In other embodiments, both omnidirectional casters 14 are replaced by roller assemblies, each having a motor, and can operate independently, on in synchronization with each other. The fuel system for the motor can be a rechargeable electric motor, or a gas powered motor, depending on the application and conditions for certain markets which may have certain requirements for size, power, and range. The motor should be capable of propelling a user up to 30 miles-per-hour.

An energy source provides energy to a motor such that the motor is able to propel the land skis 100. The source may be an engine, a motor, a battery, a fuel tank, a photovoltaic cell, a capacitor, or another energy source. For example, the fuel tank can contain gasoline, which is combusted in the engine such that the engine powers the motor to propel the land skis 100. The source can be electric and rechargeable whether in a wireless manner, such as via induction, and/or a wired manner, such as via a power cord. A power source is secured to each platform 10, under the bindings on the underside of the platforms 20. The source is secured to the platform via fastening, but in other embodiments, the source is secured to the platform via nailing, adhering, mating, interlocking, bolting, clamping, or any combinations thereof. In yet other embodiments, the source is secured to the platform 10 under the bindings on the upper side of the platform. In still other embodiments, the source is not between the bindings, such as in the front portion and/or the rear portion. In such embodiments, this leaves the underside surface open for riders to continue using the skis for tricks, including grinding. Note that more than one source can be used in any manner, whether powering one or more motors in any manner, whether synchronously and/or asynchronously, independently and/or dependently, in one manner and/or in different manners, and/or in any type of correspondence, such as one-to-one, many-to-many, one-to-many, and/or many-to-one.

An exemplary embodiment of a roller land ski with an ability to move and stop consistent with mechanics of an actual snow skiing is disclosed herein, and shown in FIGS. 1-16H, 17B, 18, 20, and 21B. The land ski 100 comprises a rigid platform 10 with a top surface 11 and bottom 20 surface having a pair of trucks 58 mounted to the bottom surface 20 wherein carving wheels 17 are mounted to curved axles 30 to provide movability of the rigid platform 10. Each truck 58 has a curved axle 30 on either side of the truck 58 and said curved axles 30 extend away from each of said trucks 58 in a semicircular arch wherein the distal ends 31 of said axles 30 are closer to the surface of said rigid platform 10 to enhance the turning radius of the rigid platform 10. A pair of omnidirectional casters 14 are included and spaced laterally apart toward the distal ends of the rigid platform 10. An alpine ski binding 21 and mount 18 are affixed to the top surface 11 of the rigid platform 10 in a front to back orientation configured to receive an alpine ski boot connection.

The rigid platform 10 of the land ski 100 further includes portions defined as a tip 25 portion, a tail 27 portion, an inner side 44*a*, and an outer side 44*b*, as shown in FIG. 1. The inner side 44*a* and the outer side 44*b* have concave curvature in which said curvature narrows width of said rigid platform 10 laterally inward toward a center of said rigid platform 10 and extends wider towards the distal ends defined by said tail 27 portion and tip 25 portion. The rigid platform 10 also includes four wheel cutouts 34, as shown in FIG. 4, wherein each cutout 34 is located above one of the carving wheels 17, and is configured to accommodate vertical movement of said wheels 17 mounted to said curved axles 30 extending from said trucks 58 attached to said rigid surface 20. The carving wheels 17 are further configured to achieve carving by using an individual axis of rotation 66/68 for each individual wheel 17*a*/17*b*, providing a variation of forward directions depending on the carving wheel 17*a*/17*b*.

Each truck 58 in the pair of trucks 58 is pivotally mounted to a bottom surface 20 of said rigid platform 10, and configured to shift at each distal end of said axles vertically in both clockwise and counter clockwise rotations based upon the application of weight to a particular side of said top surface of said rigid platform. That is, when the nut 60 is loosened in the truck, the two parts bracket 62 and axle mount 30*c* pivotally rotate in either a clockwise or counter-clockwise rotation. Each truck 58 also includes a base plate 62 mounted to said bottom surface 20 of said rigid platform 10, a pivot cup 63 is formed within said base plate 62 that a hanger 30*d* may pivotally engage into said pivot cup 63 of said base plate 62. Further, said base plate 62 includes an aperture 60*b* wherein a kingpin 61 can fit through said aperture 60*b* in said base plate 62 and through an aperture 33 in said hanger 30*d* and engaged with a king pin nut 60, as shown in FIG. 10C.

Further, the pivotally mounted trucks 58 are configured with a means of loosening a securement of said trucks 61/60, thereby configuring said trucks 58 to allow rotation when weight is placed on an edge of said platform 10 of the land ski 100 causing a forward direction of said wheels 17 forming an arched path for said rigid platform to follow by turning in the direction of the side where weight has been placed. In some embodiments, this means of loosening said securement of said trucks 58 includes a king pin 61 and a king pin nut 60 that, when tightened reduce the ability of rotation and when loosened increase the ability of pivotal rotation.

Each caster 14 includes fork body 42 that acts as a frame and a wheel mount for a caster wheel 38. The caster wheel 38 is mounted within the fork 42 by an adjustable axle bolt 55/54. This axle bolt 55/54 extends through a center aperture 39 in said caster wheel 38. This axle bolt 55/54 is engaged with an adjustable wheel channel 52, wherein said caster wheel 38 may be raised or lowered relative to said rigid platform by loosening said axle bolt 55/54, adjusting the height said wheel, and tightening said bolt 55/54, and the wheel channel includes nesting cutouts to assist with securing said bolt at a pre-designated height.

The fork body is rotatably coupled to the caster mounting bracket by insertion of the kingpin through the fork body, and use of a bearing. Between the fork body and the caster mounting bracket is a tension cam, which is configured in a shape that provides force on a tension screw of a tension bar when each caster in said pair of casters is rotated, thereby urging said caster towards a stable position when no force is exerted on said caster, and urging a caster in a direction of force when said force is applied. In some embodiments, the shape of the tension cam is an oval.

The rigid platform 10 of said exemplary embodiment also includes an aperture 56 in the rigid platform 10, wherein a stem 36 of said omnidirectional caster 14 may extend through. A kingpin 26 is fitted through the stem 36, also referred to herein as a spacer 59, and is fastened to a locking nut 24 thereby connecting said fork body 42 of said omnidirectional caster 14 to a caster mounting bracket 22. The mounting bracket 22 is fastened to a top surface 11 of said rigid platform 10. This arrangement can be primarily seen in FIGS. 8 and 11-13.

An alpine ski binding 21 is mounted atop of said alpine ski binding mount 18 affixed to the top surface 11 of the rigid platform 10. The alpine ski binding 21 is mounted to said alpine ski binding mount 18 using at least one mounting screw (not shown) fastening a toe portion 21*a* of said alpine ski binding 21 and securing said alpine ski binding 21 to a front binding channel 41 and least one mounting screw (not shown) fastening a heel portion 21*b* of said alpine ski binding 21 and securing said alpine ski binding 21 to a rear binding channel 41, which may be seen in FIG. 3, as well as may be appreciated by viewing FIGS. 17B, 18, 20, and 21B. The binding channels 41 allow said alpine ski binding 21 to adjust forwardly and backwardly to accommodate a range of ski boot sizes, as well as locate said alpine ski binding 21 forward or backward from a center point of said rigid platform 10.

In some embodiments, the binding mounting plate 18 includes at least one mounting location 48, wherein said at least one mounting location 48 includes a plurality of nested screw recesses 46, as shown in FIG. 3. The plurality of nested screw recesses 46 are configurable to shift said binding mounting plate 18 forward and backward relative to a center point of said rigid platform 10. In some embodiments, the at least one mounting location 48 includes four mounting locations toward a center portion of said binding mounting plate 18 spaced in a square pattern wherein said nested screw recesses 46 line up with apertures in said rigid platform to thereby insert screws 40/50 in for securement to said rigid platform 10. In some embodiments, the attached binding 12 is an alpine ski binding 21, but it may also be appreciated, that in other embodiments, any kind of traditional release and non-release ski bindings may be attached.

Also provided herein is an exemplary embodiment of a system for replicating the experience of skiing on dry land, as shown primarily in FIGS. 1-25C. The system includes a pair of roller skis 100, as described above, an alpine ski binding 21 mounted atop of said alpine ski binding mount 18 affixed to the top surface 11 of the rigid platform 10, and a pair of boots 70, wherein each boot is configured to engage with said roller ski 100 in said pair of said roller skis. FIGS. 1 and 17B-20 show the system, comprised of the components shown in FIGS. 2-17A and 21A-25C.

As may be appreciated in FIGS. 17A-25C, each of said boots 70 in said pair of boots further includes an upper 76 constructed of flexible material, a stiff cuff 86 surrounding an opening 87 for a user's foot, a fastener 82/84*a* for tightening said opening 87, a tongue portion 88, a sole 72 having an top portion 73 and a bottom portion 74, an internal liner 102, an ankle support structure 104, and laces 78 for constricting a volume created by a cavity 106 between said upper 76 and said sole 72; and The upper 76 forms an opening 87 configured for receiving a user's foot. The sole 72 is configured to include a bottom portion 74 having a linear bottom surface 90, wherein a toe 92 and heel 94 of said linear bottom surface each outwardly curve upward. The sole terminates at a forward portion in a toe lug 96 configured for use with an alpine binding 21 connection. The sole 72 also terminates at a rear portion in a heel lug 95 configured for use with an alpine binding 21 connection, as may be seen in FIG. 21A. The bottom portion 74 of the sole 72 comprises a rubber lower surface 90 with treads 91 formed therein, as may be appreciated from FIG. 19.

The internal liner 102, the upper 76 of flexible material, and the sole 72 are bonded through sonic welding to form a unitary piece, wherein said flexible material of said upper 76 is sandwiched between said sole 72 and said internal liner 102.

Figure 23A:
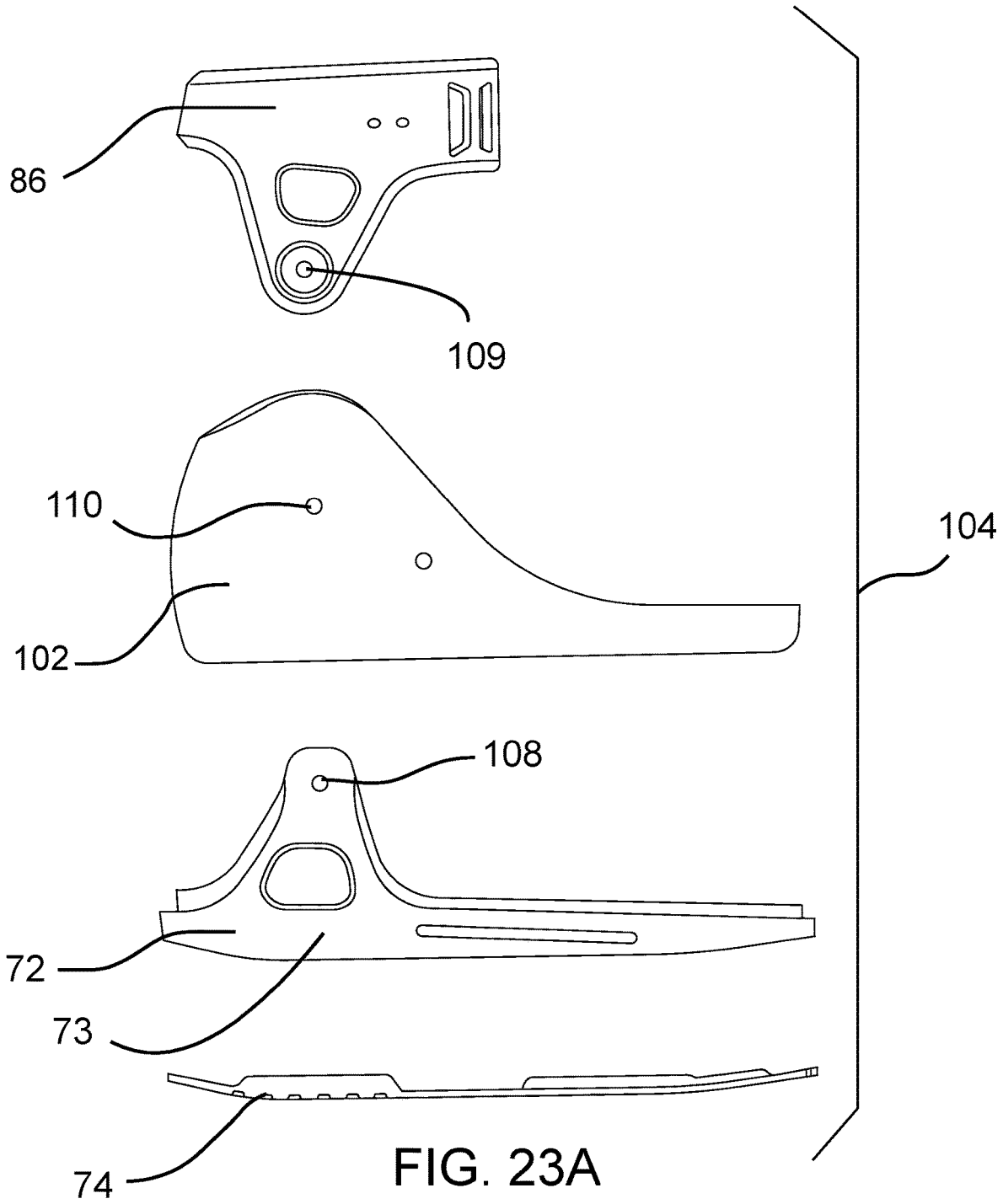
FIG. 23A is an exploded side view of the boot core support structure.
Figure 23B:
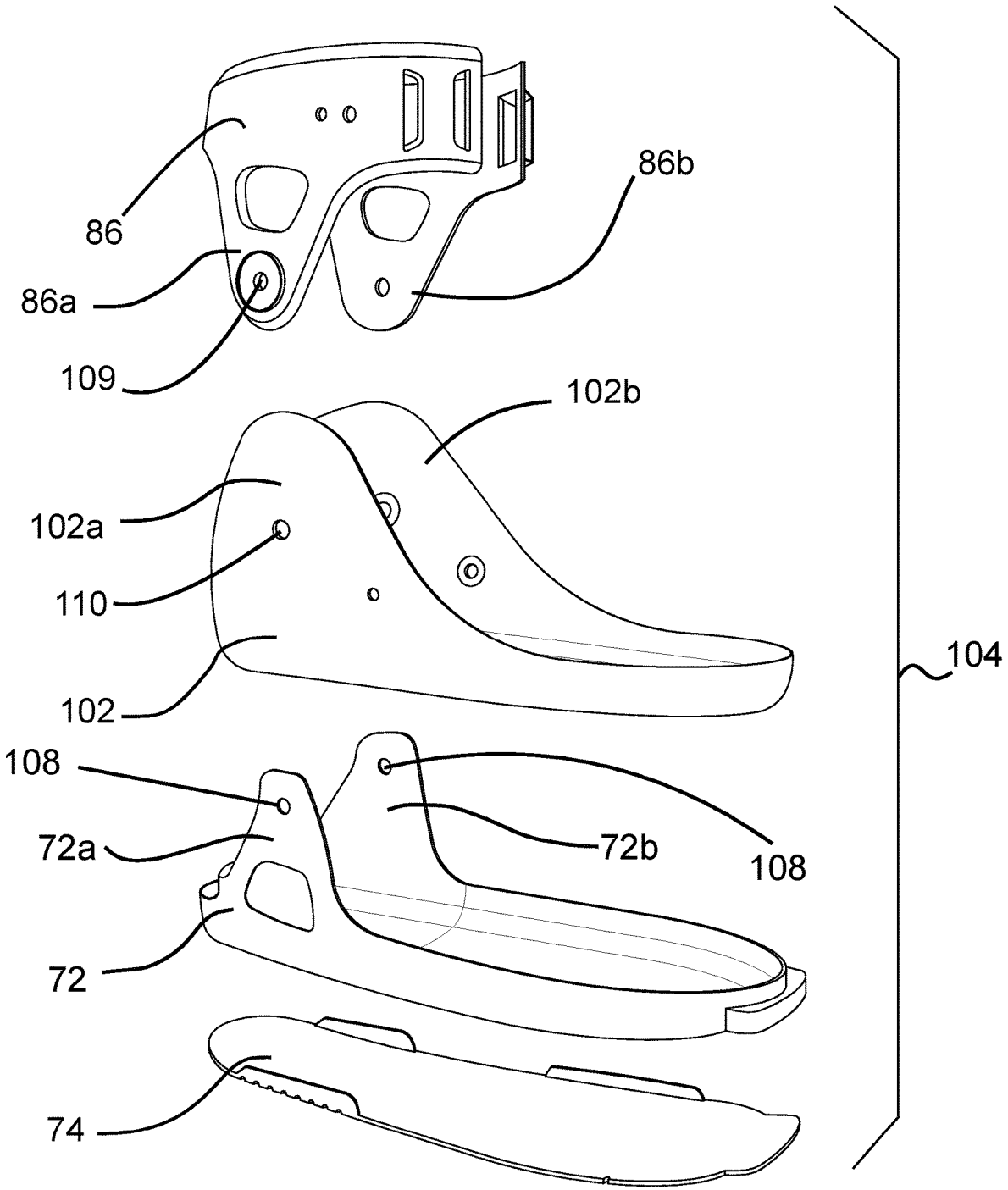
FIG. 23B is an exploded front perspective view of the boot core support structure.
Figure 24A:
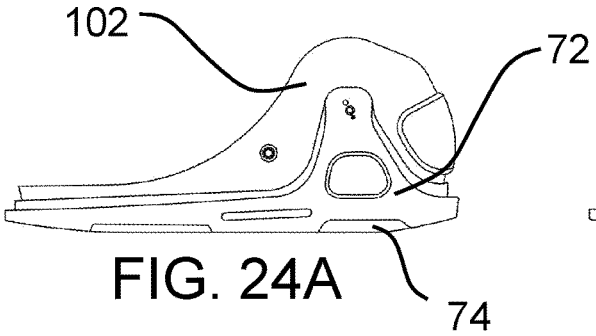
FIG. 24A is a medial side view of the liner and sole of the boot core support structure.
Figure 24D:
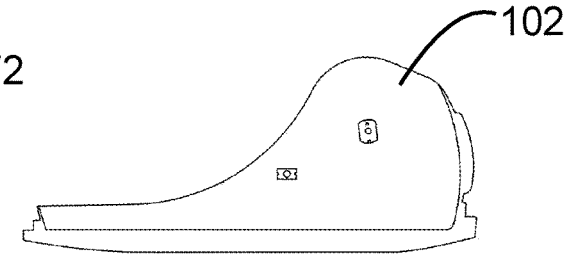
FIG. 24D is a cross-sectional side view showing the inside of a lateral side of said liner and sole of the boot core support structure.
Figure 24B:
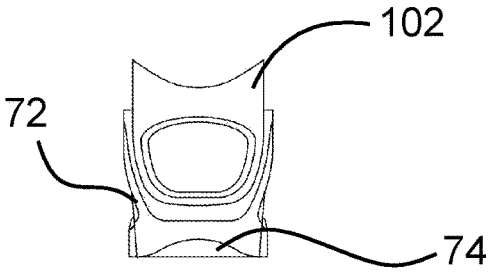
FIG. 24B is a rear view of the liner and sole of the boot core support structure.
Figure 24E:
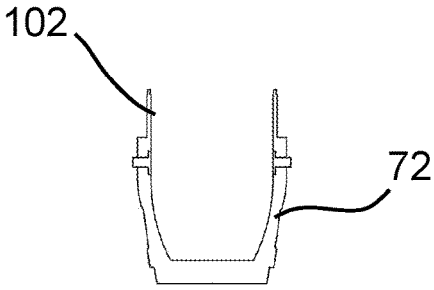
FIG. 24E is a cross-sectional rear view of the view in FIG. 24B
Figure 24C:
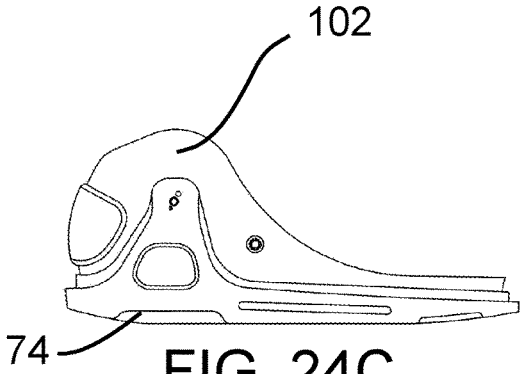
FIG. 24C is a lateral side view of the liner and sole of the boot core support structure.
Figure 24F:
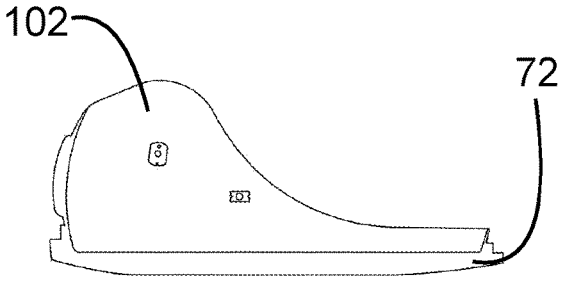
FIG. 24F is a cross-sectional side view showing the inside of a medial side of said liner and sole of the boot core support structure.

The ankle support structure 104 includes the sole 72 with a pair of sole extensions 72*a*/72*b*, the internal liner 102 with a pair of liner extensions 102*a*/102*b*, the cuff 86 with a pair of cuff extensions 86*a*/86*b*, and a pair of hinge screws 101, as may be seen in FIGS. 23A and 23B.

An mentioned, a pair of sole extensions 72*a*/72*b* protrude from the sole 72. A first extension 72*b* is on a medial side of said sole, and a second extension 72*a* is on a lateral side of said sole. The pair of sole extensions 72*a*/72*b* are molded from the same piece of material as the sole 72. Each of the sole extensions 72*a*/72*b* in the pair of sole extensions have a screw aperture 108 therein.

The pair of liner extensions 102*a*/102*b* protrude from the internal liner 102. A first extension 102*b* is on a medial side of said internal liner 102, and a second extension 102*a* is on a lateral side of said internal liner 102. The pair of liner extensions 102*a*/102*b* are molded from the same piece of material as said internal liner 102, each of said liner extensions in said pair of liner extensions have a screw aperture 110 therein;

The pair of cuff extensions 86*a*/86*b* protrude downwardly from said cuff 86. A first extension 86*b* is on a medial side of said cuff 86, and a second extension 86*a* is on a lateral side of said cuff 86. The pair of cuff extensions 86*a*/86*b* are molded from the same piece of material as said cuff 86. Each cuff extension in the pair of cuff extensions 86*a*/86*b* have a screw aperture therein 109.

A pair of hinge screws 101 are also included, as shown primarily in FIGS. 17A and 22A-22C. A first hinge screw in said pair of hinge screws 101 is inserted on a medial side of said support structure 104 through said apertures 108/109/110 in said extensions in said sole 72, internal liner 102, and cuff 86. The said second hinge screw in said pair of hinge screws 101 is inserted on a lateral side of said support structure through said apertures 108/109/110 in said extensions in said sole 72, internal liner 110, and cuff 86.

Figure 17A:
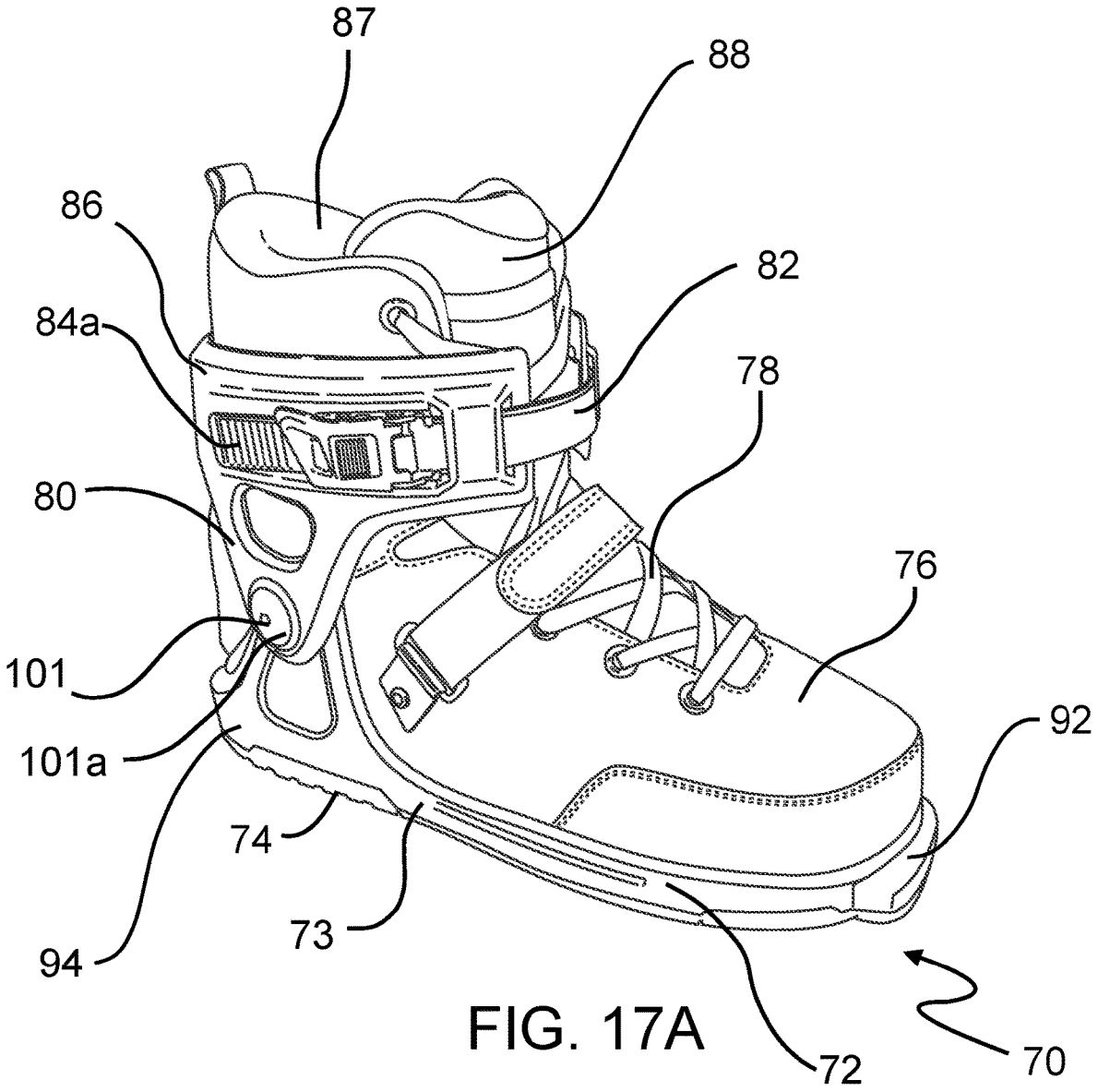
FIG. 17A is a perspective view of the boot of the system.
Figure 17B:
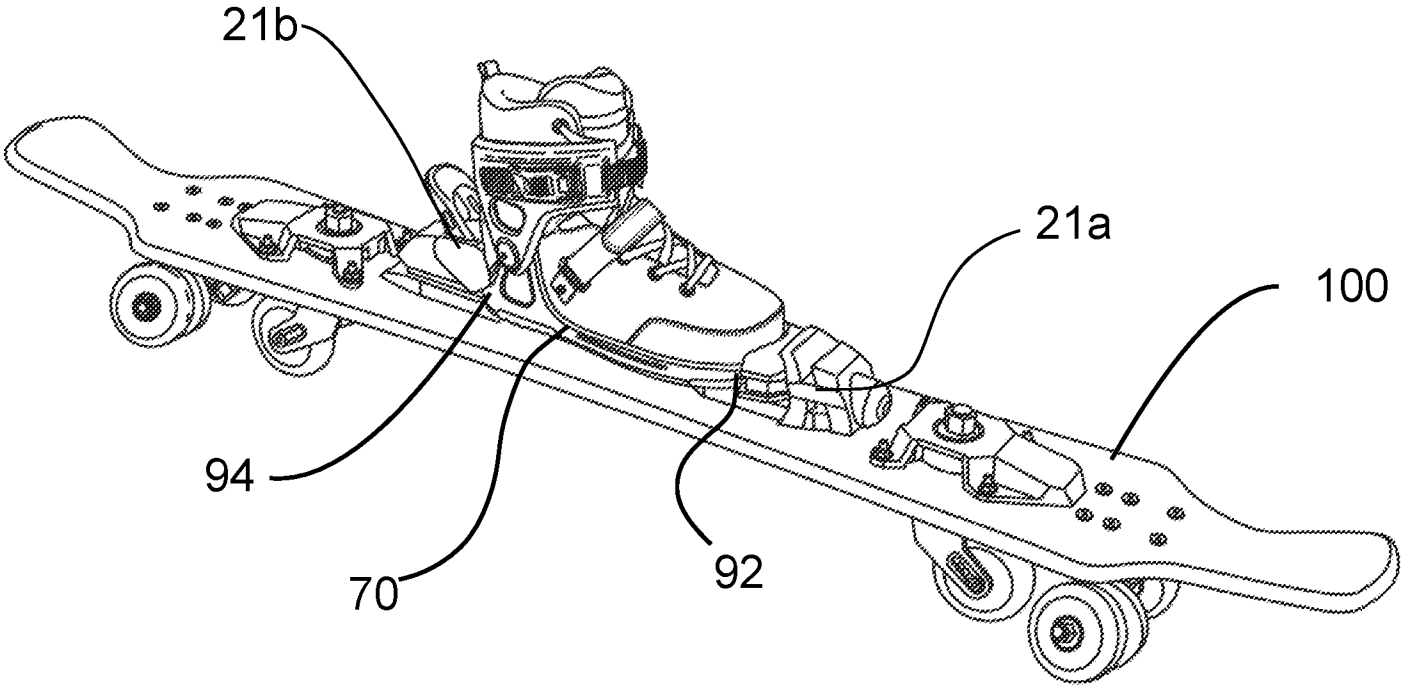
FIG. 17B is a perspective view of the system showing the boot of FIG. 17A with a land ski.
Figure 18:
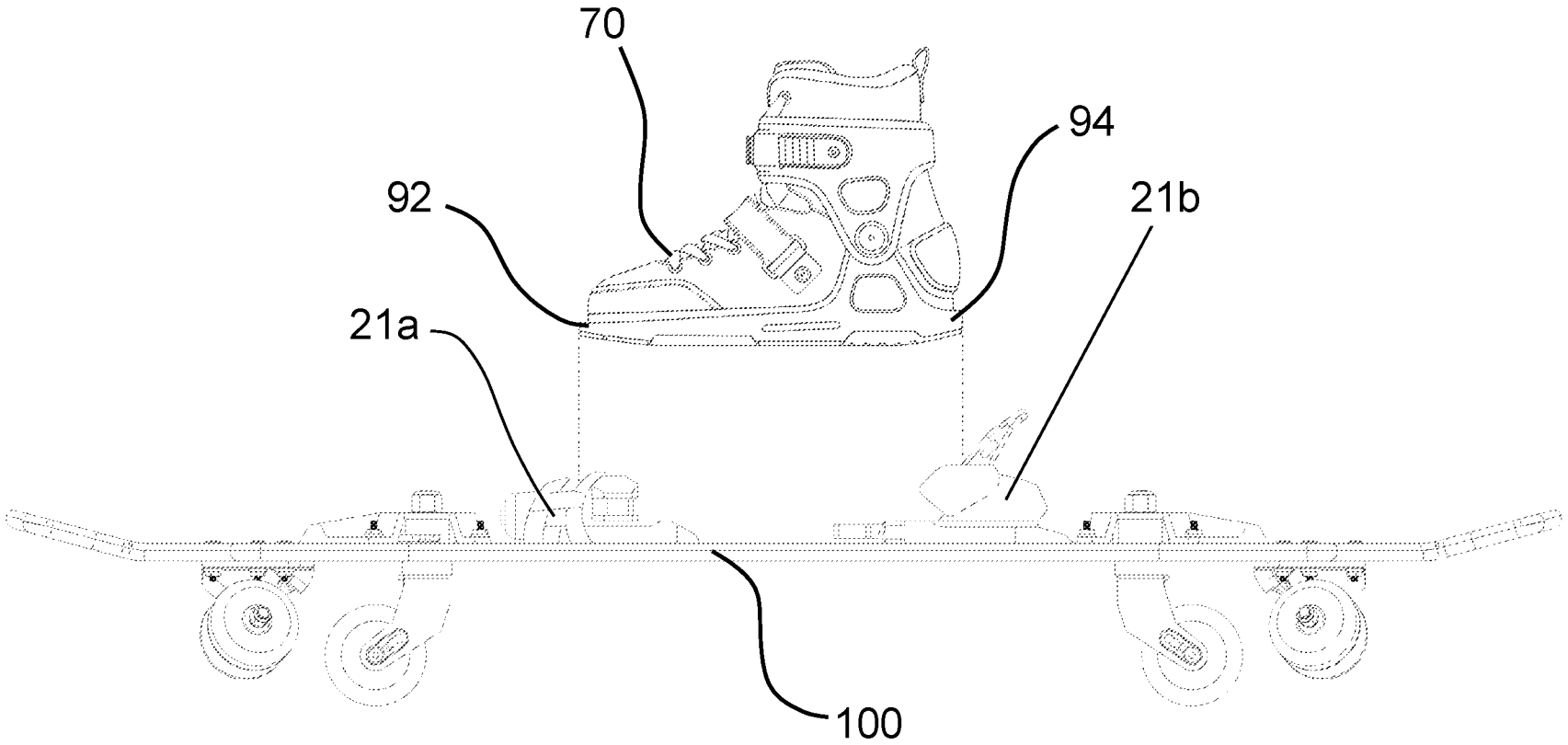
FIG. 18 is side view of the medial side of the boot of the system with indications of engagement with a land ski.

The pair of hinge screws 101 create a pair of hinge points 101*a*, as may be appreciated in FIG. 17A, allowing a top portion of said ankle support, including the cuff 86, to move forward to back relative to said hinge point 101*a* of said ankle support structure 104 to allow flexibility while providing rigid support for a user's ankle.

Figure 25A:
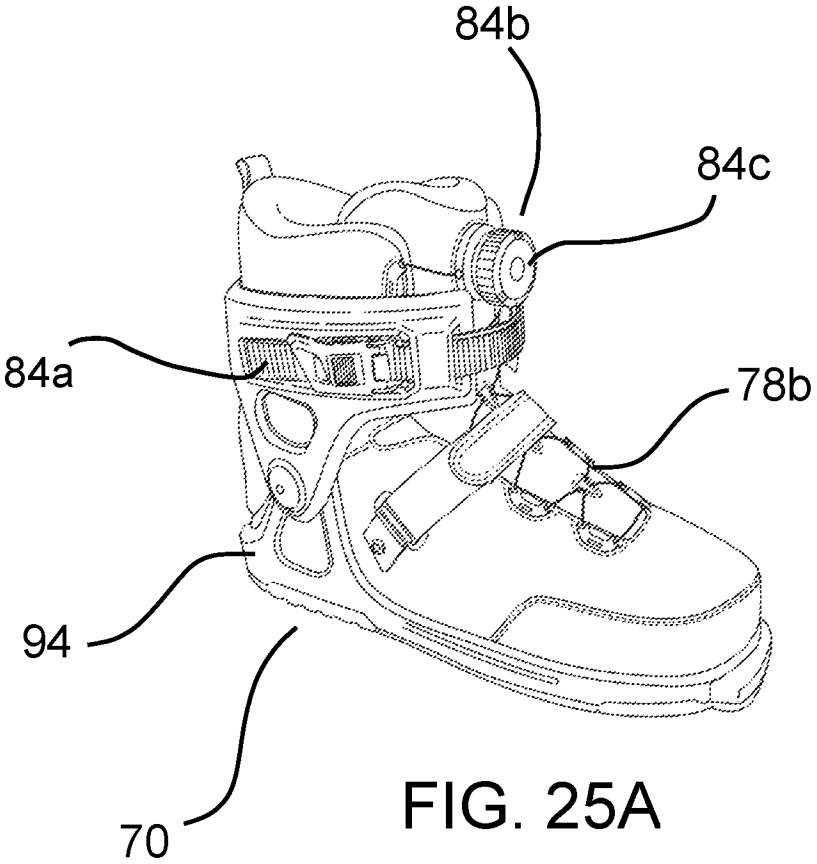
FIG. 25A is a front perspective view of the boot with a reel knob lacing system closure.
Figure 25C:
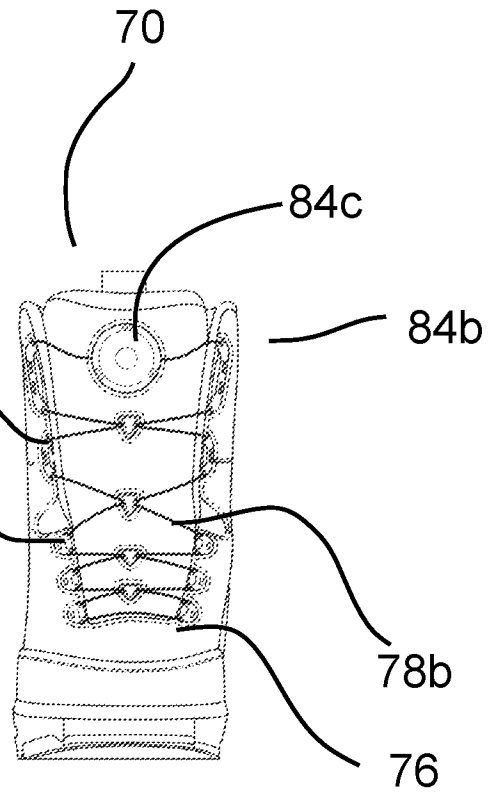
FIG. 25C is a view of the front of the boot with a reel knob lacing system closure, showing the lacing system without cuff and strap.
Figure 25B:
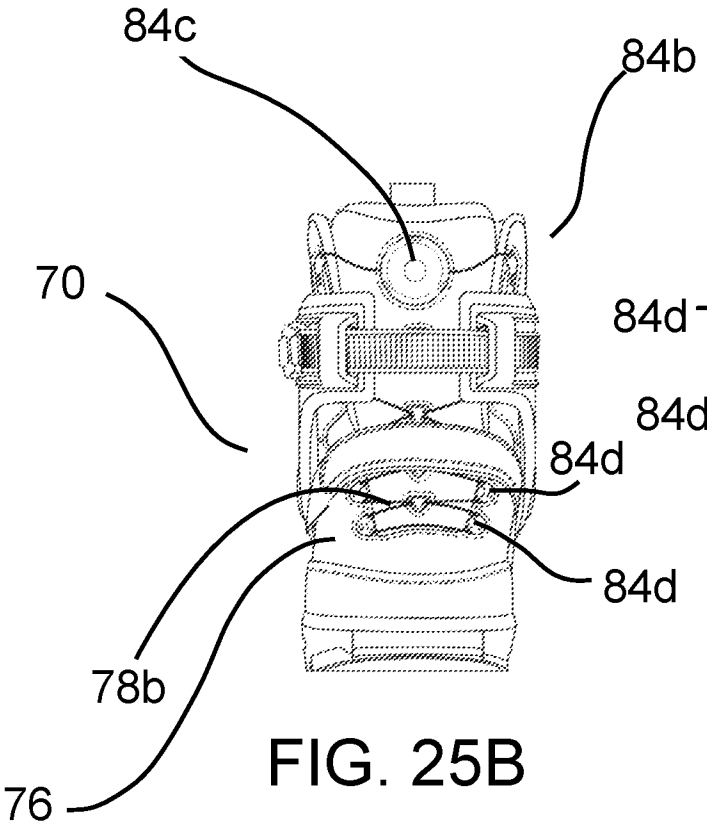
FIG. 25B is a front view of the boot with a reel knob lacing system closure.

In some embodiments the fastener for tightening said opening for each boot in said pair of boots is a strap with fastening ribs and a ratchet fastener type buckle 84*a*, as shown in FIG. 17A. In other embodiments, the fastener for tightening said opening for each boot in said pair of boots is a reel knob lacing system 84*b*, as shown in FIGS. 25A-25C.

This reel knob lacing system 84*b* includes at least one knob 84*c* with an attached reel (not shown, but internal to knob 84*c*), wherein the laces 78*b* accumulate about a spun reel about an axis, fixed to each boot 70 in said pair of boots and may be turned by said knob 84*c*. The reel is configured to engage with a lace cord 78*b* configured to be wound around said reel, wherein when said knob 84*c* is turned, the reel collects the lace 78*b*, and when the knob 84*c* is turned in an alternate direction, the lace 78*b* releases (loosens). The reel knob lacing system 84*b* also includes a plurality of upper anchors 84*d* that are affixed to the upper 76 of each boot 70 and engages with the laces 78*b*, wherein when the knob 84*b* is turned to collect the laces 78*b*, said laces 78*b* pull on the upper anchors 84*d*, thereby tightening the upper 76 and constricting the cavity created for a user's foot. The lace cord 78*b* act as said laces in each boot 70 in said pair of boots, and said knob 84*c* affixed to said reel is configured to wind said reel when engaged thereby constricting said opening 87.

In most embodiments, the upper 76 material for each boot 70 in said pair of boots is either a fabric, a mesh, or a combination of the two. The ankle support cuff 86 material is a stiff material, such as plastic.

Further provided herein is an exemplary embodiment of a method for replicating the experience of skiing on dry land. The method includes providing a pair of independent platforms 10. Each platform 10 in the pair of independent platforms further includes a pair of caster wheels 14, a pair of carving wheel assemblies 16, and a mounting location 40 for a ski boot binding 12, thereby creating a land ski 100, as may be seen in FIGS. 1-9. Each carving wheel assembly 16 includes a truck 58 with a plurality of carving wheels 17 attached to the axles 30 therewith.

The method step for providing a pair of independent platforms 10 further includes configuring each caster 14 in the pair of casters 14 to remain in a linear direction from front to back of the platform 10 until significant external lateral pressure is placed on the caster 10. This is done by incorporating a tension mechanism 51/53/57, as may be seen in FIGS. 8, 12, and 13, to urge the wheel 38 of the caster 14 in to a stable forward-facing position when no force is applied to the casters 14. Incorporating the tension mechanism 51/53/57 also assists with rotating of the caster 14 in a direction of the force when force is applied. In this application, a "significant pressure" is a pressure that is greater then the tension provided by the tension cam 57 and tension bar 51, whereby once the pressure is applied, the caster 14 will rotate, despite the opposing forces of the tension cam 57 and tension bar 51. The tension mechanism includes at least a tension cam 57, a tension screw 53, and a tension bar 51, configured into a caster mounting bracket 22 of each caster 14 in said pair of casters 14.

The method step for providing a pair of independent platforms also includes mounting each of the casters 14 in the pair of casters 14 to a top surface 11 of each of the platforms 10, wherein a stem 36/59 of the caster 14 descends through an aperture 56 to an underside 20 of the platform 10 to provide additional surface area under the platform 10 for use with ski maneuvers, a configuration of which may be appreciated in FIGS. 7 and 8. This is important when the ski maneuvers are "tricks" such as grinding on a rail or other surface.

Figure 11:
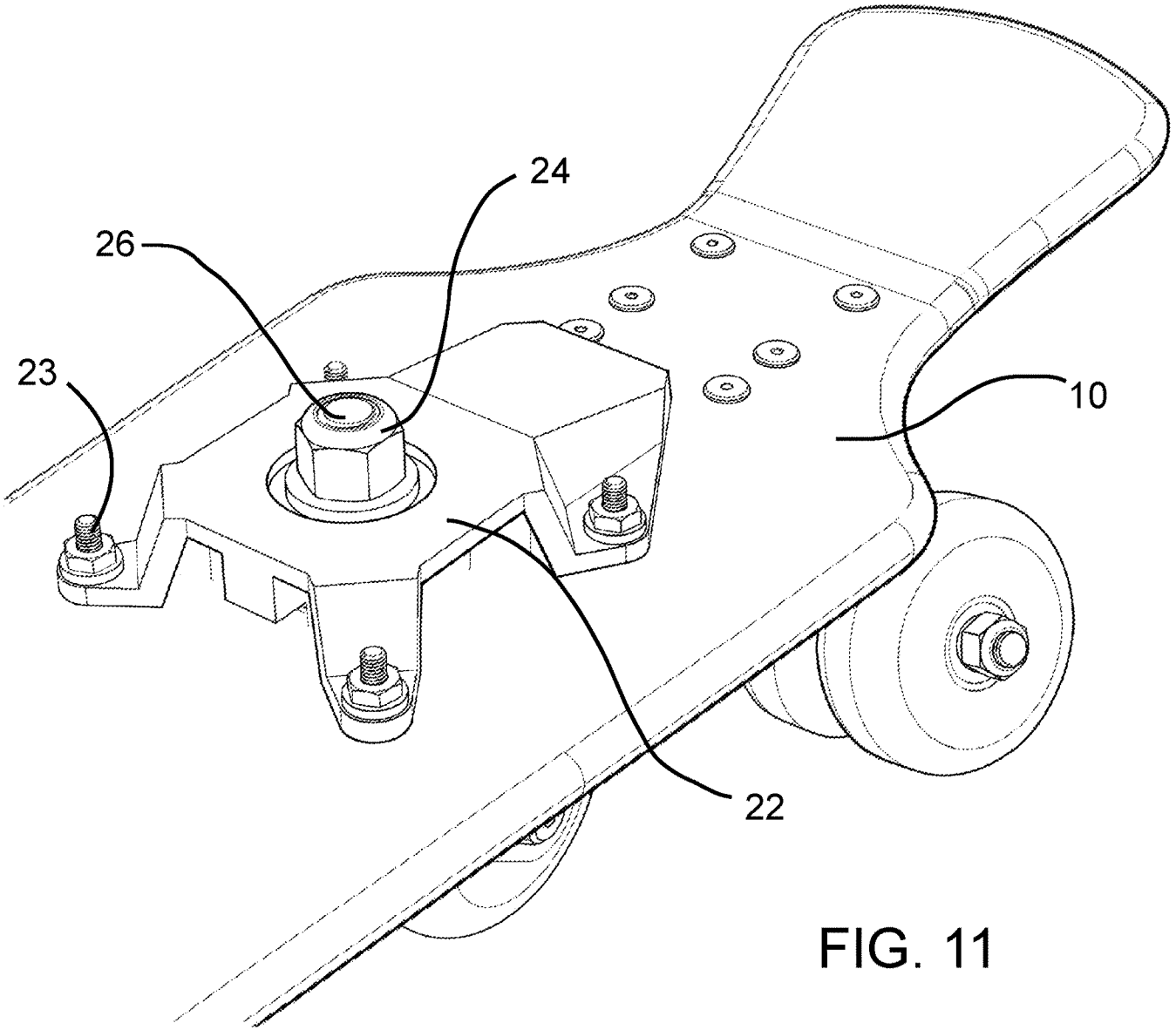
FIG. 11 is an enlarged isolated perspective top view of the tail end of a land ski.
Figure 12:
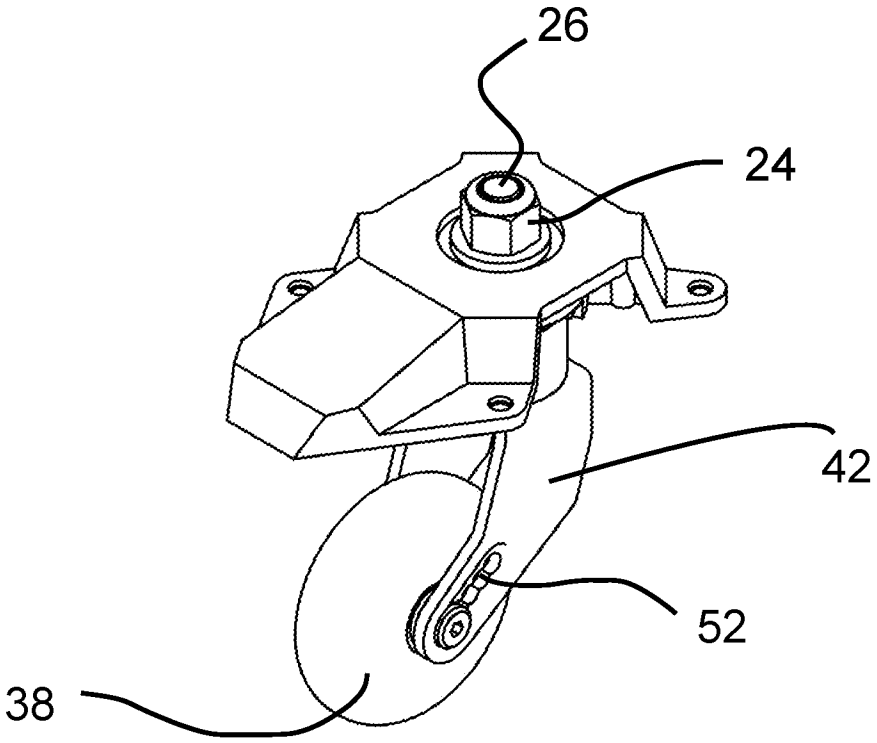
FIG. 12 is an isolated view of the caster.

The method step for providing a pair of independent platforms additionally includes configuring the mounting of each caster 14 in the pair of casters 14 to the top surface 11 of each of the platforms 10 to lower the height of the platform 10 relative to a surface on which the caster wheels 14 engage, which may be appreciated in FIGS. 2, and 11.

The method step for providing a pair of independent platforms also includes the step of providing traction for movement of the platform 10 when the platform 10 is angulated, as shown in FIGS. 16A-16H, relative to a horizon of ground surface 120/122/124 by configuring each carving wheel assembly 16 to include a truck 58 with a plurality of carving wheels 17 rotatably affixed to an axle 30, as may be appreciated in FIGS. 9-10C. Each truck 58 is located at a center axis from front to back relative a center point of a width of the platform 10, each truck 58 contains a pair of axles 30, each axle 30 in the pair of axles 30 extends perpendicularly outwardly away from the center point, upwardly, and inward, creating an angled arch, as shown in FIGS. 9-10C.

The method step for providing a pair of independent platforms also includes the step of providing shock absorption for the land ski 100 by mounting the trucks 58 along the center point of the platform and employing the use of curved axles 30. The shock absorption is achieved by mounting the curved axles 30 to the truck 58 at a point relative to a center point of the platform 10, rather than at the distal ends, and using a semi-rigid material capable of slight flex providing a degree of vertical travel at the distal ends of each axle 30. The term "slight flex" indicates that the axles 30 provide support and hold their form, but can accommodate an abrupt compression due to changes in the road surface. While the axles 30 are stiff and will still transfer some shock to a user, the shock will be absorbed to a degree because of the allowable degree of travel in the axles 30.

The method step for providing a pair of independent platforms also includes the step of positioning each truck 58 in the pair of trucks 58 in a location towards the outside of the casters, as shown in FIGS. 5-7, with a one caster 14 in a front-most position of the platform and the remaining caster 14 in a back-most portion of the platform to maximize surface area in between the pair of casters 14. As mentioned above, the maximization of space between the front and rear casters 14 enhances the land ski's ability to accommodate a variety of ski maneuvers and tricks.

Some embodiments of the method for replicating the experience of snow skiing further include providing wheel cutouts 34 in the rigid platform 10 corresponding to a location above the carving wheels 17 to allow a greater degree of vertical travel of the wheels 17 and angulation of the platform by allowing the carving wheels 17 to travel beyond a threshold of the top surface 11 of the rigid platform 10, as may be appreciated in FIGS. 4, 9, and 16A-16H.

Some embodiments of the method for replicating the experience of snow skiing further include providing enhanced ground clearance of the rigid platform 10 when performing maneuvers that require the board 10 to be inclined relative to a road surface by angulating at least one of a tip 25 and a tail 27 portion upward, as may be seen in FIGS. 1 and 6, to provide for greater clearance and degree of rotation at which the carving wheels 17 may engage head-on with a ground surface. This allows the system to accomplish more ski maneuvers, such as tricks and jumps.

Some embodiments of the method for replicating the experience of snow skiing further include providing an enhanced geometry of the platforms 10 to allow for tighter turning by configuring the platform 10 to include concave curves at edges 44/44*a*/44*b* creating an hourglass shape, as may be seen in FIGS. 1 and 5, increasing the flexure of platform 10 and allowing tighter turns.

The method for replicating the experience of snow skiing further includes providing a pair of boots 70, shown in FIGS. 17A, 21A, and 22A-25C. The method step of providing a pair of boots 70 further includes configuring each boot 70 in the pair of boots to be constructed of lightweight material to allow enhanced movement of the land ski 100 by using a flexible material as an upper 76 in the boot 70. "Enhanced movement" is movement unlike regular ski boot, whereby the boot 70 shares similarities with skate shoes, rather than rigid ski boots. Also, the lightweight configuration allows easier movement of ground ski 100 as well, because it is easier to lift and rotate. The method also includes providing a core structure 104 comprising a rubber lower sole 74, plastic upper sole 72, and internal liner 102. The method further calls for using sonic welding to bond said flexible upper 76 material and the core structure 104 to thereby create a sealed unitary structure, as may be appreciated in FIGS. 22A-24F.

Further included in the method step of providing a pair of boots is incorporating a support structure 104, as may be seen in FIGS. 22A-24F, for a user's ankle and leg by fastening a rigid cuff element 86 around an opening 106 in the upper 76 of the boot 70. The fastening is accomplished by inserting a screw 101 through an aperture 109 in lower cuff extensions 86*a*/86*b* located along a lower perimeter of the cuff through apertures 109/110/108 located in sole extensions 72*a*/72*b* and liner extensions 102*a*/102*b*. Doing this creates a hinge point connecting rigid components of said support structure 104. The method step also includes incorporating a fastening means 84*a*/84*b*/84*c*/78 to provide closure and constrict an internal volume created by the void between said upper 76 and said core structure 104. In some embodiments, the closure means includes a ratchet fastener 84*a* and strap 82, laces 78, and/or a reel knob lacing system 84*b*/78*b*. This method step also includes configuring the boot 70 to engage with a binding 21 by incorporating a toe lug 96 and heel lug 95 into a toe portion 92 and heel portion 94 of a rubber sole 94 and the core structure 104.

Some embodiments of the method for replicating the experience of snow skiing further including using boots 70 with a reel knob lacing system 84*b*/78*b*, having at least one knob 84*c* with an attached reel (internal to the knob). The reel spins about an axis fixed to each boot 70 in the pair of boots 70 and may be turned by the knob 84*c*, as may be seen in FIGS. 25A-25C. The reel is configured to engage with a lace cord 78*b* configured to be wound around the reel. When the knob 84*c* is turned, the reel collects said lace 78*b*, and when the knob 84*c* is turned in an alternate direction, or released, the lace 78*b* releases. A plurality of upper anchors 84*d* are also included that are affixed to the upper 76 of each boot 70 in the pair of boots and engages with the laces 78*b*. When the knob 84*c* is turned to collect the laces 78*b*, the laces 78*b* pull on said upper anchors 84*d*, thereby tightening the upper 76. The lace cord 78*b* acts as laces in each boot 70 in the pair of boots, and the knob 84*c* affixed to the reel is configured to wind the reel when engaged thereby constricting the opening.

The method for replicating the experience of snow skiing further includes embodiments that include a user securing the pair of boots 70 on to the user's feet and engaging each of the boots 70 in the pair of boots with one platform 10, in the pair of independent platforms 10 as shown in FIGS. 1, 17B, 18, 20, and 21B. The boots 70 engage with a binding element 12/12*a*/12*b* thereby affixing the boots 70 to the platform 10. In some maneuvers, the steps further include proceeding on a downhill terrain to gain momentum, shifting a user's weight to a left side of each of the platforms 10 to urge a counter-clockwise rotational direction of said user. In some maneuvers, the steps further include shifting a user's weight to a right side of each of said platforms 10 to urge a clockwise rotational direction of said user. Adjusting a turning radius of said platforms is accomplished by loosening a kingpin 61 in said truck assembly 58 to create a tighter turning radius. The method for replicating the experience of snow skiing further includes embodiments that provide for adjustment of the height of the land skis 100. Lowering the platform 10 to a lower setting is accomplished by removing the axle 55 from each caster 14 in the pair of casters, as shown in FIG. 13, shifting each caster wheel 38 up to a higher cutout 52 on each of the caster frames 42, and reinserting each axle 55 through the higher cutout 52, thereby securing the caster wheel 38 in said caster wheel body 42. Raising the platform 10 to a higher setting is accomplished by removing the axle 55 from each caster 14 in said pair of casters 14, shifting each caster wheel 38 up to a lower cutout 52 on each caster frame 42, and reinserting each axle 55 through the lower cutout 52, thereby securing the caster wheel 38 in the caster wheel body 42.

The method for replicating the experience of snow skiing further includes exerting force on said caster wheels 38, adding pressure on the tension mechanism 51/53/57 therein urging the caster wheel 38 in a direction of the force.

The method for replicating the experience of skiing on dry land also includes providing an ability to turn like a traditional snow ski by configuring the caster wheel 38 to include a bearing with a lower degree of friction than a bearing in said carving wheels 16 to thereby allow said caster wheel 38 to spin at a faster rate then said carving wheels 16.

Although some elements may be absent from the figures, the descriptions herein are sufficient to convey to a person of ordinary skill in the art the structures and inherent functions of the different elements herein.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

I claim:

1. A system for replicating the experience of skiing on dry land, comprising:

a pair of roller skis, wherein each roller ski includes:

a rigid platform with a top and bottom surface having a pair of trucks mounted to the bottom surface wherein carving wheels are mounted to curved axles to provide movability of the rigid platform;

each truck having said curved axles on either side of said truck and said curved axles extending away from each of said trucks in a semicircular arch wherein the distal ends of said axles are closer to the surface of said rigid platform to enhance the turning radius of the rigid platform;

a pair of omnidirectional casters spaced laterally apart toward the distal ends of the rigid platform, wherein a tension cam and tension bar is included within each caster assembly; and an alpine ski binding mount affixed to the top surface of the rigid platform in a front to back orientation configured to receive an alpine ski boot connection;

an alpine ski binding mounted atop of said alpine ski binding mount affixed to the top surface of the rigid platform; and a pair of boots, wherein each boot is configured to engage with said roller ski in said pair of said roller skis, each of said boots in said pair of boots further includes:

an upper constructed of flexible material;

said upper forming an opening configured for receiving a user's foot;

a stiff cuff surrounding said opening;

fastener for tightening said opening;

a tongue portion;

a sole having a top portion and a bottom portion;

said sole configured to include said bottom portion having a linear bottom surface, wherein a toe and heel of said linear bottom surface each outwardly curve upward;

said sole terminating at a forward portion in a toe lug configured for use with an alpine binding connection;

said sole terminating at a rear portion in a heel lug configured for use with an alpine binding connection;

said bottom portion of said sole comprising a rubber lower surface with treads formed therein;

an internal liner;

said internal liner, said upper of flexible material, and said sole are bonded through sonic welding to form a unitary piece, wherein said flexible material is sandwiched between said sole and said internal liner;

laces for constricting a volume created by a cavity between said upper and said sole; and an ankle support structure, wherein said ankle support structure includes:

i. said sole;

ii. a pair of sole extensions protruding from said sole, wherein a first extension is on a medial side of said sole, and a second extension is on a lateral side of said sole, in which said pair of sole extensions are molded from the same piece of material as said sole, each of said sole extensions in said pair of sole extensions having a screw aperture therein;

iii. said internal liner;

iv. a pair of liner extensions protruding from said internal liner, wherein a first extension is on a medial side of said internal liner, and a second extension is on a lateral side of said internal liner, in which said pair of liner extensions are molded from the same piece of material as said internal liner, each of said liner extensions in said pair of liner extensions having a screw aperture therein;

v. said cuff;

vi. a cuff with a pair of cuff extensions protruding downwardly from said cuff, wherein a first extension is on a medial side of said cuff, and a second extension is on a lateral side of said cuff, in which said pair of cuff extensions are molded from the same piece of material as said cuff, each of said cuff extensions in said pair of cuff extensions having a screw aperture therein;

vii. a pair of hinge screws, wherein a first hinge screw in said pair of hinge screws is inserted on a medial side of said support structure through said apertures in said extensions in said sole, internal liner, and cuff, and said second hinge screw in said pair of hinge screws is inserted on a lateral side of said support structure through said apertures in said extensions in said sole, internal liner, and cuff; and viii. said pair of hinge screws thereby creating a pair of hinge points allowing a top portion of said ankle support to move forward to back relative to said hinge point of said ankle support structure to allow flexibility while providing rigid support for a user's ankle.

2. The system as recited in claim 1, wherein said rigid platform for each roller ski in said pair of roller skis further includes a tip portion, a tail portion, an inner side, and an outer side.

3. The system as recited in claim 2, wherein said inner side and said outer side for each roller ski in said pair of roller skis have concave curvature in which said curvature narrows width of said rigid surface laterally inward toward a center of said rigid platform and extends wider towards the distal ends defined by said tail portion and tip portion.

4. The system as recited in claim 2, wherein said rigid platform for each roller ski in said pair of roller skis further includes four wheel cutouts, each cutout of said four wheel cutouts being located above said carving wheels mounted to said curved axles extending from said trucks attached to said rigid surface, and configured to accommodate vertical movement of said wheels mounted to said curved axles extending from said trucks attached to said rigid surface.

5. The system as recited in claim 2, wherein said carving for each roller ski in said pair of roller skis wheels are further configured to achieve carving by using an individual axis of rotation for each individual wheel, providing a variation of forward directions depending on the carving wheel.

6. The system as recited in claim 5, wherein each truck in said pair of trucks for each roller ski in said pair of roller skis is pivotally mounted to a bottom surface of said rigid platform, and configured to shift at each distal end of said axles vertically in both clockwise and counter clockwise rotations based upon the application of weight to a particular side of said top surface of said rigid platform.

7. The system as recited in claim 6, wherein each truck in said pair of trucks is pivotally, further comprises:

a base plate mounted to said bottom surface of said rigid platform, a pivot cup formed within said base plate that a hanger may pivotally engage into, platform formed on said base plate with an aperture wherein a kingpin can fit through said aperture in said base plate and through an aperture in said hanger and engaged with a king pin nut.

8. The system as recited in claim 6, wherein said pivotally mounted trucks for each roller ski in said pair of roller skis are configured with a means of loosening a securement of said trucks, thereby configuring said trucks to allow rotation when weight is placed on an edge of said board causing a forward direction of said wheels forming an arched path for said rigid platform to follow by turning in the direction of the side where weight has been placed.

9. The system as recited in claim 8, wherein the means of loosening said securement of said trucks for each roller ski in said pair of roller skis includes a king pin and a king pin nut that, when tightened reduce the ability of rotation and when loosened increase the ability of pivotal rotation.

10. The system as recited in claim 2, wherein each roller ski in said pair of roller skis, further comprises:

each caster in said pair of omnidirectional casters includes fork body that acts as a frame and a wheel mount for a caster wheel;

said caster wheel is mounted within said fork by an adjustable axle bolt;

said axle bolt extending through a center aperture in said caster wheel;

said axle bolt engaged with an adjustable wheel channel, wherein said caster wheel may be raised or lowered relative to said rigid platform by loosening said axle bolt, adjusting the height said wheel, and tightening said bolt; and said wheel channel including nesting cutouts to assist with securing said bolt at a pre-designated height.

11. The system as recited in claim 10, wherein each roller ski in said pair of roller skis, further comprises:

an aperture in said rigid platform, wherein a stem of said omnidirectional caster may extend through;

a kingpin fitting through said stem and fastening to a locking nut thereby connecting said fork body of said omnidirectional caster to a caster mounting bracket; and said mounting bracket being fastened to a top surface of said rigid platform.

12. The system as recited in claim 6, wherein each roller ski in said pair of roller skis, further comprises:

said alpine ski binding mounted to said alpine ski binding mount with at least one mounting screw fastening a toe portion of said alpine ski binding and securing said alpine ski binding to a front binding channel;

said alpine ski binding mounted to said alpine ski binding mount with at least one mounting screw fastening a heel portion of said alpine ski binding and securing said alpine ski binding to a rear binding channel; and said binding channels allow said alpine ski binding to adjust forwardly and backwardly to accommodate a range of ski boot sizes, as well as locate said alpine ski binding forward or backward from a center point of said rigid platform.

13. The system as recited in claim 12, wherein each roller ski in said pair of roller skis, further comprises:

at least one mounting location in said binding mounting plate, wherein said at least one mounting location includes a plurality of nested screw recesses; and said plurality of nested screw recesses configurable to shift said binding mounting plate forward and backward relative to a center point of said rigid platform.

14. The system as recited in claim 13, wherein said at least one mounting location for each roller ski in said pair of roller skis includes four mounting locations toward a center portion of said binding mounting plate spaced in a square pattern wherein said nested screw recesses line up with apertures in said rigid platform to thereby insert screws in for securement to said rigid platform.

15. The system as recited in claim 1, wherein the fastener for tightening said opening for each boot in said pair of boots is a strap with fastening ribs and a ratchet fastener type buckle.

16. The system as recited in claim 1, wherein said fastener for tightening said opening for each boot in said pair of boots is a reel knob lacing system.

17. The system as recited in claim 16, wherein said reel knob lacing system, further comprises:

at least one knob with an attached reel, wherein said reel spins about an axis fixed to each boot in said pair of boots and may be turned by said knob;

said reel is configured to engage with a lace cord configured to be wound around said reel, wherein when said knob is turned, said reel collects said lace, and when said knob is turned in an alternate direction, said lace releases;

a plurality of upper anchors that are affixed to said upper of each boot in said pair of boots and engages with said laces, wherein when said knob is turned to collect said laces, said laces pull on said upper anchors, thereby tightening said upper; and said lace cord act as said laces in each boot in said pair of boots, and said knob affixed to said reel is configured to wind said reel when engaged thereby constricting said opening.

18. The system as recited in claim 1, wherein said flexible material for said upper for each boot in said pair of boots is a cloth fabric.

19. The system as recited in claim 1, wherein said flexible material for said upper for each boot in said pair of boots is a mesh fabric.

20. The system as recited in claim 1, wherein a material for said ankle support for each boot in said pair of boots is a plastic.

21. The system as recited in claim 1, wherein said caster wheels are configured to include a bearing with a lower degree of friction than a bearing in said carving wheels to thereby allow said caster wheel to spin at a faster rate than said carving wheels.

22. A method for replicating the experience of snow skiing, comprising:

providing a pair of independent platforms, wherein each platform in said pair of independent platforms further includes a pair of caster wheels, a pair of carving wheel assemblies wherein each carving wheel assembly includes a truck with a plurality of carving wheels attached to axles therewith, and a mounting location for a ski boot binding, thereby creating a land ski;

said providing a pair of independent platforms further includes:

configuring each caster in said pair of casters to remain in a linear direction from front to back of said platform until significant pressure is placed on said caster by incorporating a tension mechanism to urge said wheel of said caster to a stable forward-facing position when no force is applied to the casters, and rotating said the caster in a direction of said force when force is applied, wherein said tension mechanism includes at least a tension cam, a tension screw, and a tension bar, configured into a caster mounting bracket of each caster in said pair of casters;

mounting each of said casters in said pair of casters to a top surface of each of said platforms, wherein a stem of said caster descends through an aperture to an underside of said platform to provide additional surface area under said platform for use with ski maneuvers;

configuring said mounting of each caster in said pair of casters to said top surface of each of said platforms to lower the height of the platform relative to a surface on which said caster wheels engage;

providing traction for movement of said platform when said platform is angulated relative to a horizon of ground surface by configuring each carving wheel assembly to include a truck with a plurality of carving wheels rotatably affixed to an axle, wherein said each truck is located at a center axis from front to back relative a center point of a width of said platform, each truck contains a pair of axles, each axle in said pair of axles extend perpendicularly outwardly away from said center point, upwardly, and inward, creating an angled arch;

providing shock absorption by mounting said trucks along said center point of said platform and employing the use of said curved axles, whereby shock absorption is achieved by mounting said curved axles to said truck at a point relative to a center point of said platform and using a semi-rigid material capable of flex providing a degree of vertical travel at the distal ends of each axle; and positioning each truck in said pair of trucks in a location towards the outside of the casters with one caster in a front-most position of said platform and the remaining caster in a back-most portion of said platform to maximize surface area in between said pair of casters;

providing a pair of boots;

said providing a pair of boots further includes:

configuring each boot in said pair of boots to be constructed of lightweight material to allow enhanced movement of said land ski by using a flexible material as an upper in said boot, providing a core structure comprising a rubber lower sole, plastic upper sole, and internal liner;

using sonic welding to bond said flexible upper material and said core structure to thereby create a sealed unitary structure;

incorporating a support structure for a user's ankle and leg by fastening a rigid cuff element around an opening in said upper and said fastening is accomplished by inserting a screw through an aperture in lower cuff extensions located along a lower perimeter of said cuff through an apertures located in sole extensions and liner extensions, thereby creating a hinge point connecting rigid components of said support structure; incorporating a fastening means to provide closure and constrict an internal volume created by the void between said upper and said core structure, wherein said closure means include at least one of a ratchet fastener and strap, laces, and a reel knob lacing system; and configuring said boot to engage with a binding by incorporating a toe lug and heel lug into a toe portion and heel portion of a rubber sole and said core structure.

23. The method for replicating the experience of snow skiing, as recited in claim 22, further comprising:

providing wheel cutouts in said rigid platform corresponding to a location above said carving wheels to allow a greater degree of vertical travel of the wheels and angulation of said platform by allowing said carving wheels to travel beyond a threshold of said top surface of said rigid platform.

24. The method for replicating the experience of snow skiing, as recited in claim 22, further comprising:

providing enhanced clearance of said rigid platform when performing maneuvers that require the board to be inclined relative to a road surface by angulating at least one of a tip and a tail portion upward to provide for greater clearance and degree of rotation at which said carving wheels may engage head-on with a ground surface.

25. The method for replicating the experience of snow skiing, as recited in claim 22, further comprising:

providing a geometry to allow for tighter turning by configuring said platform to include concave curves creating an hourglass shape, thereby increasing the flexure of said platform and allowing tighter turns.

26. The method for replicating the experience of snow skiing, as recited in claim 22, further comprising:

a user securing said pair of boots on to said user's feet engaging each of said boots in said pair of boots with one platform in said pair of independent platforms, wherein said boots engage with a said binding element thereby affixing the boots to the platform;

proceeding on a downhill terrain to gain momentum;

shifting said user's weight to a left side of each of said platforms to urge a counter-clockwise rotational direction of said user;

shifting said user's weight to a right side of each of said platforms to urge a clockwise rotational direction of said user; and adjusting a turning radius of said platforms by loosening a kingpin in said truck assembly to create a tighter turning radius.

27. The method for replicating the experience of snow skiing, as recited in claim 26, further comprising:

exerting force on said caster wheels, thereby adding pressure on the tension mechanism therein urging said caster wheel in a direction of said force.

28. The method for replicating the experience of snow skiing, as recited in claim 22, further comprising:

lowering the platform to a lower setting by removing the axle from each caster in said pair of casters;

shifting each caster wheel up to a higher cutout on each of said caster frame; and reinserting each axle through said higher cutout, thereby securing said caster wheel in said caster wheel body.

29. The method for replicating the experience of snow skiing, as recited in claim 22, further comprising:

raising the platform to a higher setting by removing the axle from each caster in said pair of casters;

shifting each caster wheel up to a lower cutout on each of said caster frame; and reinserting each axle through said lower cutout, thereby securing said caster wheel in said caster wheel body.

30. The method as recited in claim 22, wherein the reel knob lacing system, further comprises:

at least one knob with an attached reel, wherein said reel spins about an axis fixed to each boot in said pair of boots and may be turned by said knob;

said reel is configured to engage with a lace cord configured to be wound around said reel, wherein when said knob is turned, said reel collects said lace, and when said knob is turned in an alternate direction, said lace releases;

a plurality of upper anchors that are affixed to said upper of each boot in said pair of boots and engages with said laces, wherein when said knob is turned to collect said laces, said laces pull on said upper anchors, thereby tightening said upper; and said lace cord act as said laces in each boot in said pair of boots, and said knob affixed to said reel is configured to wind said reel when engaged thereby constricting said opening.

31. The method as recited in claim 22, further comprising:

providing an ability to turn like a traditional snow ski by configuring the caster wheel to include a bearing with a lower degree of friction than a bearing in said carving wheels to thereby allow said caster wheel to spin at a faster rate than said carving wheels.

32. A system for replicating the experience of skiing on dry land, comprising:

a pair of roller skis, wherein each roller ski includes:

a rigid platform with a top and bottom surface having a pair of trucks mounted to the bottom surface wherein carving wheels are mounted to curved axles to provide movability of the rigid platform;

each truck having said curved axles on either side of said truck and said curved axles extending away from each of said trucks in a semicircular arch wherein the distal ends of said axles are closer to the surface of said rigid platform to enhance the turning radius of the rigid platform;

a pair of omnidirectional casters spaced laterally apart toward the distal ends of the rigid platform;

an alpine ski binding mount affixed to the top surface of the rigid platform in a front to back orientation configured to receive an alpine ski boot connection; and said rigid platform further includes four wheel cutouts, each cutout of said four wheel cutouts being located above said carving wheels mounted to said curved axles extending from said trucks attached to said rigid surface, and configured to accommodate vertical movement of said wheels mounted to said curved axles extending from said trucks attached to said rigid surface;

an alpine ski binding mounted atop of said alpine ski binding mount affixed to the top surface of the rigid platform; and a pair of boots, wherein each boot is configured to engage with said roller ski in said pair of said roller skis.

33. A system for replicating the experience of skiing on dry land, comprising:

a pair of roller skis, wherein each roller ski includes:

a rigid platform with a top and bottom surface having a pair of trucks mounted to the bottom surface wherein carving wheels are mounted to curved axles to provide movability of the rigid platform, wherein said rigid platform further includes a tip portion, a tail portion, an inner side, and an outer side;

each truck having said curved axles on either side of said truck and said curved axles extending away from each of said trucks in a semicircular arch wherein the distal ends of said axles are closer to the surface of said rigid platform to enhance the turning radius of the rigid platform;

a pair of omnidirectional casters spaced laterally apart toward the distal ends of the rigid platform;

an alpine ski binding mount affixed to the top surface of the rigid platform in a front to back orientation configured to receive an alpine ski boot connection;

said carving wheels are further configured to achieve carving by using an individual axis of rotation for each individual wheel, providing a variation of forward directions depending on the carving wheel; and each truck in said pair of trucks is pivotally mounted to said bottom surface of said rigid platform, and configured to shift at each distal end of said axles vertically in both clockwise and counter clockwise rotations based, wherein each truck in said pair of trucks further comprises a base plate mounted to said bottom surface of said rigid platform, a pivot cup formed within said base plate that a hanger may pivotally engage into, platform formed on said base plate with an aperture wherein a kingpin can fit through said aperture in said base plate and through an aperture in said hanger and engaged with a king pin nut;

an alpine ski binding mounted atop of said alpine ski binding mount affixed to the top surface of the rigid platform; and a pair of boots, wherein each boot is configured to engage with said roller ski in said pair of said roller skis.

34. A system for replicating the experience of skiing on dry land, comprising:

a pair of roller skis, wherein each roller ski includes:

a rigid platform with a top and bottom surface having a pair of trucks mounted to the bottom surface wherein carving wheels are mounted to curved axles to provide movability of the rigid platform, wherein said rigid platform further includes a tip portion, a tail portion, an inner side, and an outer side;

each truck having said curved axles on either side of said truck and said curved axles extending away from each of said trucks in a semicircular arch wherein the distal ends of said axles are closer to the surface of said rigid platform to enhance the turning radius of the rigid platform;

a pair of omnidirectional casters spaced laterally apart toward the distal ends of the rigid platform;

an alpine ski binding mount affixed to the top surface of the rigid platform in a front to back orientation configured to receive an alpine ski boot connection;

each caster in said pair of omnidirectional casters includes fork body that acts as a frame and a wheel mount for a caster wheel;

said fork body rotatably coupled to a caster mounting bracket by insertion of a kingpin through said fork body, and use of a bearing; and between said fork body and said caster mounting bracket is a tension cam, which is configured in a shape that provides force on a tension screw of a tension bar when each caster in said pair of casters is rotated, thereby urging said caster towards a stable position when no force is exerted on said caster, and urging a caster in a direction of force when said force is applied;

an alpine ski binding mounted atop of said alpine ski binding mount affixed to the top surface of the rigid platform; and a pair of boots, wherein each boot is configured to engage with said roller ski in said pair of said roller skis.

35. A system for replicating the experience of skiing on dry land, comprising:

a pair of roller skis, wherein each roller ski includes:

a rigid platform with a top and bottom surface having a pair of trucks mounted to the bottom surface wherein carving wheels are mounted to curved axles to provide movability of the rigid platform;

each truck having said curved axles on either side of said truck and said curved axles extending away from each of said trucks in a semicircular arch wherein the distal ends of said axles are closer to the surface of said rigid platform to enhance the turning radius of the rigid platform;

a pair of omnidirectional casters spaced laterally apart toward the distal ends of the rigid platform;

an alpine ski binding mount affixed to the top surface of the rigid platform in a front to back orientation configured to receive an alpine ski boot connection;

an alpine ski binding mounted atop of said alpine ski binding mount affixed to the top surface of the rigid platform;

said alpine ski binding mounted to said alpine ski binding mount with at least one mounting screw fastening a toe portion of said alpine ski binding and securing said alpine ski binding to a front binding channel;

said alpine ski binding mounted to said alpine ski binding mount with at least one mounting screw fastening a heel portion of said alpine ski binding and securing said alpine ski binding to a rear binding channel; and said binding channels allow said alpine ski binding to adjust forwardly and backwardly to accommodate a range of ski boot sizes, as well as locate said alpine ski binding forward or backward from a center point of said rigid platform;

an alpine ski binding mounted atop of said alpine ski binding mount affixed to the top surface of the rigid platform; and a pair of boots, wherein each boot is configured to engage with said roller ski in said pair of said roller skis.

36. A system for replicating the experience of skiing on dry land, comprising:

a pair of roller skis, wherein each roller ski includes:

a rigid platform with a top and bottom surface having a pair of trucks mounted to the bottom surface wherein carving wheels are mounted to curved axles to provide movability of the rigid platform;

each truck having said curved axles on either side of said truck and said curved axles extending away from each of said trucks in a semicircular arch wherein the distal ends of said axles are closer to the surface of said rigid platform to enhance the turning radius of the rigid platform;

a pair of omnidirectional casters spaced laterally apart toward the distal ends of the rigid platform, wherein caster wheels in said pair of omnidirectional casters are configured to include a bearing with a lower degree of friction than a bearing in said carving wheels to thereby allow said caster wheel to spin at a faster rate than said carving wheels; and an alpine ski binding mount affixed to the top surface of the rigid platform in a front to back orientation configured to receive an alpine ski boot connection;

an alpine ski binding mounted atop of said alpine ski binding mount affixed to the top surface of the rigid platform; and a pair of boots, wherein each boot is configured to engage with said roller ski in said pair of said roller skis.

37. A method for replicating the experience of snow skiing, comprising:

providing a pair of independent platforms, wherein each platform in said pair of independent platforms further includes a pair of caster wheels, a pair of carving wheel assemblies wherein each carving wheel assembly includes a truck with a plurality of carving wheels attached to axles therewith, and a mounting location for a ski boot binding, thereby creating a land ski;

said providing a pair of independent platforms further includes:

configuring each caster in said pair of casters to remain in a linear direction from front to back of said platform until significant pressure is placed on said caster by incorporating a tension mechanism to urge said wheel of said caster to a stable forward-facing position when no force is applied to the casters, and rotating said the caster in a direction of said force when force is applied, wherein said tension mechanism includes at least a tension cam, a tension screw, and a tension bar, configured into a caster mounting bracket of each caster in said pair of casters;

mounting each of said casters in said pair of casters to a top surface of each of said platforms, wherein a stem of said caster descends through an aperture to an underside of said platform to provide additional surface area under said platform for use with ski maneuvers;

configuring said mounting of each caster in said pair of casters to said top surface of each of said platforms to lower the height of the platform relative to a surface on which said caster wheels engage;

providing traction for movement of said platform when said platform is angulated relative to a horizon of ground surface by configuring each carving wheel assembly to include a truck with a plurality of carving wheels rotatably affixed to an axle, wherein said each truck is located at a center axis from front to back relative a center point of a width of said platform, each truck contains a pair of axles, each axle in said pair of axles extend perpendicularly outwardly away from said center point, upwardly, and inward, creating an angled arch;

providing shock absorption by mounting said trucks along said center point of said platform and employing the use of said curved axles, whereby shock absorption is achieved by mounting said curved axles to said truck at a point relative to a center point of said platform and using a semi-rigid material capable of flex providing a degree of vertical travel at the distal ends of each axle; and positioning each truck in said pair of trucks in a location towards the outside of the casters with one caster in a front-most position of said platform and the remaining caster in a back-most portion of said platform to maximize surface area in between said pair of casters; and providing a pair of boots.

38. A method for replicating the experience of snow skiing, comprising:

providing a pair of independent platforms with a top and bottom surface, wherein each platform in said pair of independent platforms further includes:

a pair of trucks mounted to the bottom surface wherein carving wheels are mounted to curved axles to provide movability of the platform;

each truck having said curved axles on either side of said truck and said curved axles extending away from each of said trucks in a semicircular angled arch wherein the distal ends of said axles are closer to the surface of said platform to enhance the turning radius of the platform;

a pair of casters spaced laterally apart toward the distal ends of the platform; a mounting location for an alpine ski boot binding;

an alpine ski boot binding mount affixed to the top surface of the platform in a front to back orientation configured to receive an alpine ski boot connection;

said platform further includes four wheel cutouts, each cutout of said four wheel cutouts being located above said carving wheels mounted to said curved axles extending from said trucks attached to said platform, and configured to accommodate vertical movement of said wheels mounted to said curved axles extending from said trucks attached to said platform; thereby creating a land ski; and providing a pair of boots.

39. The method for replicating the experience of snow skiing, as recited in claim 38, wherein said providing a pair of independent platforms further includes:

configuring each caster in said pair of casters to remain in a linear direction from front to back of said platform until significant pressure is placed on said caster by incorporating a tension mechanism to urge a wheel of said caster to a stable forward-facing position when no force is applied to the casters, and rotating said the caster in a direction of said force when force is applied, wherein said tension mechanism includes at least a tension cam, a tension screw, and a tension bar, configured into a caster mounting bracket of each caster in said pair of casters;

mounting each of said casters in said pair of casters to said top surface of each of said platforms, wherein a stem of said caster descends through an aperture to an underside of said platform to provide additional surface area under said platform for use with ski maneuvers;

configuring said mounting of each caster in said pair of casters to said top surface of each of said platforms to lower the height of the platform relative to a surface on which said caster wheels engage;

providing traction for movement of said platform when said platform is angulated relative to a horizon of ground surface by configuring each carving wheel assembly to include said truck with a plurality of said carving wheels rotatably affixed to said axle, wherein said each truck is located at a center axis from front to back relative a center point of a width of said platform, each truck contains said curved axles on either side of said truck forming a pair of axles, each axle in said pair of axles extend perpendicularly outwardly away from said center point, upwardly, and inward, creating said angled arch;

providing shock absorption by mounting said trucks along said center point of said platform and employing the use of said curved axles, whereby shock absorption is achieved by mounting said curved axles to said truck at a point relative to a center point of said platform and using a semi-rigid material capable of flex providing a degree of vertical travel at the distal ends of each axle; and positioning each truck in said pair of trucks in a location towards the outside of the casters with one caster in a front-most position of said platform and the remaining caster in a back-most portion of said platform to maximize surface area in between said pair of casters.

40. A method for replicating the experience of snow skiing, comprising:

providing a pair of independent platforms with a top and bottom surface, wherein each platform in said pair of independent platforms further includes:

a pair of trucks mounted to the bottom surface wherein carving wheels are mounted to curved axles to provide movability of the platform;

each truck having said curved axles on either side of said truck and said curved axles extending away from each of said trucks in a semicircular angled arch wherein the distal ends of said axles are closer to the surface of said platform to enhance the turning radius of the platform;

a pair of casters spaced laterally apart toward the distal ends of the platform; a mounting location for an alpine ski boot binding;

an alpine ski boot binding mount affixed to the top surface of the platform in a front to back orientation configured to receive an alpine ski boot connection;

said carving wheels are further configured to achieve carving by using an individual axis of rotation for each individual wheel, providing a variation of forward directions depending on the carving wheel;

each truck in said pair of trucks is pivotally mounted to a bottom surface of said rigid platform, and configured to shift at each distal end of said axles vertically in both clockwise and counter clockwise rotations based, wherein each truck in said pair of trucks, further comprises a base plate mounted to said bottom surface of said rigid platform, a pivot cup formed within said base plate that a hanger may pivotally engage into, platform formed on said base plate with an aperture wherein a kingpin can fit through said aperture in said base plate and through an aperture in said hanger and engaged with a king pin nut;

thereby creating a land ski; and providing a pair of boots.

41. The method for replicating the experience of snow skiing, as recited in claim 40, wherein said providing a pair of independent platforms further includes:

configuring each caster in said pair of casters to remain in a linear direction from front to back of said platform until significant pressure is placed on said caster by incorporating a tension mechanism to urge a wheel of said caster to a stable forward-facing position when no force is applied to the casters, and rotating said the caster in a direction of said force when force is applied, wherein said tension mechanism includes at least a tension cam, a tension screw, and a tension bar, configured into a caster mounting bracket of each caster in said pair of casters;

mounting each of said casters in said pair of casters to said top surface of each of said platforms, wherein a stem of said caster descends through an aperture to an underside of said platform to provide additional surface area under said platform for use with ski maneuvers;

configuring said mounting of each caster in said pair of casters to said top surface of each of said platforms to lower the height of the platform relative to a surface on which said caster wheels engage;

providing traction for movement of said platform when said platform is angulated relative to a horizon of ground surface by configuring each carving wheel assembly to include said truck with a plurality of said carving wheels rotatably affixed to said axle, wherein said each truck is located at a center axis from front to back relative a center point of a width of said platform, each truck contains said curved axles on either side of said truck forming a pair of axles, each axle in said pair of axles extend perpendicularly outwardly away from said center point, upwardly, and inward, creating said angled arch;

providing shock absorption by mounting said trucks along said center point of said platform and employing the use of said curved axles, whereby shock absorption is achieved by mounting said curved axles to said truck at a point relative to a center point of said platform and using a semi-rigid material capable of flex providing a degree of vertical travel at the distal ends of each axle; and positioning each truck in said pair of trucks in a location towards the outside of the casters with one caster in a front-most position of said platform and the remaining caster in a back-most portion of said platform to maximize surface area in between said pair of casters.

42. A method for replicating the experience of snow skiing, comprising:

providing a pair of independent platforms with a top and bottom surface, wherein each platform in said pair of independent platforms further includes:

a pair of trucks mounted to the bottom surface wherein carving wheels are mounted to curved axles to provide movability of the platform;

each truck having said curved axles on either side of said truck and said curved axles extending away from each of said trucks in a semicircular angled arch wherein the distal ends of said axles are closer to the surface of said platform to enhance the turning radius of the platform;

a pair of casters spaced laterally apart toward the distal ends of the platform; a mounting location for an alpine ski boot binding;

an alpine ski boot binding mount affixed to the top surface of the platform in a front to back orientation configured to receive an alpine ski boot connection;

each caster in said pair of omnidirectional casters includes fork body that acts as a frame and a wheel mount for a caster wheel;

said fork body rotatably coupled to a caster mounting bracket by insertion of a kingpin through said fork body, and use of a bearing; and between said fork body and said caster mounting bracket is a tension cam, which is configured in a shape that provides force on a tension screw of a tension bar when each caster in said pair of casters is rotated, thereby urging said caster towards a stable position when no force is exerted on said caster, and urging a caster in a direction of force when said force is applied;

thereby creating a land ski; and providing a pair of boots.

43. The method for replicating the experience of snow skiing, as recited in claim 42, wherein said providing a pair of independent platforms further includes:

configuring each caster in said pair of casters to remain in a linear direction from front to back of said platform until significant pressure is placed on said caster by incorporating a tension mechanism to urge a wheel of said caster to a stable forward-facing position when no force is applied to the casters, and rotating said the caster in a direction of said force when force is applied, wherein said tension mechanism includes at least a tension cam, a tension screw, and a tension bar, configured into a caster mounting bracket of each caster in said pair of casters;

mounting each of said casters in said pair of casters to said top surface of each of said platforms, wherein a stem of said caster descends through an aperture to an underside of said platform to provide additional surface area under said platform for use with ski maneuvers;

configuring said mounting of each caster in said pair of casters to said top surface of each of said platforms to lower the height of the platform relative to a surface on which said caster wheels engage;

providing traction for movement of said platform when said platform is angulated relative to a horizon of ground surface by configuring each carving wheel assembly to include said truck with a plurality of said carving wheels rotatably affixed to said axle, wherein said each truck is located at a center axis from front to back relative a center point of a width of said platform, each truck contains said curved axles on either side of said truck forming a pair of axles, each axle in said pair of axles extend perpendicularly outwardly away from said center point, upwardly, and inward, creating said angled arch;

providing shock absorption by mounting said trucks along said center point of said platform and employing the use of said curved axles, whereby shock absorption is achieved by mounting said curved axles to said truck at a point relative to a center point of said platform and using a semi-rigid material capable of flex providing a degree of vertical travel at the distal ends of each axle; and positioning each truck in said pair of trucks in a location towards the outside of the casters with one caster in a front-most position of said platform and the remaining caster in a back-most portion of said platform to maximize surface area in between said pair of casters.

44. A method for replicating the experience of snow skiing, comprising:

providing a pair of independent platforms with a top and bottom surface, wherein each platform in said pair of independent platforms further includes:

a pair of trucks mounted to the bottom surface wherein carving wheels are mounted to curved axles to provide movability of the platform;

each truck having said curved axles on either side of said truck and said curved axles extending away from each of said trucks in a semicircular angled arch wherein the distal ends of said axles are closer to the surface of said platform to enhance the turning radius of the platform;

a pair of casters spaced laterally apart toward the distal ends of the platform; a mounting location for an alpine ski boot binding;

an alpine ski boot binding mount affixed to the top surface of the platform in a front to back orientation configured to receive an alpine ski boot connection;

said alpine ski boot binding mounted atop of said alpine ski binding mount affixed to the top surface of the platform;

said alpine ski binding mounted to said alpine ski binding mount with at least one mounting screw fastening a toe portion of said alpine ski binding and securing said alpine ski binding to a front binding channel;

said alpine ski binding mounted to said alpine ski binding mount with at least one mounting screw fastening a heel portion of said alpine ski binding and securing said alpine ski binding to a rear binding channel; and said binding channels allow said alpine ski binding to adjust forwardly and backwardly to accommodate a range of ski boot sizes, as well as locate said alpine ski binding forward or backward from a center point of said platform; thereby creating a land ski; and providing a pair of boots.

45. The method for replicating the experience of snow skiing, as recited in claim 44, wherein said providing a pair of independent platforms further includes:

configuring each caster in said pair of casters to remain in a linear direction from front to back of said platform until significant pressure is placed on said caster by incorporating a tension mechanism to urge a wheel of said caster to a stable forward-facing position when no force is applied to the casters, and rotating said the caster in a direction of said force when force is applied, wherein said tension mechanism includes at least a tension cam, a tension screw, and a tension bar, configured into a caster mounting bracket of each caster in said pair of casters;

mounting each of said casters in said pair of casters to said top surface of each of said platforms, wherein a stem of said caster descends through an aperture to an underside of said platform to provide additional surface area under said platform for use with ski maneuvers;

configuring said mounting of each caster in said pair of casters to said top surface of each of said platforms to lower the height of the platform relative to a surface on which said caster wheels engage;

providing traction for movement of said platform when said platform is angulated relative to a horizon of ground surface by configuring each carving wheel assembly to include said truck with a plurality of said carving wheels rotatably affixed to said axle, wherein said each truck is located at a center axis from front to back relative a center point of a width of said platform, each truck contains said curved axles on either side of said truck forming a pair of axles, each axle in said pair of axles extend perpendicularly outwardly away from said center point, upwardly, and inward, creating said angled arch;

providing shock absorption by mounting said trucks along said center point of said platform and employing the use of said curved axles, whereby shock absorption is achieved by mounting said curved axles to said truck at a point relative to a center point of said platform and using a semi-rigid material capable of flex providing a degree of vertical travel at the distal ends of each axle; and positioning each truck in said pair of trucks in a location towards the outside of the casters with one caster in a front-most position of said platform and the remaining caster in a back-most portion of said platform to maximize surface area in between said pair of casters.

46. A method for replicating the experience of snow skiing, comprising:

providing a pair of independent platforms with a top and bottom surface, wherein each platform in said pair of independent platforms further includes:

a pair of trucks mounted to the bottom surface wherein carving wheels are mounted to curved axles to provide movability of the platform;

each truck having said curved axles on either side of said truck and said curved axles extending away from each of said trucks in a semicircular angled arch wherein the distal ends of said axles are closer to the surface of said platform to enhance the turning radius of the platform;

a pair of casters spaced laterally apart toward the distal ends of the platform; a mounting location for an alpine ski boot binding;

an alpine ski boot binding mount affixed to the top surface of the platform in a front to back orientation configured to receive an alpine ski boot connection;

wherein said caster wheels in said pair of casters are configured to include a bearing with a lower degree of friction than a bearing in said carving wheels to thereby allow said caster wheel to spin at a faster rate than said carving wheels;

thereby creating a land ski; and providing a pair of boots.

47. The method for replicating the experience of snow skiing, as recited in claim 46, wherein said providing a pair of independent platforms further includes:

configuring each caster in said pair of casters to remain in a linear direction from front to back of said platform until significant pressure is placed on said caster by incorporating a tension mechanism to urge a wheel of said caster to a stable forward-facing position when no force is applied to the casters, and rotating said the caster in a direction of said force when force is applied, wherein said tension mechanism includes at least a tension cam, a tension screw, and a tension bar, configured into a caster mounting bracket of each caster in said pair of casters;

mounting each of said casters in said pair of casters to said top surface of each of said platforms, wherein a stem of said caster descends through an aperture to an underside of said platform to provide additional surface area under said platform for use with ski maneuvers;

configuring said mounting of each caster in said pair of casters to said top surface of each of said platforms to lower the height of the platform relative to a surface on which said caster wheels engage;

providing traction for movement of said platform when said platform is angulated relative to a horizon of ground surface by configuring each carving wheel assembly to include said truck with a plurality of said carving wheels rotatably affixed to said axle, wherein said each truck is located at a center axis from front to back relative a center point of a width of said platform, each truck contains said curved axles on either side of said truck forming a pair of axles, each axle in said pair of axles extend perpendicularly outwardly away from said center point, upwardly, and inward, creating said angled arch;

providing shock absorption by mounting said trucks along said center point of said platform and employing the use of said curved axles, whereby shock absorption is achieved by mounting said curved axles to said truck at a point relative to a center point of said platform and using a semi-rigid material capable of flex providing a degree of vertical travel at the distal ends of each axle; and positioning each truck in said pair of trucks in a location towards the outside of the casters with one caster in a front-most position of said platform and the remaining caster in a back-most portion of said platform to maximize surface area in between said pair of casters.

* * * * *